US012571115B2

(12) United States Patent
Shimizu et al.

(10) Patent No.: US 12,571,115 B2
(45) Date of Patent: Mar. 10, 2026

(54) ELECTROLYZER, AND METHOD FOR PRODUCING ELECTROLYZER

(71) Applicant: ASAHI KASEI KABUSHIKI KAISHA, Tokyo (JP)

(72) Inventors: Shujiro Shimizu, Tokyo (JP); Mamoru Matsuoka, Tokyo (JP); Akiyasu Funakawa, Tokyo (JP); Yoshifumi Kado, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 687 days.

(21) Appl. No.: 17/801,976

(22) PCT Filed: Feb. 26, 2021

(86) PCT No.: PCT/JP2021/007310
§ 371 (c)(1),
(2) Date: Aug. 24, 2022

(87) PCT Pub. No.: WO2021/172508
PCT Pub. Date: Sep. 2, 2021

(65) Prior Publication Data

US 2023/0140700 A1 May 4, 2023

(30) Foreign Application Priority Data

Feb. 26, 2020 (JP) ..... 2020-030768
May 12, 2020 (JP) ..... 2020-083726

(51) Int. Cl.
*C25B 9/63* (2021.01)
*C25B 9/23* (2021.01)
(Continued)

(52) U.S. Cl.
CPC ..... *C25B 9/63* (2021.01); *C25B 9/23* (2021.01); *C25B 9/60* (2021.01); *C25B 9/77* (2021.01);
(Continued)

(58) Field of Classification Search
CPC .... C25B 1/04; C25B 1/46; C25B 9/60; C25B 9/63; C25B 11/02; C25B 13/00;
(Continued)

(56) References Cited

U.S. PATENT DOCUMENTS 4,340,452 A * 7/1982 deNora ..... C25B 11/02 204/266
4,444,632 A * 4/1984 deNora ..... C25B 9/65 204/266
(Continued)

FOREIGN PATENT DOCUMENTS

CN 104254644 A 12/2014
CN 105531399 A 4/2016
(Continued)

OTHER PUBLICATIONS

European Search Report that issued in European Patent Application No. 21761532.7, dated Jan. 23, 2025.
(Continued)

*Primary Examiner* — Luan V Van
*Assistant Examiner* — Alexander R. Parent
(74) *Attorney, Agent, or Firm* — Greenblum & Bernstein, P.L.C.

(57) ABSTRACT

An electrolyzer containing:
an anode,
a cathode that is opposed to the anode,
a membrane that is arranged between the anode and the cathode;
a first elastic body that presses the cathode in a direction toward the anode,
(Continued)

a first electrode for electrolysis that is arranged between the membrane and the cathode; and a second elastic body that is arranged between the first electrode for electrolysis and the cathode and presses the first electrode for electrolysis in the direction toward the anode, wherein the first electrode for electrolysis serves as a cathode electrode, and the first electrode for electrolysis, the second elastic body, the cathode, and the first elastic body are electrically connected.

17 Claims, 15 Drawing Sheets

(51) Int. Cl.

| | |
|---|---|
| ***C25B 9/60*** | (2021.01) |
| ***C25B 9/77*** | (2021.01) |
| ***C25B 11/02*** | (2021.01) |
| ***C25B 15/00*** | (2006.01) |
| *C25B 1/04* | (2021.01) |
| *C25B 1/46* | (2006.01) |

(52) U.S. Cl.
CPC ..... *C25B 11/02* (2013.01); *C25B 15/00* (2013.01); *C25B 1/04* (2013.01); *C25B 1/46* (2013.01)

(58) Field of Classification Search
CPC ..... C25B 13/02; C25B 15/00; C25B 15/04; C25B 9/77
USPC ..... 204/297.09, 297.1, 297.14
See application file for complete search history.

(56) References Cited

U.S. PATENT DOCUMENTS

| | | | | |
|---|---|---|---|---|
| 5,873,987 | A | 2/1999 | Katayama et al. | |
| 6,841,047 | B2 * | 1/2005 | Gestermann | C25B 1/26 204/252 |
| 7,323,090 | B2 | 1/2008 | Houda et al. | |
| 9,797,051 | B2 * | 10/2017 | Federico | C25B 9/19 |
| 10,208,388 | B2 * | 2/2019 | Hatano | C25B 9/23 |
| 2006/0042935 | A1 | 3/2006 | Houda et al. | |
| 2009/0008261 | A1 | 1/2009 | Kotzeva et al. | |
| 2015/0114830 | A1 * | 4/2015 | Asaumi | C25B 9/63 204/252 |
| 2016/0237577 | A1 | 8/2016 | Hatano et al. | |
| 2020/0102662 | A1 | 4/2020 | Funakawa et al. | |
| 2020/0340130 | A1 * | 10/2020 | Tanaka | C25B 9/73 |

FOREIGN PATENT DOCUMENTS

| | | | | | |
|---|---|---|---|---|---|
| EP | 0 823 495 | A1 | | 2/1998 | |
| JP | 55-148775 | A | | 11/1980 | |
| JP | 58-048686 | A | | 3/1983 | |
| JP | 10-053887 | A | | 2/1998 | |
| JP | 2000178781 | A | * | 6/2000 | |
| JP | 2010-037619 | A | | 2/2010 | |
| JP | 2010-111947 | A | | 5/2010 | |
| JP | 2012-140653 | A | | 7/2012 | |
| JP | 5047265 | B2 | | 7/2012 | |
| JP | 2013-231218 | A | | 11/2013 | |
| JP | 2017088952 | A | * | 5/2017 | |
| JP | 6380405 | B2 | | 8/2018 | |
| JP | 2019-163524 | A | | 9/2019 | |
| JP | 2019-163525 | A | | 9/2019 | |
| JP | 2019-163526 | A | | 9/2019 | |
| WO | 2015/068579 | A1 | | 5/2015 | |
| WO | WO-2019111832 | A1 | * | 6/2019 | C25B 9/75 |

OTHER PUBLICATIONS

International Search Report and Written Opinion of the International Searching Authority issued in International Patent Application No. PCT/JP2021/007310, dated Mar. 30, 2021, along with an English translation thereof.

International Preliminary Report on Patentability issued in International Patent Application No. PCT/JP2021/007310, dated Aug. 30, 2022, along with an English translation thereof.

* cited by examiner

[Figure 1]
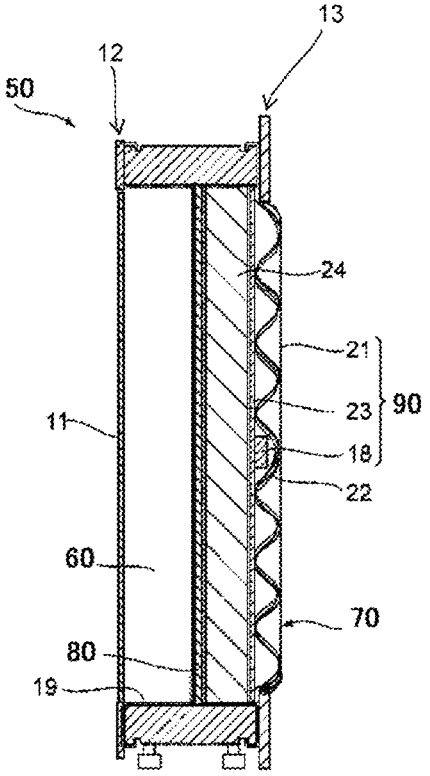

[Figure 2]
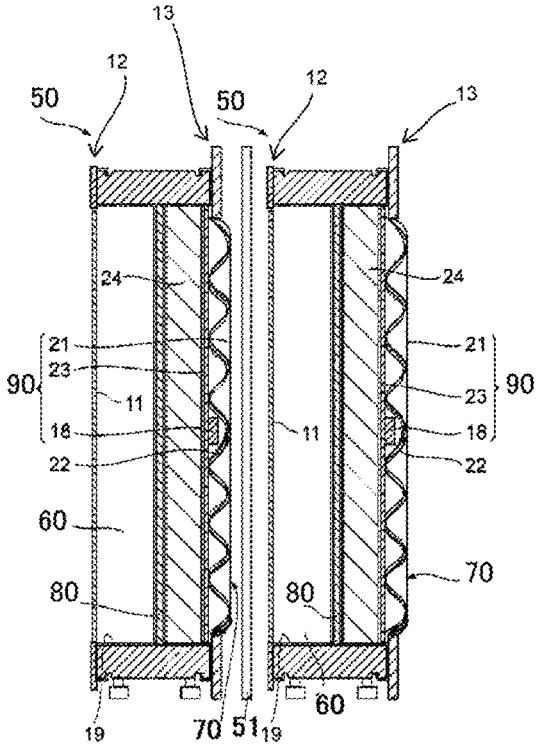

[Figure 3]
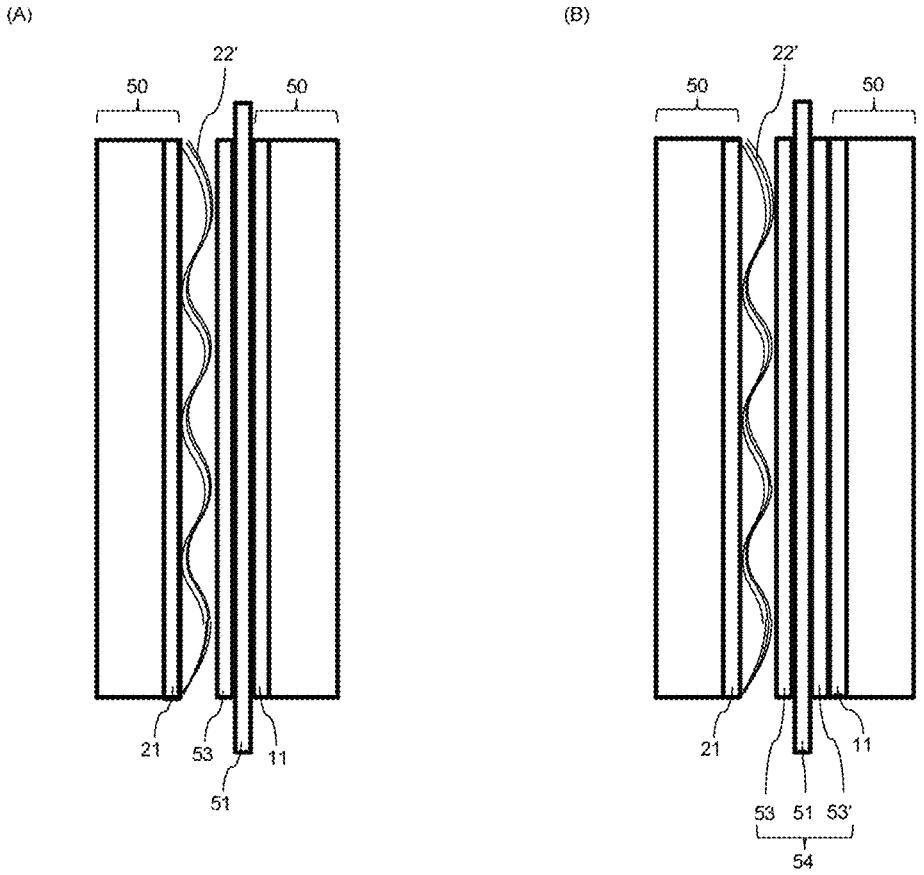
[Figure 4]
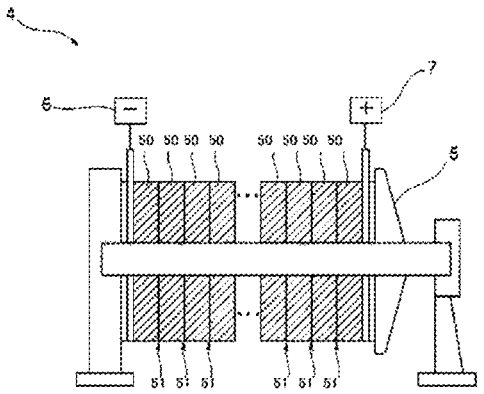

[Figure 5]
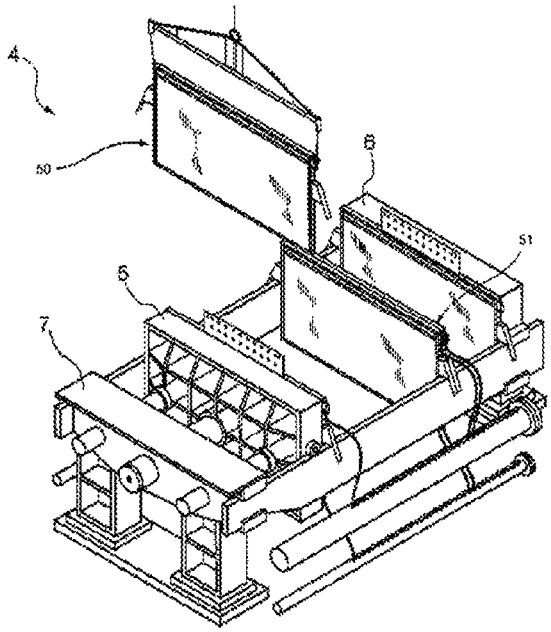
[Figure 6]
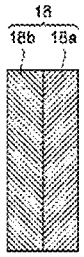
[Figure 7]
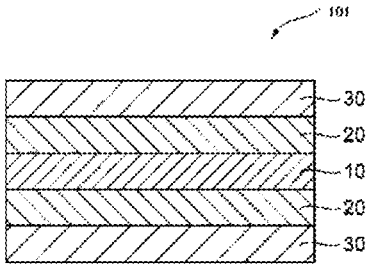

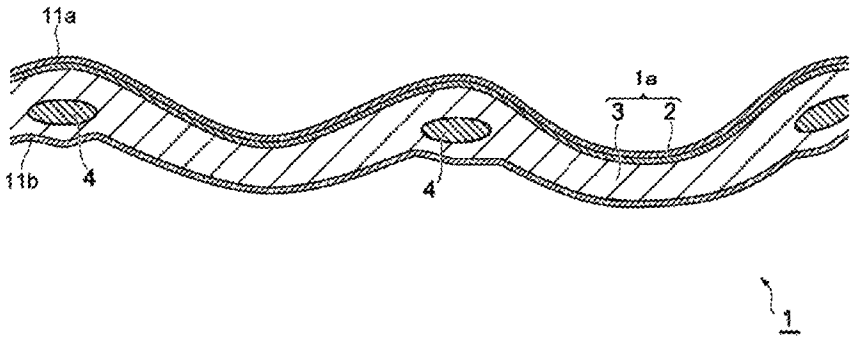
[Figure 8]

[Figure 9]
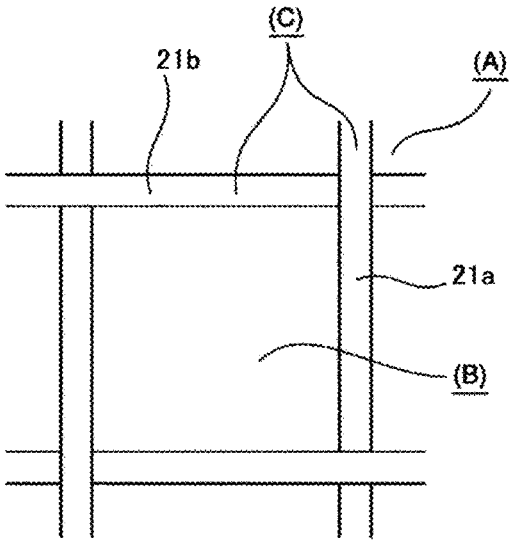
(B) = (A) − (C)
(B)/(A) = {(A) − (C)}/(A)

[Figure 10]
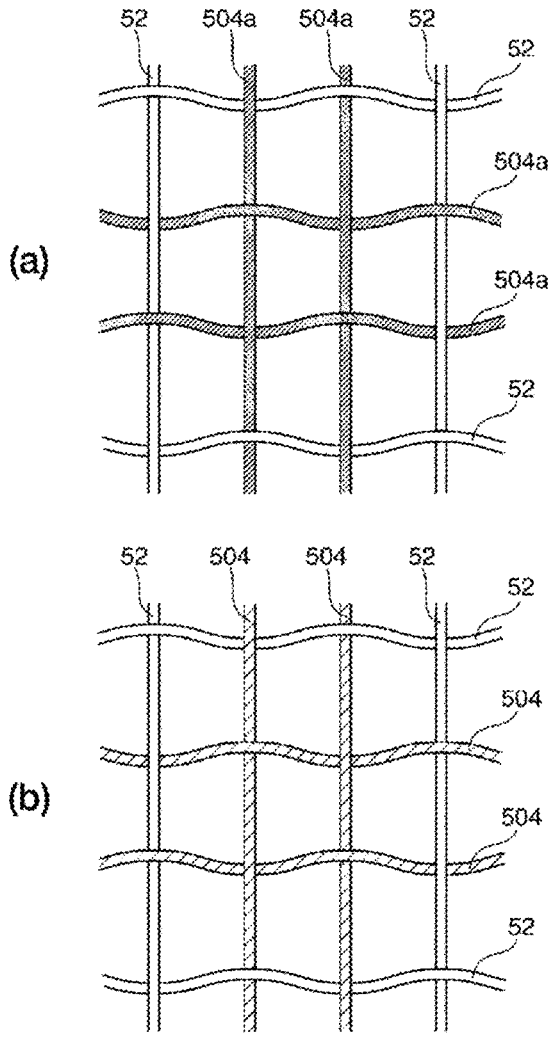

[Figure 11]
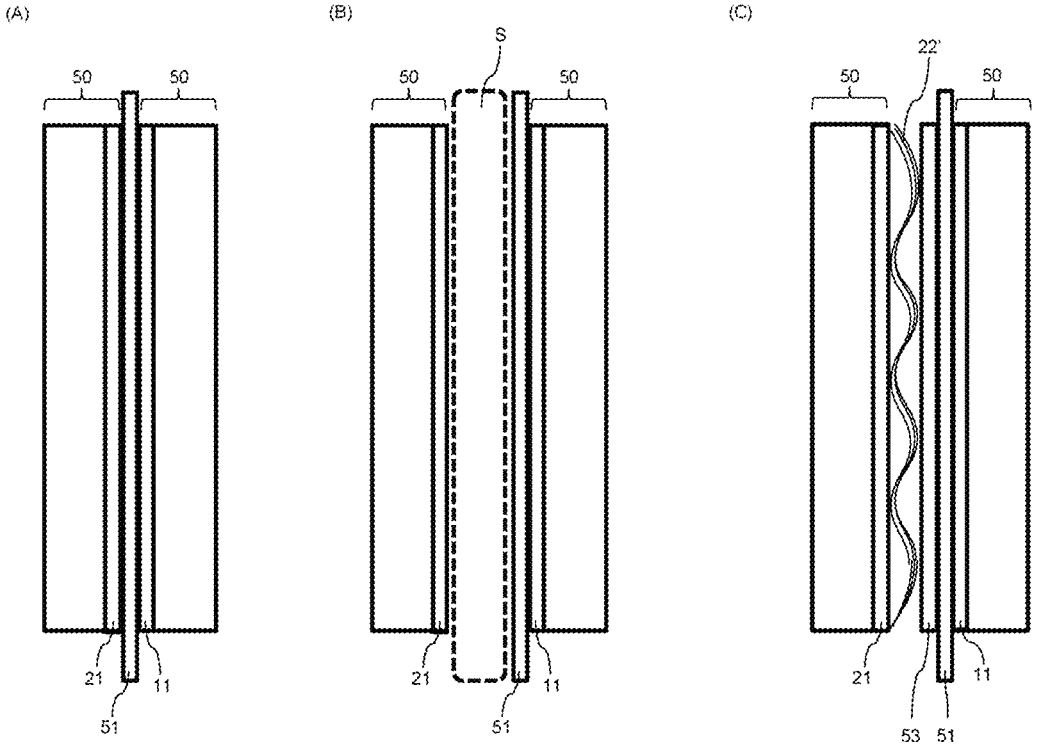

[Figure 12]
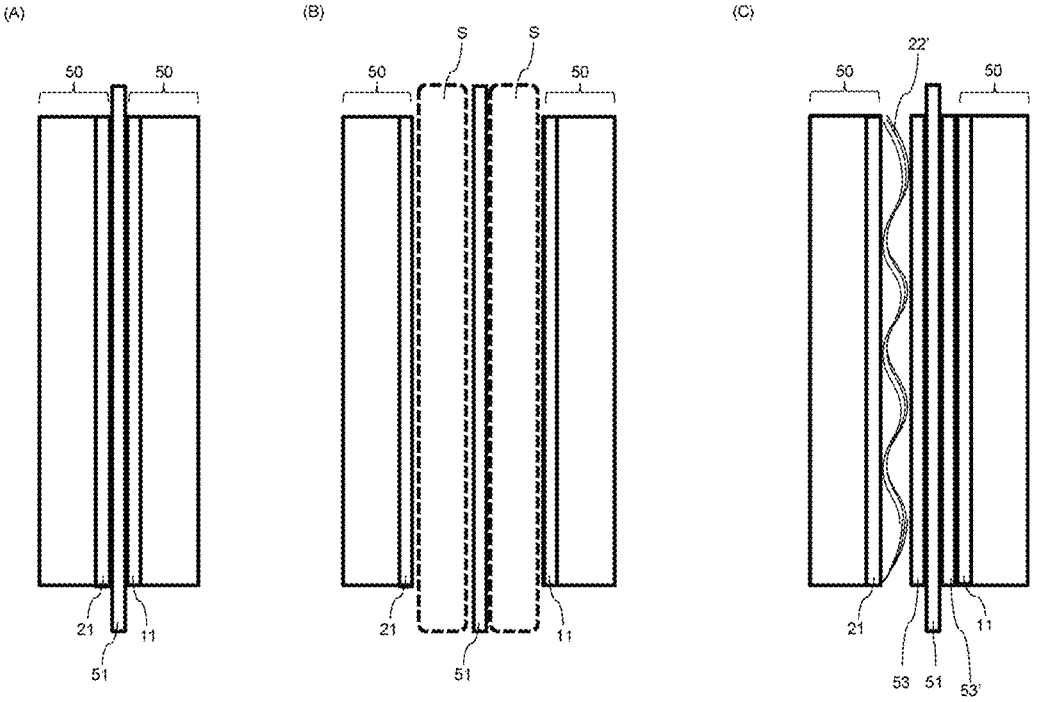

[Figure 13]
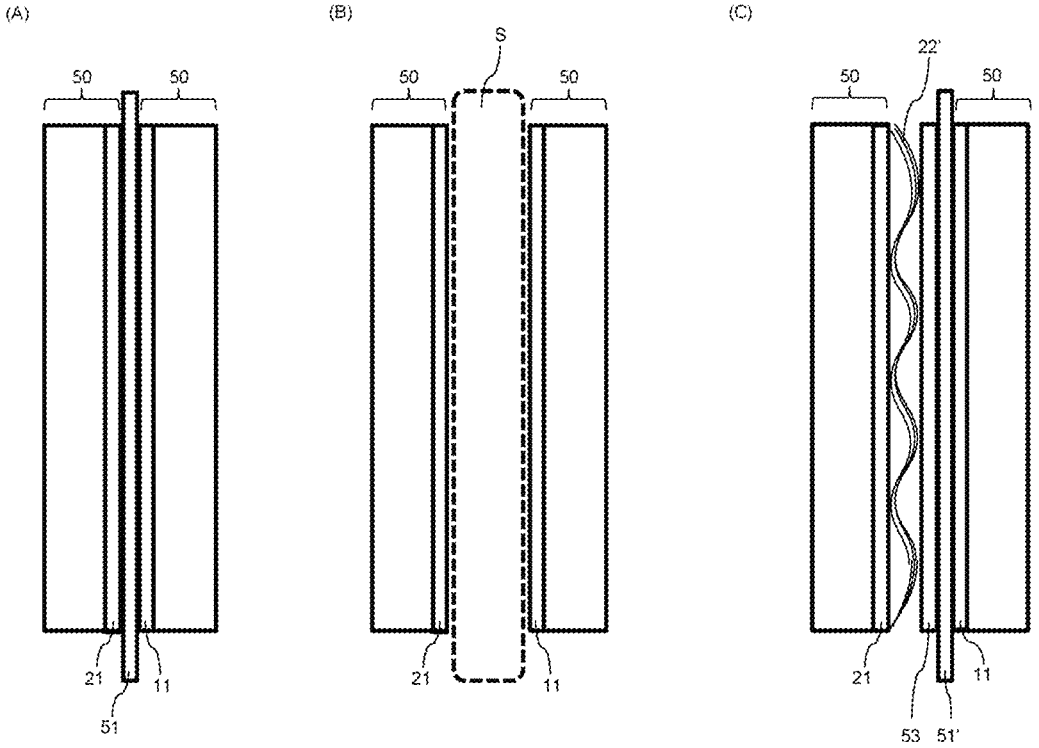

[Figure 14]
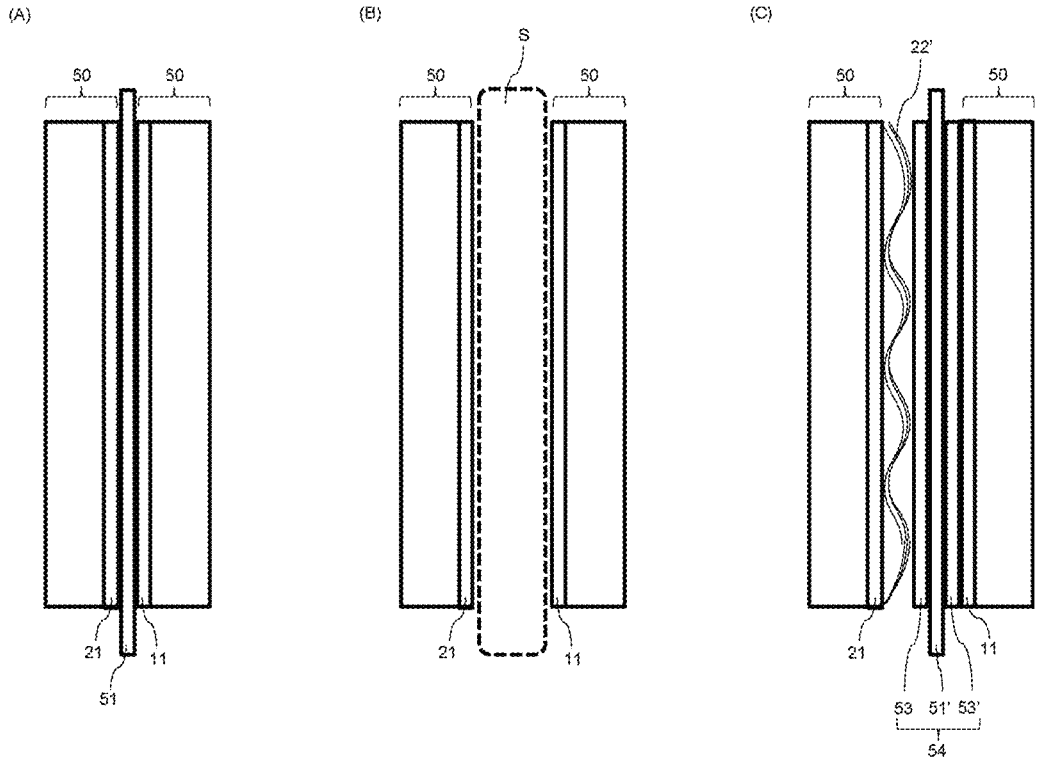

[Figure 15]
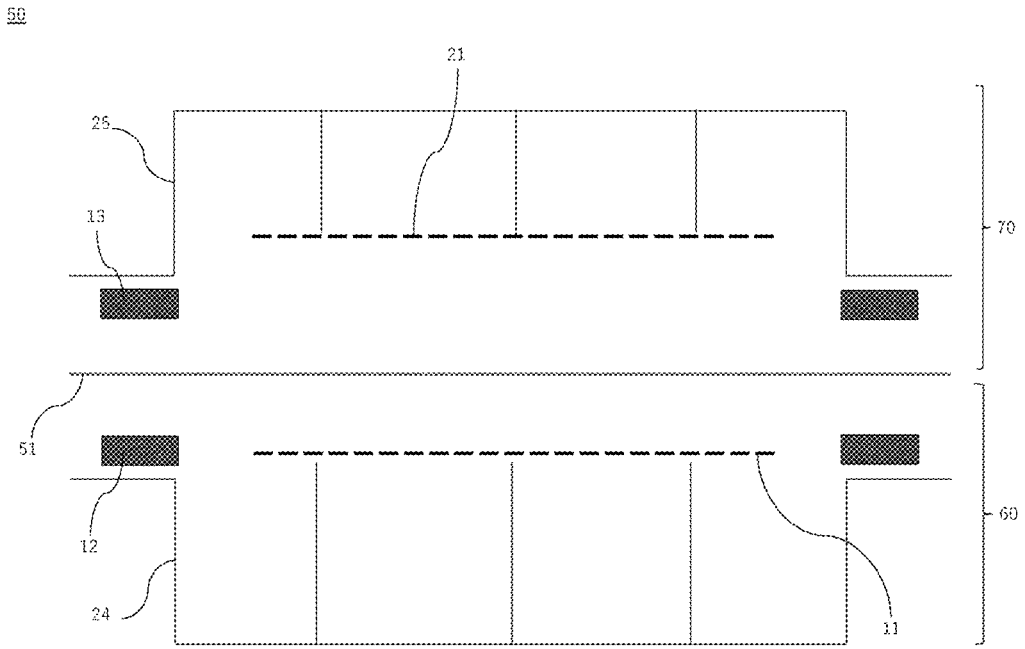
[Figure 16]
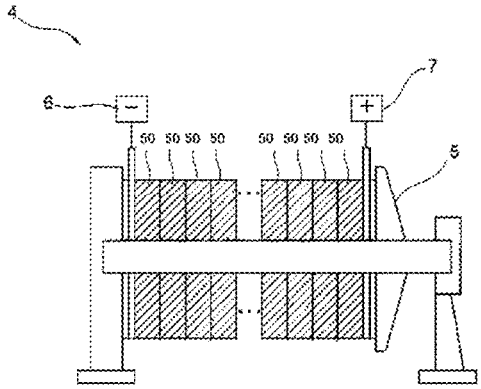

[Figure 17]
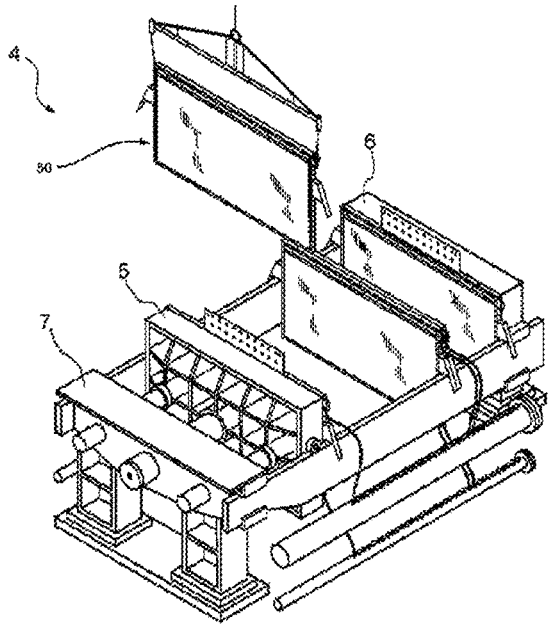

[Figure 19]
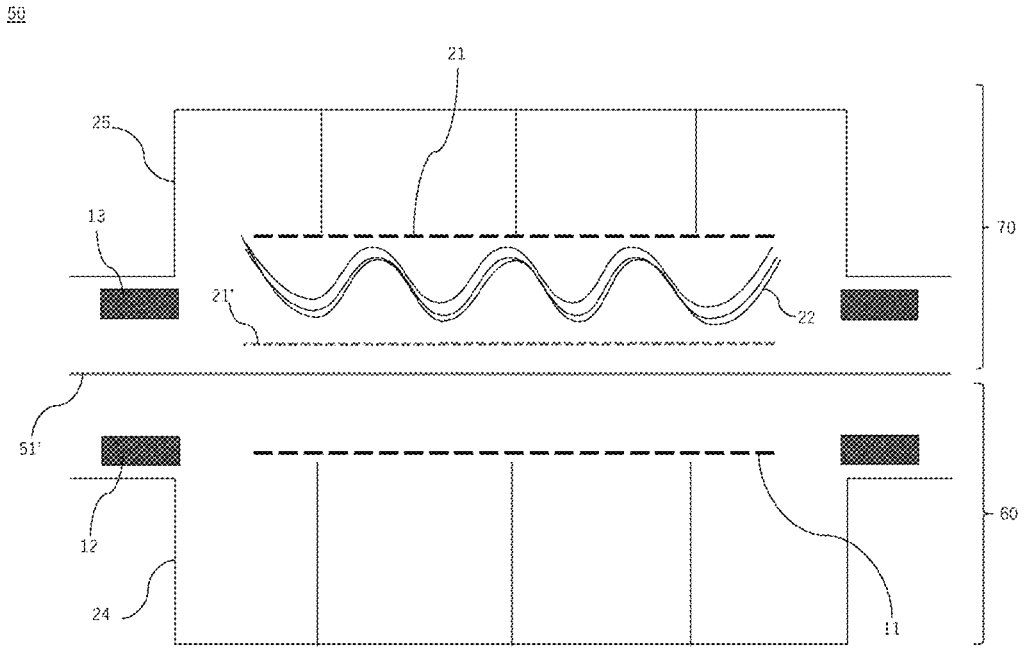
[Figure 20]
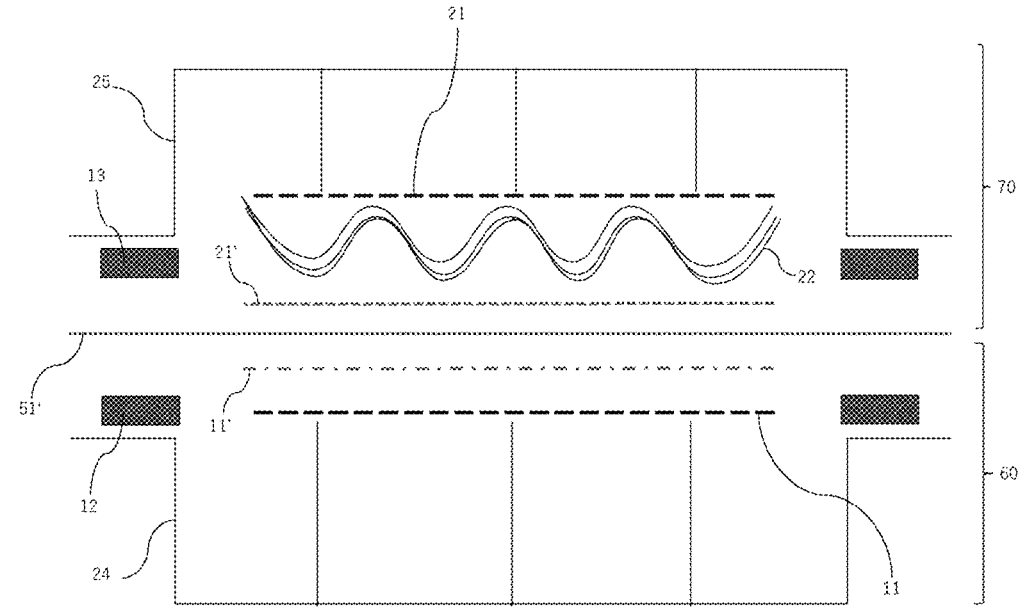

ELECTROLYZER, AND METHOD FOR PRODUCING ELECTROLYZER

TECHNICAL FIELD

The present invention relates to an electrolyzer, and a method for producing an electrolyzer.

BACKGROUND ART

For electrolysis of an alkali metal chloride aqueous solution such as salt solution and electrolysis of water (hereinbelow, collectively referred to as "electrolysis".), methods by use of an electrolyzer including a membrane, more specifically an ion exchange membrane or microporous membrane have been employed. This electrolyzer includes many electrolytic cells connected in series therein, in many cases. A membrane is interposed between each of electrolytic cell to perform electrolysis. In an electrolytic cell, a cathode chamber including a cathode and an anode chamber including an anode are disposed back to back with a partition wall (back plate) interposed therebetween or via pressing by means of press pressure, bolt tightening, or the like.

Conventionally, the anode and the cathode for use in these electrolyzers are each fixed to the anode chamber or the cathode chamber of an electrolytic cell by a method such as welding and folding, and thereafter, stored or transported to customers. Meanwhile, each membrane in a state of being singly wound around a vinyl chloride pipe is stored or transported to customers. Each customer arranges the electrolytic cell on the frame of an electrolyzer and interposes the membrane between electrolytic cells to assemble the electrolyzer. In this manner, electrolytic cells are produced, and an electrolyzer is assembled by each customer. Patent Literatures 1 and 2 each disclose a structure formed by integrating a membrane and an electrode as a structure applicable to such an electrolyzer.

In a conventional electrolyzer, only arranging an anode, a membrane, and a cathode in this order for every electrolytic cell being a constituent unit of the conventional electrolyzer results in a distance of about 1 mm at the maximum between the cathode and the anode due to the structure thereof. Particularly, because of the fact that the gap present between the membrane and the cathode serves as resistance, the electrolytic voltage tends to increase (hereinbelow, a conventional electrolyzer having such a gap is also referred to as a "narrow-gap electrolyzer"). In view of the problem, electrolyzers in which the anode and the cathode are brought into a close contact with the membrane to eliminate the gap (hereinbelow, also referred to as "zero-gap base electrolyzers") have been developed in order to lower the electrolytic voltage. In connection to this, methods for modifying a narrow-gap electrolyzer, in other words, there have been suggested methods for producing a zero-gap base electrolyzer by modifying an electrolytic cell that has been used in a narrow-gap electrolyzer (e.g., see Patent Literature 3).

CITATION LIST

Patent Literature

Patent Literature 1
Japanese Patent Laid-Open No. 58-048686
Patent Literature 2
Japanese Patent Laid-Open No. 55-148775
Patent Literature 3
Japanese Patent No. 5047265

SUMMARY OF INVENTION

Technical Problem (First Object)

When electrolysis operation is started and continued, each part deteriorates and electrolytic performance are lowered due to various factors, and each part is replaced at a certain time point. The membrane can be relatively easily renewed by extracting from an electrolytic cell and inserting a new membrane. In contrast, the anode and the cathode are fixed to the electrolytic cell, and thus, there is a problem of occurrence of an extremely complicated work on renewing the electrode, in which the electrolytic cell is removed from the electrolyzer and conveyed to a dedicated renewing plant, fixing such as welding is removed and the old electrode is striped off, then a new electrode is placed and fixed by a method such as welding, and the cell is conveyed to the electrolysis plant and placed back to the electrolyzer. It is considered herein that the structure formed by integrating a membrane and an electrode via thermal compression described in Patent Literatures 1 and 2 is used for the renewing described above, but the structure, which can be produced at a laboratory level relatively easily, is not easily produced so as to be adapted to an electrolytic cell in an actual commercially-available size (e.g., 1.5 m in length, 3 m in width). Even when the structure is used, occurrence of the complicated work mentioned above cannot be avoided.

Meanwhile, in view of the problem mentioned above, there is contemplated renewing a degraded electrode without removal by insertion of a new electrode for electrolysis between the existing electrode and the existing membrane. Here, a so-called zero-gap base electrolyzer, in which the membrane is in contact with the cathode, has a structure in which the zero gap is maintained by pressing the cathode by an elastic body in the direction toward the membrane and the anode. When the elastic body is degraded (loses elasticity sufficient to maintain the zero-gap), the elastic body has to be replaced by a new one before the renewing operation as described above is conducted. Due to the structure of the electrolyzer, the existing electrode is once removed on replacing the elastic body. It can be said that this operation is also complicated.

The present invention has been conceived in view of the problems of the conventional art described above, and a first object of the present invention is to provide a method for producing an electrolyzer that can improve the work efficiency on renewing a part in a zero-gap base electrolyzer, and an electrolyzer comprising a structure corresponding thereto.

(Second Object)

According to the method described in Patent Literature 3, on modifying a narrow-gap electrolyzer, sequentially providing a cushion mat layer and a new cathode in the gap enables a zero-gap base electrolyzer to be produced inexpensively and easily while the existing members used in the narrow-gap electrolyzer are maintained. Meanwhile, when the modification as described above is conducted based on a narrow-gap electrolyzer that has been already subjected to operation, the existing members in the narrow-gap electrolyzer are also assumed to be degraded. According to the method described in Patent Literature 3, even if the existing cathode is degraded, the characteristics as a cathode member are renewed because a new cathode is provided, but when operation has been repeated until the existing cathode is degraded, the existing membrane also may be degraded. In such a case, with only zero-gapping in accordance with the method described in Patent Literature 3, the resulting electrolytic characteristics may not be sufficient. An electrolyzer usually includes many electrolytic cell as constituent units thereof. Thus, even if one member among the constituent units is degraded, it can be said that the influence is likely to be manifested.

The present invention has been conceived in view of the problems described above, and a second object of the present invention is to provide a method for producing a zero-gap base electrolyzer by modifying an electrolytic cell that has been used in a narrow-gap electrolyzer, wherein the characteristics of the existing cathode and membrane can be renewed in addition to zero-gapping, and the work efficiency is also excellent, and an electrolyzer comprising a structure corresponding thereto.

Solution to Problem

As a result of the intensive studies to achieve the first object, the present inventors have found that the problems described above can be solved by arranging a new elastic body in an existing electrolyzer instead of removal of the existing elastic body in the existing electrolyzer, thereby having completed the present invention.

That is, the present invention includes the following aspects.

[1]

An electrolyzer comprising:

an anode, a cathode that is opposed to the anode, a membrane that is arranged between the anode and the cathode;

a first elastic body that presses the cathode in a direction toward the anode, a first electrode for electrolysis that is arranged between the membrane and the cathode; and a second elastic body that is arranged between the first electrode for electrolysis and the cathode and presses the first electrode for electrolysis in the direction toward the anode, wherein the first electrode for electrolysis serves as a cathode electrode, and the first electrode for electrolysis, the second elastic body, the cathode, and the first elastic body are electrically connected.

[2]

The electrolyzer according to [1], wherein a thickness of the second elastic body is larger than a thickness of the first elastic body.

[3]

The electrolyzer according to [1] or [2], wherein a normal surface pressure of the second elastic body is larger than a normal surface pressure of the first elastic body.

[4]

The electrolyzer according to any one of [1] to [3], further comprising a second electrode for electrolysis that is arranged between the anode and the membrane, wherein the second electrode for electrolysis serves as an anode electrode, and the second electrode for electrolysis and the anode are electrically connected.

[5]

A method for producing a new electrolyzer from an existing electrolyzer comprising an anode, a cathode that is opposed to the anode, a membrane that is arranged between the anode and the cathode, and a first elastic body that presses the cathode in a direction toward the anode, the method comprising:

a step (A) of arranging a first electrode for electrolysis between the membrane and the cathode and arranging a second elastic body between the first electrode for electrolysis and the cathode in the existing electrolyzer, wherein the second elastic body presses the first electrode for electrolysis in the direction toward the anode, the first electrode for electrolysis serves as a cathode electrode, and the first electrode for electrolysis, the second elastic body, the cathode, and the first elastic body are electrically connected.

[6]

The method for producing the electrolyzer according to [5], wherein a thickness of the second elastic body is larger than a thickness of the first elastic body.

[7]

The method for producing the electrolyzer according to [5] or [6], wherein a normal surface pressure of the second elastic body is larger than a normal surface pressure of the first elastic body.

[8]

The method for producing the electrolyzer according to any one of [5] to [7], further comprising:

a step (B) of arranging a second electrode for electrolysis between the anode and the membrane, wherein the second electrode for electrolysis serves as an anode electrode, and the second electrode for electrolysis and the anode are electrically connected.

[9]

The method for producing the electrolyzer according to any one of [5] to [7], wherein the step (A) comprises:

a sub-step (a1) of removing the membrane, and a sub-step (a2) of arranging a laminate between the second elastic body and the anode after the sub-step (a1), the laminate comprising a new membrane and the first electrode for electrolysis.

[10]

The method for producing the electrolyzer according to [9], wherein the laminate further comprises a second electrode for electrolysis, the second electrode for electrolysis serves as an anode electrode, and the second electrode for electrolysis and the anode are electrically connected.

Also, as a result of the intensive studies to achieve the second object, the present inventors have found that the problems described above can be solved by arranging a laminate including a new membrane and a new electrode for electrolysis in a method for producing a zero-gap base electrolyzer by modifying an electrolytic cell that has been used in a narrow-gap electrolyzer, thereby having completed the present invention.

That is, the present invention includes the following aspects.

[11]

A method for producing a new electrolyzer from an existing electrolyzer comprising an anode, a cathode that is opposed to the anode, a membrane that is arranged between the anode and the cathode, and a support that directly supports the cathode, the method comprising:

a step (A) of replacing the membrane by a laminate comprising a new membrane and a first electrode for electrolysis and arranging an elastic body between the first electrode for electrolysis and the cathode in the existing electrolyzer, wherein the elastic body presses the first electrode for electrolysis in a direction toward the anode, a thickness of the first electrode for electrolysis is 120 μm or less, and the first electrode for electrolysis, the elastic body, the cathode, and the support are electrically connected.

[12]

The method for producing the electrolyzer according to [11], wherein the laminate further comprises a second electrode for electrolysis, the second electrode for electrolysis serves as an anode electrode, and the second electrode for electrolysis and the anode are electrically connected.

[13]

An electrolyzer comprising:

an anode, a cathode that is opposed to the anode, a membrane that is arranged between the anode and the cathode, a first electrode for electrolysis that is arranged between the membrane and the cathode, a second electrode for electrolysis that is arranged between the anode and the membrane, an elastic body that is arranged between the first electrode for electrolysis and the cathode and presses the first electrode for electrolysis in a direction toward the anode, and a support that directly supports the cathode, wherein the first electrode for electrolysis serves as a cathode electrode, the second electrode for electrolysis serves as an anode electrode, a thickness of the first electrode for electrolysis is 120 μm or less, the first electrode for electrolysis, the elastic body, the cathode, and the support are electrically connected, and the second electrode for electrolysis and the anode are electrically connected.

[14]

A method for producing a new electrolytic cell from an existing electrolytic cell comprising an anode, a cathode that is opposed to the anode, a membrane that is arranged between the anode and the cathode, and a support that directly supports the cathode, the method comprising:

a step (A) of replacing the membrane by a laminate comprising a new membrane and a first electrode for electrolysis and arranging an elastic body between the first electrode for electrolysis and the cathode in the existing electrolytic cell, wherein the elastic body presses the first electrode for electrolysis in a direction toward the anode, a thickness of the first electrode for electrolysis is 120 μm or less, and the first electrode for electrolysis, the elastic body, the cathode, and the support are electrically connected.

[15]

The method for producing an electrolytic cell according to [14], wherein the laminate further comprises a second electrode for electrolysis, the second electrode for electrolysis serves as an anode electrode, and the second electrode for electrolysis and the anode are electrically connected.

[16]

An electrolytic cell comprising:

an anode, a cathode that is opposed to the anode, a membrane that is arranged between the anode and the cathode, a first electrode for electrolysis that is arranged between the membrane and the cathode, a second electrode for electrolysis that is arranged between the anode and the membrane, an elastic body that is arranged between the first electrode for electrolysis and the cathode and presses the first electrode for electrolysis in a direction toward the anode, and a support that directly supports the cathode, wherein the first electrode for electrolysis serves as a cathode electrode, the second electrode for electrolysis serves as an anode electrode, a thickness of the first electrode for electrolysis is 120 μm or less, the first electrode for electrolysis, the elastic body, the cathode, and the support are electrically connected, and the second electrode for electrolysis and the anode are electrically connected.

[17]

An electrolyzer comprising the electrolytic cell according to [16].

Advantageous Effects of Invention

According to one aspect of the present invention, it is possible to provide a method for producing an electrolyzer that can improve the work efficiency during electrode renewing in an electrolyzer, and an electrolyzer comprising a structure corresponding thereto.

According to another aspect of the present invention, it is possible to provide a method for producing a zero-gap base electrolyzer by modifying an electrolytic cell that has been used in a narrow-gap electrolyzer, wherein the characteristics of the existing cathode and membrane can be renewed in addition to zero-gapping, and the work efficiency is also excellent, and an electrolyzer having a structure corresponding thereto.

BRIEF DESCRIPTION OF DRAWINGS

FIG. 1 illustrates a cross-sectional schematic view of an electrolytic cell according to a first embodiment.

FIG. 2 illustrates a cross-sectional schematic view showing a state of two electrolytic cells connected in series in an existing electrolyzer according to the first embodiment.

FIG. 3 illustrates a cross-sectional schematic view illustrating a state of two electrolytic cells connected in series in an electrolyzer according to the first embodiment.

FIG. 4 illustrates a schematic view of an electrolyzer according to the first embodiment.

FIG. 5 illustrates a schematic perspective view showing a step of assembling the electrolyzer according to the first embodiment.

FIG. 6 illustrates a cross-sectional schematic view of a reverse current absorber that may be included in an electrolytic cell of the present embodiment.

FIG. 7 illustrates a cross-sectional schematic view of an electrode for electrolysis of the present embodiment.

FIG. 8 illustrates a schematic cross-sectional view illustrating an ion exchange membrane of the present embodiment.

FIG. 9 illustrates a schematic view for explaining the aperture ratio of reinforcement core materials constituting the ion exchange membrane of the present embodiment.

FIG. 10 shows a schematic view for explaining a method for forming the continuous holes of the ion exchange membrane.

FIG. 11 illustrates an explanation view illustrating one aspect of a method for producing an electrolyzer according to the first embodiment.

FIG. 12 illustrates an explanation view illustrating another aspect of the method for producing an electrolyzer according to the first embodiment.

FIG. 13 illustrates an explanation view illustrating further another aspect of the method for producing an electrolyzer according to the first embodiment.

FIG. 14 illustrates an explanation view illustrating still further another aspect of the method for producing an electrolyzer according to the first embodiment.

FIG. 15 illustrates a cross-sectional schematic view of an electrolytic cell according to a second embodiment.

FIG. 16 illustrates a schematic view of an electrolyzer according to the second embodiment.

FIG. 17 illustrates a schematic perspective view showing a step of assembling the electrolyzer according to the second embodiment.

FIG. 18(A) shows an overview of an elastic body. FIG. 18(B) shows an overview of a laminate of a first electrode for electrolysis and a membrane. FIG. 18(C) shows an overview of a laminate of the first electrode for electrolysis, the membrane, and a second electrode for electrolysis.

FIG. 19 illustrates a cross-sectional schematic view illustrating an electrolytic cell obtained when one aspect of a method for producing an electrolyzer according to the second embodiment is conducted.

FIG. 20 illustrates a cross-sectional schematic view illustrating an electrolytic cell obtained when another aspect of the method for producing an electrolyzer according to the second embodiment is conducted.

DESCRIPTION OF EMBODIMENTS

Figure 18A:
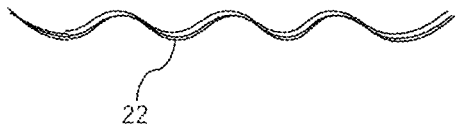
FIG. 18(A)-18(C) show an overview of a member used for a method for producing an electrolyzer according to the second embodiment.

Hereinbelow, the embodiments of the present invention (hereinbelow, may be referred to as the present embodiments) will be each described in detail, with reference to drawings as required. The embodiments below are illustration for explaining the present invention, and the present invention is not limited to the contents below. The accompanying drawings illustrate one example of the embodiments, and aspects should not be construed to be limited thereto. The present invention may be appropriately modified and carried out within the spirit thereof. In the drawings, positional relations such as top, bottom, left, and right are based on the positional relations shown in the drawing unless otherwise noted. The dimensions and ratios in the drawings are not limited to those shown.

First Embodiment

Here, a first aspect according to the present embodiment (hereinbelow, also referred to as the "first embodiment") will be described in detail with reference to FIGS. 1 to 14.

[Electrolyzer]

An electrolyzer of the first embodiment (hereinbelow, unless otherwise specified, "the present embodiment" in the section of <First embodiment> means the first embodiment.) comprises an anode, a cathode that is opposed to the anode, a membrane that is arranged between the anode and the cathode, a first elastic body that presses the cathode in a direction toward the anode, a first electrode for electrolysis that is arranged between the membrane and the cathode, and a second elastic body that is arranged between the first electrode for electrolysis and the cathode and presses the first electrode for electrolysis in the direction toward the anode, wherein the first electrode for electrolysis serves as a cathode electrode, and the first electrode for electrolysis, the second elastic body, the cathode, and the first elastic body are electrically connected.

According to the electrolyzer having the configuration described above, the second elastic body presses the first electrode for electrolysis in the direction toward the anode. Thus, even when the first elastic body is degraded to lose elasticity sufficient to maintain the zero-gap, the zero-gap can be maintained by the elasticity of the second elastic body, and the necessity of removal and replacement of the first elastic body per se is eliminated. Further, even when the second elastic body is degraded to lose elasticity sufficient to maintain the zero-gap, the second elastic body is sandwiched between adjacent members, and thus, only releasing the sandwiching easily enables the second elastic body per se to be replaced by a new one.

Additionally, even when the cathode is degraded, the first electrode for electrolysis serves as a cathode electrode, and the necessity of removal and replacement of the cathode per se is eliminated. Further, even when the first electrode for electrolysis is degraded and the electrolytic characteristics are lowered, the first electrode for electrolysis is sandwiched between adjacent members, and thus, only releasing the sandwiching easily enables the first electrode for electrolysis to be replaced by a new one.

Thus, according to the electrolyzer of the present embodiment, it is possible to avoid a complicated work during electrode renewing in an electrolyzer.

In the present embodiment, a combination of an anode chamber including an anode and a cathode chamber including a cathode is referred to as an electrolytic cell, and each member thereof will be described in detail below.

[Electrolytic Cell]

First, the electrolytic cell, which can be used as a constituent unit of the electrolyzer of the present embodiment, will be described. FIG. 1 illustrates a cross-sectional view of an electrolytic cell 50.

The electrolytic cell 50 comprises an anode chamber 60, a cathode chamber 70, a partition wall 80 placed between the anode chamber 60 and the cathode chamber 70, an anode 11 placed in the anode chamber 60, and a cathode 21 placed in the cathode chamber 70. As required, the electrolytic cell 50 may comprise a reverse current absorber 18 placed in the cathode chamber. The anode 11 and the cathode 21 belonging to the electrolytic cell 50 are electrically connected to each other. The electrolytic cell 50 can be said to comprise the following cathode structure. The cathode structure 90 comprises the cathode chamber 70, the cathode 21 placed in the cathode chamber 70, and the reverse current absorber 18 placed in the cathode chamber 70, the reverse current absorber 18 has the substrate 18*a* and the reverse current absorbing layer 18*b* formed on the substrate 18*a*, as shown in FIG. 6, and the cathode 21 and the reverse current absorbing layer 18*b* are electrically connected. The cathode chamber 70 further has a collector 23, a support 24 supporting the collector, and a first elastic body 22, which is a metal elastic body. The first elastic body 22 is placed between the collector 23 and the cathode 21. The support 24 is placed between the collector 23 and the partition wall 80. The collector 23 is electrically connected to the cathode 21 via the first elastic body 22. The partition wall 80 is electrically connected to the collector 23 via the support 24. Accordingly, the partition wall 80, the support 24, the collector 23, the first elastic body 22, and the cathode 21 are electrically connected. The cathode 21 and the reverse current absorbing layer 18*b* are electrically connected. The cathode 21 and the reverse current absorbing layer may be directly connected or may be indirectly connected via the collector, the support, the metal elastic body, the partition wall, or the like. The entire surface of the cathode 21 is preferably covered with a catalyst layer for reduction reaction. The form of electrical connection may be a form in which the partition wall 80 and the support 24, the support 24 and the collector 23, and the collector 23 and the first elastic body 22 are each directly attached and the cathode 21 is laminated on the first elastic body 22. Examples of a method for directly attaching these constituent members to one another include welding and the like. Alternatively, the reverse current absorber 18, the cathode 21, and the collector 23 may be collectively referred to as a cathode structure 90.

FIG. 2 is a cross-sectional view of two electrolytic cells 50 that are adjacent in the electrolyzer before the electrolyzer of the present embodiment is assembled. FIG. 3 is a cross-sectional view of two electrolytic cells 50 that are adjacent in the electrolyzer 4 of the present embodiment. FIG. 4 shows an electrolyzer 4 of the present embodiment. FIG. 5 shows a step of assembling the electrolyzer 4.

As shown in FIG. 2, an electrolytic cell 50, a cation exchange membrane 51, and an electrolytic cell 50 are arranged in series in the order mentioned. A cation exchange membrane 51 is arranged between the anode chamber of one electrolytic cell 50 of the two electrolytic cells that are adjacent in FIG. 2 and the cathode chamber of the other electrolytic cell 50. That is, the anode chamber 60 of the electrolytic cell 50 and the cathode chamber 70 of the electrolytic cell 50 adjacent thereto is separated by the cation exchange membrane 51. As shown in FIG. 4, the electrolyzer 4 is composed of a plurality of electrolytic cells 50 connected in series via the cation exchange membrane 51. That is, the electrolyzer 4 is a bipolar electrolyzer comprising the plurality of electrolytic cells 50 arranged in series and the cation exchange membranes 51 each arranged between adjacent electrolytic cells 50. As shown in FIG. 5, the electrolyzer 4 is assembled by arranging the plurality of electrolytic cells 50 connected in series via the cation exchange membrane 51 and coupling the cells by means of a press device 5.

The structure possessed by the electrolyzer of the present embodiment will be described by use of FIG. 3(A). As shown in FIG. 3(A), in the electrolyzer 4, a first electrode for electrolysis 53 is arranged between the cation exchange membrane 51 and the electrolytic cell 50 on the left side thereof. In other words, the first electrode for electrolysis 53 is arranged between the cathode 21 and the cation exchange membrane 51 to serve as a cathode electrode. Further, as shown in FIG. 3(A), a second elastic body 22' is arranged between the first electrode for electrolysis 53 and the cathode 21.

As described above, in the electrolyzer of the present embodiment, the second elastic body 22' presses the first electrode for electrolysis 53 in the direction toward the anode 11. Thus, even when the first elastic body 22 is degraded to lose elasticity sufficient to maintain the zero-gap, the zero-gap can be maintained by the elasticity of the second elastic body 22', and the necessity of removal and replacement of the first elastic body 22 per se is eliminated. Further, even when the second elastic body 22' is degraded to lose elasticity sufficient to maintain the zero-gap, the second elastic body 22' is sandwiched between adjacent members, and thus, only releasing the sandwiching easily enables the second elastic body per se to be replaced by a new one.

Additionally, even when the cathode 21 is degraded, the first electrode for electrolysis 53 serves as a cathode electrode, and the necessity of removal and replacement of the cathode 21 per se is eliminated. Further, even when the first electrode for electrolysis 53 is degraded and the electrolytic characteristics are lowered, the first electrode for electrolysis 53 is sandwiched between adjacent members, and thus, only releasing the sandwiching easily enables the first electrode for electrolysis to be replaced by a new one.

A preferable structure possessed by the electrolyzer of the present embodiment will be described by use of FIG. 3(B). As shown in FIG. 3(B), in the electrolyzer 4, a laminate 54 of a first electrode for electrolysis 53, a cation exchange membrane 51, and a second electrode for electrolysis 53' are arranged between the cation exchange membrane 51 and the electrolytic cell 50 on the left side thereof. In other words, while the first electrode for electrolysis 53 is arranged between the cathode 21 and the cation exchange membrane 51 to serve as a cathode electrode, the second electrode for electrolysis 53' is arranged between the anode 11 and the cation exchange membrane 51 to serve as an anode electrode. Further, as shown in FIG. 3(B), a second elastic body 22' is arranged between the first electrode for electrolysis 53 and the cathode 21.

Also in this electrolyzer, the second elastic body 22' presses the first electrode for electrolysis 53 in the direction toward the anode 11. Thus, even when the first elastic body 22 is degraded to lose elasticity sufficient to maintain the zero-gap, the zero-gap can be maintained by the elasticity of the second elastic body 22', and the necessity of removal and replacement of the first elastic body 22 per se is eliminated. Further, even when the second elastic body 22' is degraded to lose elasticity sufficient to maintain the zero-gap, the second elastic body 22' is sandwiched between adjacent members, and thus, only releasing the sandwiching easily enables the second elastic body per se to be replaced by a new one.

Additionally, even when the cathode 21 is degraded, the first electrode for electrolysis 53 serves as a cathode electrode, and the necessity of removal and replacement of the cathode 21 per se is eliminated. Further, even when the first electrode for electrolysis 53 is degraded and the electrolytic characteristics are lowered, the first electrode for electrolysis 53 is sandwiched between adjacent members, and thus, only releasing the sandwiching easily enables the first electrode for electrolysis to be replaced by a new one.

Also, even when the anode 11 is degraded, the second electrode for electrolysis 53' serves as an anode electrode, and the necessity of removal and replacement of the anode 11 per se is eliminated. Further, even when the second electrode for electrolysis 53' is degraded and the electrolytic characteristics are lowered, the second electrode for electrolysis 53' is sandwiched between adjacent members, and thus, only releasing the sandwiching easily enables the second electrode for electrolysis to be replaced by a new one.

The electrolyzer 4 has an anode terminal 7 and a cathode terminal 6 to be connected to a power supply. The anode 11 of the electrolytic cell 50 located at farthest end among the plurality of electrolytic cells 50 coupled in series in the electrolyzer 4 is electrically connected to the anode terminal 7. The cathode 21 of the electrolytic cell located at the end opposite to the anode terminal 7 among the plurality of electrolytic cells 50 coupled in series in the electrolyzer 4 is electrically connected to the cathode terminal 6. The electric current during electrolysis flows from the side of the anode terminal 7, through the anode and cathode of each electrolytic cell 50, toward the cathode terminal 6. At the both ends of the coupled electrolytic cells 50, an electrolytic cell having an anode chamber only (anode terminal cell) and an electrolytic cell having a cathode chamber only (cathode terminal cell) may be arranged. In this case, the anode terminal 7 is connected to the anode terminal cell arranged at the one end, and the cathode terminal 6 is connected to the cathode terminal cell arranged at the other end.

In the case of electrolyzing brine, brine is supplied to each anode chamber 60, and pure water or a low-concentration sodium hydroxide aqueous solution is supplied to each cathode chamber 70. Each liquid is supplied from an electrolyte solution supply pipe (not shown in Figure), through an electrolyte solution supply hose (not shown in Figure), to each electrolytic cell 50. The electrolyte solution and products from electrolysis are recovered from an electrolyte solution recovery pipe (not shown in Figure). During electrolysis, sodium ions in the brine migrate from the anode chamber 60 of the one electrolytic cell 50, through the cation exchange membrane 51, to the cathode chamber 70 of the adjacent electrolytic cell 50. Thus, the electric current during electrolysis flows in the direction in which the electrolytic cells 50 are coupled in series. That is, the electric current flows, through the cation exchange membrane 51, from the anode chamber 60 toward the cathode chamber 70. As the brine is electrolyzed, chlorine gas is generated on the side of the anode 11, and sodium hydroxide (solute) and hydrogen gas are generated on the side of the cathode 21.

(Anode Chamber)

The anode chamber 60 has the anode 11 or anode feed conductor 11. The feed conductor herein referred to mean a degraded electrode (i.e., the existing electrode), an electrode having no catalyst coating, and the like. When the electrode for electrolysis in the present embodiment is inserted to the anode side, 11 serves as an anode feed conductor. When the electrode for electrolysis in the present embodiment is not inserted to the anode side, 11 serves as an anode. The anode chamber 60 has an anode-side electrolyte solution supply unit that supplies an electrolyte solution to the anode chamber 60, a baffle plate that is arranged above the anode-side electrolyte solution supply unit so as to be substantially parallel or oblique to the partition wall 80, and an anode-side gas liquid separation unit arranged above the baffle plate to separate gas from the electrolyte solution including the gas mixed.

(Anode)

When the electrode for electrolysis in the present embodiment is not inserted to the anode side, an anode 11 is provided in the frame of the anode chamber 60 (i.e., the anode frame). As the anode 11, a metal electrode such as so-called DSA(R) can be used. DSA is an electrode including a titanium substrate of which surface is covered with an oxide comprising ruthenium, iridium, and titanium as components.

As the form, any of a perforated metal, nonwoven fabric, foamed metal, expanded metal, metal porous foil formed by electroforming, so-called woven mesh produced by knitting metal lines, and the like can be used.

(Anode Feed Conductor)

When the electrode for electrolysis in the present embodiment is inserted to the anode side, the anode feed conductor 11 is provided in the frame of the anode chamber 60. As the anode feed conductor 11, a metal electrode such as so-called DSA(R) can be used, and titanium having no catalyst coating can be also used. Alternatively, DSA having a thinner catalyst coating can be also used. Further, a used anode can be also used.

As the form, any of a perforated metal, nonwoven fabric, foamed metal, expanded metal, metal porous foil formed by electroforming, so-called woven mesh produced by knitting metal lines, and the like can be used.

(Anode-Side Electrolyte Solution Supply Unit)

The anode-side electrolyte solution supply unit, which supplies the electrolyte solution to the anode chamber 60, is connected to the electrolyte solution supply pipe. The anode-side electrolyte solution supply unit is preferably arranged below the anode chamber 60. As the anode-side electrolyte solution supply unit, for example, a pipe on the surface of which aperture portions are formed (dispersion pipe) and the like can be used. Such a pipe is more preferably arranged along the surface of the anode 11 and parallel to the bottom 19 of the electrolytic cell. This pipe is connected to an electrolyte solution supply pipe (liquid supply nozzle) that supplies the electrolyte solution into the electrolytic cell 50. The electrolyte solution supplied from the liquid supply nozzle is conveyed with a pipe into the electrolytic cell 50 and supplied from the aperture portions provided on the surface of the pipe to inside the anode chamber 60. Arranging the pipe along the surface of the anode 11 and parallel to the bottom 19 of the electrolytic cell is preferable because the electrolyte solution can be uniformly supplied to inside the anode chamber 60.

(Anode-Side Gas Liquid Separation Unit)

The anode-side gas liquid separation unit is preferably arranged above the baffle plate. The anode-side gas liquid separation unit has a function of separating produced gas such as chlorine gas from the electrolyte solution during electrolysis. Unless otherwise specified, above means the upper direction in the electrolytic cell 50 in FIG. 1, and below means the lower direction in the electrolytic cell 50 in FIG. 1.

During electrolysis, produced gas generated in the electrolytic cell 50 and the electrolyte solution form a mixed phase (gas-liquid mixed phase), which is then emitted out of the system. Subsequently, pressure fluctuations inside the electrolytic cell 50 cause vibration, which may result in physical damage of the ion exchange membrane. In order to prevent this event, the electrolytic cell 50 in the present embodiment is preferably provided with an anode-side gas liquid separation unit to separate the gas from the liquid. The anode-side gas liquid separation unit is preferably provided with a defoaming plate to eliminate bubbles. When the gas-liquid mixed phase flow passes through the defoaming plate, bubbles burst to thereby enable the electrolyte solution and the gas to be separated. As a result, vibration during electrolysis can be prevented.

(Baffle Plate)

The baffle plate is preferably arranged above the anode-side electrolyte solution supply unit and arranged substantially in parallel with or obliquely to the partition wall 80. The baffle plate is a partition plate that controls the flow of the electrolyte solution in the anode chamber 60. When the baffle plate is provided, it is possible to cause the electrolyte solution (brine or the like) to circulate internally in the anode chamber 60 to thereby make the concentration uniform. In order to cause internal circulation, the baffle plate is preferably arranged so as to separate the space in proximity to the anode 11 from the space in proximity to the partition wall 80. From such a viewpoint, the baffle plate is preferably placed so as to be opposed to the surface of the anode 11 and to the surface of the partition wall 80. In the space in proximity to the anode partitioned by the baffle plate, as electrolysis proceeds, the electrolyte solution concentration (brine concentration) is lowered, and produced gas such as chlorine gas is generated. This results in a difference in the gas-liquid specific gravity between the space in proximity to anode 11 and the space in proximity to the partition wall 80 partitioned by the baffle plate. By use of the difference, it is possible to promote the internal circulation of the electrolyte solution in the anode chamber 60 to thereby make the concentration distribution of the electrolyte solution in the anode chamber 60 more uniform.

Although not shown in FIG. 1, a collector may be additionally provided inside the anode chamber 60. The material and configuration of such a collector may be the same as those of the collector of the cathode chamber mentioned below. In the anode chamber 60, the anode 11 per se may also serve as the collector.

(Partition Wall)

The partition wall 80 is arranged between the anode chamber 60 and the cathode chamber 70. The partition wall 80 may be referred to as a separator, and the anode chamber 60 and the cathode chamber 70 are partitioned by the partition wall 80. As the partition wall 80, one known as a separator for electrolysis can be used, and an example thereof includes a partition wall formed by welding a plate comprising nickel to the cathode side and a plate comprising titanium to the anode side.

(Cathode Chamber)

In the cathode chamber 70, when the electrode for electrolysis in the present embodiment is inserted to the cathode side, 21 serves as a cathode feed conductor. When the electrode for electrolysis in the present embodiment is not inserted to the cathode side, 21 serves as a cathode. When a reverse current absorber is included, the cathode or cathode feed conductor 21 is electrically connected to the reverse current absorber. The cathode chamber 70, similarly to the anode chamber 60, preferably has a cathode-side electrolyte solution supply unit and a cathode-side gas liquid separation unit. Among the components constituting the cathode chamber 70, components similar to those constituting the anode chamber 60 will be not described.

(Cathode)

When the electrode for electrolysis in the present embodiment is not inserted to the cathode side, a cathode 21 is provided in the frame of the cathode chamber 70 (i.e., the cathode frame). The cathode 21 preferably has a nickel substrate and a catalyst layer that covers the nickel substrate. Examples of the components of the catalyst layer on the nickel substrate include metals such as Ru, C, Si, P, S, Al, Ti, V, Cr, Mn, Fe, Co, Ni, Cu, Zn, Y, Zr, Nb, Mo, Rh, Pd, Ag, Cd, In, Sn, Ta, W, Re, Os, Ir, Pt, Au, Hg, Pb, Bi, La, Ce, Pr, Nd, Pm, Sm, Eu, Gd, Tb, Dy, Ho, Er, Tm, Yb, and Lu, and oxides and hydroxides of the metals. Examples of the method for forming the catalyst layer include plating, alloy plating, dispersion/composite plating, CVD, PVD, pyrolysis, and spraying. These methods may be used in combination. The catalyst layer may have a plurality of layers and a plurality of elements, as required. The cathode 21 may be subjected to a reduction treatment, as required. As the substrate of the cathode 21, nickel, nickel alloys, and nickel-plated iron or stainless may be used.

As the form, any of a perforated metal, nonwoven fabric, foamed metal, expanded metal, metal porous foil formed by electroforming, so-called woven mesh produced by knitting metal lines, and the like can be used.

(Cathode Feed Conductor)

When the electrode for electrolysis in the present embodiment is inserted to the cathode side, a cathode feed conductor 21 is provided in the frame of the cathode chamber 70. The cathode feed conductor 21 may be covered with a catalytic component. The catalytic component may be a component that is originally used as the cathode and remains. Examples of the components of the catalyst layer include metals such as Ru, C, Si, P, S, Al, Ti, V, Cr, Mn, Fe, Co, Ni, Cu, Zn, Y, Zr, Nb, Mo, Rh, Pd, Ag, Cd, In, Sn, Ta, W, Re, Os, Ir, Pt, Au, Hg, Pb, Bi, La, Ce, Pr, Nd, Pm, Sm, Eu, Gd, Tb, Dy, Ho, Er, Tm, Yb, and Lu, and oxides and hydroxides of the metals. Examples of the method for forming the catalyst layer include plating, alloy plating, dispersion/composite plating, CVD, PVD, pyrolysis, and spraying. These methods may be used in combination. The catalyst layer may have a plurality of layers and a plurality of elements, as required. Nickel, nickel alloys, and nickel-plated iron or stainless, having no catalyst coating may be used. As the substrate of the cathode feed conductor 21, nickel, nickel alloys, and nickel-plated iron or stainless may be used.

As the form, any of a perforated metal, nonwoven fabric, foamed metal, expanded metal, metal porous foil formed by electroforming, so-called woven mesh produced by knitting metal lines, and the like can be used.

(Reverse Current Absorbing Layer)

A material having a redox potential less noble than the redox potential of the element for the catalyst layer of the cathode mentioned above may be selected as a material for the reverse current absorbing layer. Examples thereof include nickel and iron.

(Collector)

The cathode chamber 70 preferably comprises the collector 23. This improves current collection efficiency. In the present embodiment, the collector 23 is a porous plate and is preferably arranged in substantially parallel to the surface of the cathode 21.

The collector 23 preferably comprises an electrically conductive metal such as nickel, iron, copper, silver, and titanium. The collector 23 may be a mixture, alloy, or composite oxide of these metals. The collector 23 may have any form as long as the form enables the function of the collector and may have a plate or net form.

(Elastic Body)

Placing the first elastic body 22 between the collector 23 and the cathode 21 presses each cathode 21 of the plurality of electrolytic cells 50 connected in series onto the cation exchange membrane 51 to reduce the distance between each anode 11 and each cathode 21. Then, it is possible to lower the voltage to be applied entirely across the plurality of electrolytic cells 50 connected in series. Lowering of the voltage enables the power consumption to be reduced. With the first elastic body 22 placed, the pressing pressure caused by the first elastic body 22 enables the electrode for electrolysis to be stably maintained in place when the laminate including the electrode for electrolysis in the present embodiment is placed in the electrolytic cell. However, in the present embodiment, the first elastic body 22 is assumed to be degraded over time in association with long-term operation of the electrolyzer. In other words, the first elastic body 22 may be one that is degraded to lose elasticity sufficient to maintain the zero-gap. Even if the first elastic body 22 is degraded as described above, the elasticity of the second elastic body enables the zero-gap to be maintained in the present embodiment.

As the first elastic body 22 and second elastic body 22', spring members such as spiral springs and coils and cushioning mats may be used. As the first elastic body 22 and second elastic body 22', suitable ones may be appropriately employed, in consideration of a stress to press the ion exchange membrane and the like. The first elastic body 22 may be provided on the surface of the collector 23 on the side of the cathode chamber 70 or may be provided on the surface of the partition wall on the side of the anode chamber 60. Both the chambers are usually partitioned such that the cathode chamber 70 becomes smaller than the anode chamber 60. Thus, from the viewpoint of the strength of the frame and the like, the first elastic body 22 is preferably provided between the collector 23 and the cathode 21 in the cathode chamber 70. The first elastic body 22 and second elastic body 22' preferably comprise an electrically conductive metal such as nickel, iron, copper, silver, and titanium.

In the present embodiment, the first elastic body 22 and second elastic body 22' may have the same form, material, and physical properties or may be different from each other in these.

In the electrolyzer of the present embodiment, from the viewpoint of effectively preventing the zero-gap structure from being lost due to degradation of the first elastic body, the thickness of the second elastic body is preferably larger than the thickness of the first elastic body. From the similar viewpoint as described above, the normal surface pressure of the second elastic body is preferably larger than the normal surface pressure of the first elastic body.

The thickness of the first elastic body and the thickness of the second elastic body are not particularly limited, and both of them can be 0.1 mm to 15 mm, for example, are preferably 0.2 mm to 10 mm, more preferably 0.5 mm to 7 mm.

The normal surface pressure of the first elastic body and the normal surface pressure of the second elastic body are also not particularly limited, and both of them can be 30 $gf/cm^2$ to 350 $gf/cm^2$, for example, are preferably 40 to 300 $gf/cm^2$, more preferably 50 to 250 $gf/cm^2$.

(Support)

The cathode chamber 70 preferably comprises the support 24 that electrically connects the collector 23 to the partition wall 80. This can achieve an efficient current flow.

The support 24 preferably comprises an electrically conductive metal such as nickel, iron, copper, silver, and titanium. The support 24 may have any shape as long as the support can support the collector 23 and may have a rod, plate, or net shape. The support 24 has a plate shape, for example. A plurality of supports 24 are arranged between the partition wall 80 and the collector 23. The plurality of supports 24 are aligned such that the surfaces thereof are in parallel to each other. The supports 24 are arranged substantially perpendicular to the partition wall 80 and the collector 23.

(Anode-Side Gasket and Cathode-Side Gasket)

The anode-side gasket 12 is preferably arranged on the frame surface constituting the anode chamber 60. The cathode-side gasket 13 is preferably arranged on the frame surface constituting the cathode chamber 70. Electrolytic cells are connected to each other such that the anode-side gasket 12 included in one electrolytic cell and the cathode-side gasket 13 of an electrolytic cell adjacent to the cell sandwich the cation exchange membrane 51 (see FIG. 2). These gaskets can impart airtightness to connecting points when the plurality of electrolytic cells 50 are connected in series via the cation exchange membrane 51.

The gaskets form a seal between the ion exchange membrane and electrolytic cells. Specific examples of the gaskets include picture frame-like rubber sheets at the center of which an aperture portion is formed. The gaskets are required to have resistance against corrosive electrolyte solutions or produced gas and be usable for a long period. Thus, in respect of chemical resistance and hardness, vulcanized products and peroxide-crosslinked products of ethylene-propylene-diene rubber (EPDM rubber) and ethylene-propylene rubber (EPM rubber) are usually used as the gaskets. Alternatively, gaskets of which region to be in contact with liquid (liquid contact portion) is covered with a fluorine-containing resin such as polytetrafluoroethylene (PTFE) and tetrafluoroethylene-perfluoroalkyl vinyl ether copolymers (PFA) may be employed as required. These gaskets each may have an aperture portion so as not to inhibit the flow of the electrolyte solution, and the shape of the aperture portion is not particularly limited. For example, a picture frame-like gasket is attached with an adhesive or the like along the peripheral edge of each aperture portion of the anode chamber frame constituting the anode chamber 60 or the cathode chamber frame constituting the cathode chamber 70. Then, for example, when the two electrolytic cells 50 are connected via the cation exchange membrane 51 (see FIG. 2), each electrolytic cell 50 onto which the gasket is attached should be tightened via the cation exchange membrane 51. This tightening can prevent the electrolyte solution, alkali metal hydroxide, chlorine gas, hydrogen gas, and the like generated from electrolysis from leaking out of the electrolytic cells 50.

[Laminate]

The electrode for electrolysis in the present embodiment can be combined with a membrane such as an ion exchange membrane or a microporous membrane into a laminate and used. In other words, the laminate in the present embodiment may be one comprising a first electrode for electrolysis and a membrane or may be one comprising a first electrode for electrolysis, a membrane, and a second electrode for electrolysis. Specific examples of the electrode for electrolysis and membrane will be detailed below.

[Electrode for Electrolysis]

The electrode for electrolysis in the present embodiment, which is not particularly limited, is preferably one that can constitute a laminate with a membrane as described above, that is, one that can be integrated with a membrane, more preferably one that is used as a wound body. The electrode for electrolysis may be an electrode that serves as a cathode in the electrolyzer or may be an electrode that serves as an anode. As for the material, form, physical properties, and the like of the electrode for electrolysis, those suitable may be appropriately selected, in consideration of the steps (A) and (B) in the present embodiment described below, the configuration of the electrolyzer, and the like. Hereinbelow, preferable aspects of the electrode for electrolysis in the present embodiment will be described, but these are merely preferred exemplary aspects on performing the steps (A) and (B). Electrodes for electrolysis other than the aspects mentioned below also can be appropriately employed.

The electrode for electrolysis in the present embodiment has a force applied per unit mass·unit area of preferably 1.6 $N/(mg \cdot cm^2)$ or less, more preferably less than 1.6 $N/(mg \cdot cm^2)$, further preferably less than 1.5 $N/(mg \cdot cm^2)$, even further preferably 1.2 $N/mg \cdot cm^2$ or less, still more preferably 1.20 $N/mg \cdot cm^2$ or less from the viewpoint of enabling a good handling property to be provided and having a good adhesive force to a membrane such as an ion exchange membrane and a microporous membrane, a feed conductor (a degraded electrode and an electrode having no catalyst coating), and the like. The force applied is even still more preferably 1.1 N/mg·cm$^2$ or less, further still more preferably 1.10 N/mg·cm$^2$ or less, particularly preferably 1.0 N/mg·cm$^2$ or less, especially preferably 1.00 N/mg·cm$^2$ or less.

From the viewpoint of further improving the electrolytic characteristics, the force is preferably more than 0.005 N/(mg·cm$^2$), more preferably 0.08 N/(mg·cm$^2$) or more, further preferably 0.1 N/mg·cm$^2$ or more, further more preferably 0.14 N/(mg·cm$^2$) or more. The force is further more preferably 0.2 N/(mg·cm$^2$) or more from the viewpoint of further facilitating handling in a large size (e.g., a size of 1.5 m×2.5 m).

The force applied described above can be within the range described above by appropriately adjusting an opening ratio described below, the thickness of the electrode, the arithmetic average surface roughness, and the like, for example. More specifically, for example, a higher opening ratio tends to lead to a smaller force applied, and a lower opening ratio tends to lead to a larger force applied.

The mass per unit is preferably 48 mg/cm$^2$ or less, more preferably 30 mg/cm$^2$ or less, further preferably 20 mg/cm$^2$ or less from the viewpoint of enabling a good handling property to be provided, having a good adhesive force to a membrane such as an ion exchange membrane and a microporous membrane, a degraded electrode, a feed conductor having no catalyst coating, and of economy, and furthermore preferably 15 mg/cm$^2$ or less from the comprehensive viewpoint including handling property, adhesion, and economy. The lower limit value is not particularly limited but is of the order of 1 mg/cm$^2$, for example.

The mass per unit area described above can be within the range described above by appropriately adjusting an opening ratio described below, thickness of the electrode, and the like, for example. More specifically, for example, when the thickness is constant, a higher opening ratio tends to lead to a smaller mass per unit area, and a lower opening ratio tends to lead to a larger mass per unit area.

The force applied can be measured by methods (i) or (ii) described below. As for the force applied, the value obtained by the measurement of the method (i) (also referred to as "the force applied (1)") and the value obtained by the measurement of the method (ii) (also referred to as "the force applied (2)") may be the same or different, and either of the values is preferably less than 1.5 N/mg·cm$^2$.

[Method (i)]

A nickel plate obtained by blast processing with alumina of grain-size number 320 (thickness 1.2 mm, 200 mm square), an ion exchange membrane which is obtained by applying inorganic material particles and a binder to both surfaces of a membrane of a perfluorocarbon polymer into which an ion exchange group is introduced (170 mm square, the detail of the ion exchange membrane referred to herein is as described in Examples), and a sample electrode (130 mm square) are laminated in this order. After this laminate is sufficiently immersed in pure water, excess water deposited on the surface of the laminate is removed to obtain a sample for measurement. The arithmetic average surface roughness (Ra) of the nickel plate after the blast treatment is 0.5 to 0.8 μm. The specific method for calculating the arithmetic average surface roughness (Ra) is as described in Examples.

Under conditions of a temperature of 23±2° C. and a relative humidity of 30±5%, only the sample electrode in this sample for measurement is raised in the vertical direction at 10 mm/minute using a tensile and compression testing machine, and the load when the sample electrode is raised by 10 mm in the vertical direction is measured. This measurement is repeated three times, and the average value is calculated.

This average value is divided by the area of the overlapping portion of the sample of electrode and the ion exchange membrane and the mass of the portion overlapping the ion exchange membrane in the sample of electrode to calculate the force applied per unit mass·unit area (1) (N/mg·cm$^2$).

The force applied per unit mass·unit area (1) obtained by the method (i) is preferably 1.6 N/(mg·cm$^2$) or less, more preferably less than 1.6 N/(mg·cm$^2$), further preferably less than 1.5 N/(mg·cm$^2$), even further preferably 1.2 N/mg·cm$^2$ or less, still more preferably 1.20 N/mg·cm$^2$ or less from the viewpoint of enabling a good handling property to be provided and having a good adhesive force to a membrane such as an ion exchange membrane and a microporous membrane, a degraded electrode, and a feed conductor having no catalyst coating. The force applied is even still more preferably 1.1 N/mg·cm$^2$ or less, further still more preferably 1.10 N/mg·cm$^2$ or less, particularly preferably 1.0 N/mg·cm$^2$ or less, especially preferably 1.00 N/mg·cm$^2$ or less. The force is preferably more than 0.005 N/(mg·cm$^2$), more preferably 0.08 N/(mg·cm$^2$) or more, further preferably 0.1 N/(mg·cm$^2$) or more from the viewpoint of further improving the electrolytic performance, and furthermore, is further more preferably 0.14 N/(mg·cm$^2$), still more preferably 0.2 N/(mg·cm$^2$) or more from the viewpoint of further facilitating handling in a large size (e.g., a size of 1.5 m×2.5 m).

[Method (ii)]

A nickel plate obtained by blast processing with alumina of grain-size number 320 (thickness 1.2 mm, 200 mm square, a nickel plate similar to that of the method (i) above) and a sample of electrode (130 mm square) are laminated in this order. After this laminate is sufficiently immersed in pure water, excess water deposited on the surface of the laminate is removed to obtain a sample for measurement. Under conditions of a temperature of 23±2° C. and a relative humidity of 30±5%, only the sample of electrode in this sample for measurement is raised in a vertical direction at 10 mm/minute using a tensile and compression testing machine, and the load when the sample of electrode is raised by 10 mm in a vertical direction is measured. This measurement is repeated three times, and the average value is calculated.

This average value is divided by the area of the overlapping portion of the sample of electrode and the nickel plate and the mass of the sample of electrode in the portion overlapping the nickel plate to calculate the adhesive force per unit mass·unit area (2) (N/mg·cm$^2$).

The force applied per unit mass·unit area (2) obtained by the method (ii) is preferably 1.6 N/(mg·cm$^2$) or less, more preferably less than 1.6 N/(mg·cm$^2$), further preferably less than 1.5 N/(mg·cm$^2$), even further preferably 1.2 N/mg·cm$^2$ or less, still more preferably 1.20 N/mg·cm$^2$ or less from the viewpoint of enabling a good handling property to be provided and having a good adhesive force to a membrane such as an ion exchange membrane and a microporous membrane, a degraded electrode, and a feed conductor having no catalyst coating. The force applied is even still more preferably 1.1 N/mg·cm$^2$ or less, further still more preferably 1.10 N/mg·cm$^2$ or less, particularly preferably 1.0 N/mg·cm$^2$ or less, especially preferably 1.00 N/mg·cm$^2$ or less. Furthermore, the force is preferably more than 0.005

N/(mg·cm$^2$), more preferably 0.08 N/(mg·cm$^2$) or more, further preferably 0.1 N/(mg·cm$^2$) or more from the viewpoint of further improving the electrolytic performance, and is further more preferably 0.14 N/(mg·cm$^2$) or more from the viewpoint of further facilitating handling in a large size (e.g., a size of 1.5 m×2.5 m).

The electrode for electrolysis in the embodiment preferably includes a substrate for electrode for electrolysis and a catalyst layer. The thickness of the substrate for electrode for electrolysis (gauge thickness) is not particularly limited, but is preferably 300 μm or less, more preferably 205 μm or less, further preferably 155 μm or less, further preferably 135 μm or less, even further preferably 125 μm or less, still more preferably 120 μm or less, even still more preferably 100 μm or less from the viewpoint of enabling a good handling property to be provided, having a good adhesive force to a membrane such as an ion exchange membrane and a microporous membrane, a degraded electrode (feed conductor), and an electrode (feed conductor) having no catalyst coating, being capable of being suitably rolled in a roll and satisfactorily folded, and facilitating handling in a large size (e.g., a size of 1.5 m×2.5 m), and further still more preferably 50 μm or less from the viewpoint of a handling property and economy. The lower limit value is not particularly limited, but is 1 μm, for example, preferably 5 μm, more preferably 15 μm.

In the present embodiment, in order to integrate the membrane and the electrode for electrolysis, a liquid is preferably interposed therebetween. As the liquid, any liquid, such as water and organic solvents, can be used as long as the liquid generates a surface tension. The larger the surface tension of the liquid, the larger the force applied between the membrane and the electrode for electrolysis. Thus, a liquid having a larger surface tension is preferred. Examples of the liquid include the following (the numerical value in the parentheses is the surface tension of the liquid at 20° C.):

hexane (20.44 mN/m), acetone (23.30 mN/m), methanol (24.00 mN/m), ethanol (24.05 mN/m), ethylene glycol (50.21 mN/m), and water (72.76 mN/m).

A liquid having a large surface tension allows the membrane and the electrode for electrolysis to be easily integrated (to be a laminate), and renewing of the electrode tends to be easier. The liquid between the membrane and the electrode for electrolysis may be present in an amount such that the both adhere to each other by the surface tension. As a result, after the laminate is placed in an electrolytic cell, the liquid, if mixed into the electrolyte solution, does not affect electrolysis itself due to the small amount of the liquid.

From a practical viewpoint, a liquid having a surface tension of 24 mN/m to 80 mN/m, such as ethanol, ethylene glycol, and water, is preferably used as the liquid. Particularly preferred is water or an alkaline aqueous solution prepared by dissolving caustic soda, potassium hydroxide, lithium hydroxide, sodium hydrogen carbonate, potassium hydrogen carbonate, sodium carbonate, potassium carbonate, or the like in water. Alternatively, the surface tension can be adjusted by allowing these liquids to contain a surfactant. When a surfactant is contained, the adhesion between the membrane and the electrode for electrolysis varies to enable the handling property to be adjusted. The surfactant is not particularly limited, and both ionic surfactants and nonionic surfactants may be used.

The proportion measured by the following method (2) of the electrode for electrolysis in the embodiment is not particularly limited, but is preferably 90% or more, more preferably 92% or more from the viewpoint of enabling a good handling property to be provided and having a good adhesive force to a membrane such as an ion exchange membrane and a microporous membrane, a degraded electrode (feed conductor), and an electrode (feed conductor) having no catalyst coating, and further preferably 95% or more from the viewpoint of further facilitating handling in a large size (e.g., a size of 1.5 m×2.5 m). The upper limit value is 100%.

[Method (2)]

An ion exchange membrane (170 mm square) and a sample of electrode (130 mm square) are laminated in this order. The laminate is placed on a curved surface of a polyethylene pipe (outer diameter: 280 mm) such that the sample of electrode in this laminate is positioned outside under conditions of a temperature of 23±2° C. and a relative humidity of 30±5%, the laminate and the pipe are sufficiently immersed in pure water, excess water deposited on a surface of the laminate and the pipe is removed, and one minute after this removal, then the proportion (%) of an area of a portion in which the ion exchange membrane (170 mm square) is in close contact with the sample of electrode is measured.

The proportion measured by the following method (3) of the electrode for electrolysis of the embodiment is not particularly limited, but is preferably 75% or more, more preferably 80% or more from the viewpoint of enabling a good handling property to be provided, having a good adhesive force to a membrane such as an ion exchange membrane and a microporous membrane, a degraded electrode (feed conductor), and an electrode (feed conductor) having no catalyst coating, and being capable of being suitably rolled in a roll and satisfactorily folded, and is further preferably 90% or more from the viewpoint of further facilitating handling in a large size (e.g., a size of 1.5 m×2.5 m). The upper limit value is 100%.

[Method (3)]

An ion exchange membrane (170 mm square) and a sample of electrode (130 mm square) are laminated in this order. The laminate is placed on a curved surface of a polyethylene pipe (outer diameter: 145 mm) such that the sample of electrode in this laminate is positioned outside under conditions of a temperature of 23±2° C. and a relative humidity of 30±5%, the laminate and the pipe are sufficiently immersed in pure water, excess water deposited on a surface of the laminate and the pipe is removed, and one minute after this removal, then the proportion (%) of an area of a portion in which the ion exchange membrane (170 mm square) is in close contact with the sample of electrode is measured.

The electrode for electrolysis in the embodiment preferably has, but is not particularly limited to, a porous structure and an opening ratio or void ratio of 5 to 90% or less, from the viewpoint of enabling a good handling property to be provided, having a good adhesive force to a membrane such as an ion exchange membrane and a microporous membrane, a degraded electrode (feed conductor), and an electrode (feed conductor) having no catalyst coating, and preventing accumulation of gas to be generated during electrolysis. The opening ratio is more preferably 10 to 80% or less, further preferably 20 to 75%.

The opening ratio is a proportion of the opening portions per unit volume. The calculation method may differ depending on that opening portions in submicron size are considered or that only visible openings are considered. In the embodiment, a volume V can be calculated from the values of the gauge thickness, width, and length of electrode, and further, a weight W is measured to thereby enable an opening ratio A to be calculated by the following formula.

$$A=(1-(W/(V\times\rho))\times 100$$

ρ is the density of the electrode material (g/cm$^3$). For example, ρ of nickel is 8.908 g/cm$^3$, and ρ of titanium is 4.506 g/cm$^3$. The opening ratio can be appropriately adjusted by a method of changing the area of metal to be perforated per unit area in the case of perforated metal, changing the values of the SW (short diameter), LW (long diameter), and feed in the case of expanded metal, changing the line diameter of metal fiber and mesh number in the case of mesh, changing the pattern of a photoresist to be used in the case of electroforming, changing the metal fiber diameter and fiber density in the case of nonwoven fabric, changing the mold for forming voids in the case of foamed metal, or the like.

The value obtained by measurement by the following method (A) of the electrode for electrolysis in the embodiment is preferably 40 mm or less, more preferably 29 mm or less, further preferably 10 mm or less, further more preferably 6.5 mm or less from the viewpoint of the handling property.

[Method (A)]

Under conditions of a temperature of 23±2° C. and a relative humidity of 30±5%, a sample of laminate obtained by laminating the ion exchange membrane and the electrode for electrolysis is wound around and fixed onto a curved surface of a core material being made of polyvinyl chloride and having an outer diameter ϕ of 32 mm, and left to stand for 6 hours; thereafter, when the electrode for electrolysis is separated from the sample and placed on a flat plate, heights in a vertical direction at both edges of the electrode for electrolysis $L_1$ and $L_2$ are measured, and an average value thereof is used as a measurement value.

In the electrode for electrolysis in the embodiment, the ventilation resistance is preferably 24 kPa·s/m or less when the electrode for electrolysis has a size of 50 mm×50 mm, the ventilation resistance being measured under the conditions of the temperature of 24° C., the relative humidity of 32%, a piston speed of 0.2 cm/s, and a ventilation volume of 0.4 cc/cm$^2$/s (hereinbelow, also referred to as "measurement condition 1") (hereinbelow, also referred to as "ventilation resistance 1"). A larger ventilation resistance means that air is unlikely to flow and refers to a state of a high density. In this state, the product from electrolysis remains in the electrode and the reaction substrate is more unlikely to diffuse inside the electrode, and thus, the electrolytic performance (such as voltage) tends to deteriorate. The concentration on the membrane surface tends to increase. Specifically, the caustic concentration increases on the cathode surface, and the supply of brine tends to decrease on the anode surface. As a result, the product accumulates at a high concentration on the interface at which the membrane is in contact with the electrode for electrolysis. This accumulation leads to damage of the membrane and tends to also lead to increase in the voltage and damage of the membrane on the cathode surface and damage of the membrane on the anode surface.

In order to prevent these defects, the ventilation resistance is preferably set at 24 kPa·s/m or less.

From a similar viewpoint as above, the ventilation resistance is more preferably less than 0.19 kPa·s/m, further preferably 0.15 kPa·s/m or less, further more preferably 0.07 kPa·s/m or less.

When the ventilation resistance is larger than a certain value, NaOH generated in the electrode tends to accumulate on the interface between the electrode for electrolysis and the membrane to result in a high concentration in the case of the cathode, and the supply of brine tends to decrease to cause the brine concentration to be lower in the case of the anode. In order to prevent damage to the membrane that may be caused by such accumulation, the ventilation resistance is preferably less than 0.19 kPa·s/m, more preferably 0.15 kPa·s/m or less, further preferably 0.07 kPa·s/m or less.

In contrast, when the ventilation resistance is low, the area of the electrode for electrolysis is reduced and the electrolysis area is reduced. Thus, the electrolytic performance (such as voltage) tends to deteriorate. When the ventilation resistance is zero, the feed conductor functions as the electrode because no electrode for electrolysis is provided, and the electrolytic performance (such as voltage) tends to markedly deteriorate. From this viewpoint, a preferable lower limit value identified as the ventilation resistance 1 is not particularly limited, but is preferably more than 0 kPa·s/m, more preferably 0.0001 kPa·s/m or more, further preferably 0.001 kPa·s/m or more.

When the ventilation resistance 1 is 0.07 kPa·s/m or less, a sufficient measurement accuracy may not be achieved because of the measurement method therefor. From this viewpoint, it is also possible to evaluate an electrode for electrolysis having a ventilation resistance 1 of 0.07 kPa·s/m or less by means of a ventilation resistance (hereinbelow, also referred to as "ventilation resistance 2") obtained by the following measurement method (hereinbelow, also referred to as "measurement condition 2"). That is, the ventilation resistance 2 is a ventilation resistance measured, when the electrode for electrolysis has a size of 50 mm×50 mm, under conditions of the temperature of 24° C., the relative humidity of 32%, a piston speed of 2 cm/s, and a ventilation volume of 4 cc/cm$^2$/s.

The ventilation resistances 1 and 2 can be within the range described above by appropriately adjusting an opening ratio, thickness of the electrode, and the like, for example. More specifically, for example, when the thickness is constant, a higher opening ratio tends to lead to smaller ventilation resistances 1 and 2, and a lower opening ratio tends to lead to larger ventilation resistances 1 and 2.

Hereinbelow, a more specific embodiment of the electrode for electrolysis in the present embodiment will be described.

The electrode for electrolysis in the present embodiment preferably includes an electrode substrate for electrolysis and a catalyst layer. The catalyst layer may be composed of a plurality of layers as shown below or may be a single-layer configuration.

As shown in FIG. 7, an electrode for electrolysis 101 according to the present embodiment includes an electrode substrate for electrolysis 10 and a pair of first layers 20 with which the both the surfaces of the electrode substrate for electrolysis 10 are covered. The entire substrate for electrode for electrolysis 10 is preferably covered with the first layers 20. This covering is likely to improve the catalyst activity and durability of the electrode for electrolysis. One first layer 20 may be laminated only on one surface of the substrate for electrode for electrolysis 10.

Also shown in FIG. 7, the surfaces of the first layers 20 may be covered with second layers 30. The entire first layers 20 are preferably covered by the second layers 30. Alternatively, one second layer 30 may be laminated only one surface of the first layer 20.

(Substrate for Electrode for Electrolysis)

As the substrate for electrode for electrolysis 10, for example, nickel, nickel alloys, stainless steel, and further, valve metals including titanium can be used, although not limited thereto. At least one element selected from nickel (Ni) and titanium (Ti) is preferably included.

When stainless steel is used in an alkali aqueous solution of a high concentration, iron and chromium are eluted and the electrical conductivity of stainless steel is of the order of one-tenth of that of nickel. In consideration of the foregoing, a substrate containing nickel (Ni) is preferable as the substrate for electrode for electrolysis.

Alternatively, when the substrate for electrode for electrolysis 10 is used in a salt solution of a high concentration near the saturation under an atmosphere in which chlorine gas is generated, the material of the substrate for electrode 10 is also preferably titanium having high corrosion resistance.

The form of the substrate for electrode for electrolysis 10 is not particularly limited, and a form suitable for the purpose can be selected. As the form, any of a perforated metal, nonwoven fabric, foamed metal, expanded metal, metal porous foil formed by electroforming, so-called woven mesh produced by knitting metal lines, and the like can be used. Among these, a perforated metal or expanded metal is preferable. Electroforming is a technique for producing a metal thin film having a precise pattern by using photolithography and electroplating in combination. It is a method including forming a pattern on a substrate with a photoresist and electroplating the portion not protected by the resist to provide a metal thin film.

As for the form of the substrate for electrode for electrolysis, a suitable specification depends on the distance between the anode and the cathode in the electrolyzer. In the case where the distance between the anode and the cathode is finite, an expanded metal or perforated metal form can be used, and in the case of a so-called zero-gap base electrolyzer, in which the ion exchange membrane is in contact with the electrode, a woven mesh produced by knitting thin lines, wire mesh, foamed metal, metal nonwoven fabric, expanded metal, perforated metal, metal porous foil, and the like can be used, although not limited thereto.

Examples of the substrate for electrode for electrolysis 10 include a metal porous foil, a wire mesh, a metal nonwoven fabric, a perforated metal, an expanded metal, and a foamed metal.

As a plate material before processed into a perforated metal or expanded metal, rolled plate materials and electrolytic foils are preferable. An electrolytic foil is preferably further subjected to a plating treatment by use of the same element as the base material thereof, as the post-treatment, to thereby form asperities on one or both of the surfaces.

The thickness of the substrate for electrode for electrolysis 10 is, as mentioned above, preferably 300 μm or less, more preferably 205 μm or less, further preferably 155 μm or less, further more preferably 135 μm or less, even further preferably 125 μm or less, still more preferably 120 μm or less, even still more preferably 100 μm or less, and further still more preferably 50 μm or less from the viewpoint of a handling property and economy. The lower limit value is not particularly limited, but is 1 μm, for example, preferably 5 μm, more preferably 15 μm.

In the substrate for electrode for electrolysis, the residual stress during processing is preferably relaxed by annealing the substrate for electrode for electrolysis in an oxidizing atmosphere. It is preferable to form asperities using a steel grid, alumina powder, or the like on the surface of the substrate for electrode for electrolysis followed by an acid treatment to increase the surface area thereof, in order to improve the adhesion to a catalyst layer with which the surface is covered. Alternatively, it is preferable to give a plating treatment by use of the same element as the substrate to increase the surface area.

To bring the first layer 20 into close contact with the surface of the substrate for electrode for electrolysis 10, the substrate for electrode for electrolysis 10 is preferably subjected to a treatment of increasing the surface area. Examples of the treatment of increasing the surface area include a blast treatment using a cut wire, steel grid, alumina grid or the like, an acid treatment using sulfuric acid or hydrochloric acid, and a plating treatment using the same element to that of the substrate. The arithmetic average surface roughness (Ra) of the substrate surface is not particularly limited, but is preferably 0.05 μm to 50 μm, more preferably 0.1 to 10 μm, further preferably 0.1 to 8 μm.

Next, a case where the electrode for electrolysis is used as an anode for common salt electrolysis in the embodiment will be described.

(First Layer)

In FIG. 7, a first layer 20 as a catalyst layer contains at least one of ruthenium oxides, iridium oxides, and titanium oxides. Examples of the ruthenium oxide include $RuO_2$. Examples of the iridium oxide include $IrO_2$. Examples of the titanium oxide include $TiO_2$. The first layer 20 preferably contains two oxides: a ruthenium oxide and a titanium oxide or three oxides: a ruthenium oxide, an iridium oxide, and a titanium oxide. This makes the first layer 20 more stable and additionally improves the adhesion with the second layer 30.

When the first layer 20 contains two oxides: a ruthenium oxide and a titanium oxide, the first layer 20 contains preferably 1 to 9 mol, more preferably 1 to 4 mol of the titanium oxide based on 1 mol of the ruthenium oxide contained in the first layer 20. With the composition ratio of the two oxides in this range, the electrode for electrolysis 101 exhibits excellent durability.

When the first layer 20 contains three oxides: a ruthenium oxide, an iridium oxide, and a titanium oxide, the first layer 20 contains preferably 0.2 to 3 mol, more preferably 0.3 to 2.5 mol of the iridium oxide based on 1 mol of the ruthenium oxide contained in the first layer 20. The first layer 20 contains preferably 0.3 to 8 mol, more preferably 1 to 7 mol of the titanium oxide based on 1 mol of the ruthenium oxide contained in the first layer 20. With the composition ratio of the three oxides in this range, the electrode for electrolysis 101 exhibits excellent durability.

When the first layer 20 contains at least two of a ruthenium oxide, an iridium oxide, and a titanium oxide, these oxides preferably form a solid solution. Formation of the oxide solid solution allows the electrode for electrolysis 101 to exhibit excellent durability.

In addition to the compositions described above, oxides of various compositions can be used as long as at least one oxide of a ruthenium oxide, an iridium oxide, and titanium oxide is contained. For example, an oxide coating called DSA(R), which contains ruthenium, iridium, tantalum, niobium, titanium, tin, cobalt, manganese, platinum, and the like, can be used as the first layer 20.

The first layer 20 need not be a single layer and may include a plurality of layers. For example, the first layer 20 may include a layer containing three oxides and a layer containing two oxides. The thickness of the first layer 20 is preferably 0.05 to 10 μm, more preferably 0.1 to 8 μm.

(Second Layer)

The second layer 30 preferably contains ruthenium and titanium. This enables the chlorine overvoltage immediately after electrolysis to be further lowered.

The second layer 30 preferably contains a palladium oxide, a solid solution of a palladium oxide and platinum, or an alloy of palladium and platinum. This enables the chlorine overvoltage immediately after electrolysis to be further lowered.

A thicker second layer 30 can maintain the electrolytic performance for a longer period, but from the viewpoint of economy, the thickness is preferably 0.05 to 3 μm.

Next, a case where the electrode for electrolysis is used as a cathode for common salt electrolysis in the embodiment will be described.

(First Layer)

Examples of components of the first layer 20 as the catalyst layer include metals such as C, Si, P, S, Al, Ti, V, Cr, Mn, Fe, Co, Ni, Cu, Zn, Y, Zr, Nb, Mo, Ru, Rh, Pd, Ag, Cd, In, Sn, Ta, W, Re, Os, Ir, Pt, Au, Hg, Pb, Bi, La, Ce, Pr, Nd, Pm, Sm, Eu, Gd, Tb, Dy, Ho, Er, Tm, Yb, and Lu, and oxides and hydroxides of the metals.

The first layer 20 may or may not contain at least one of platinum group metals, platinum group metal oxides, platinum group metal hydroxides, and alloys containing a platinum group metal.

When the first layer 20 contains at least one of platinum group metals, platinum group metal oxides, platinum group metal hydroxides, and alloys containing a platinum group metal, the platinum group metals, platinum group metal oxides, platinum group metal hydroxides, and alloys containing a platinum group metal preferably contain at least one platinum group metal of platinum, palladium, rhodium, ruthenium, and iridium.

As the platinum group metal, platinum is preferably contained.

As the platinum group metal oxide, a ruthenium oxide is preferably contained.

As the platinum group metal hydroxide, a ruthenium hydroxide is preferably contained.

As the platinum group metal alloy, an alloy of platinum with nickel, iron, and cobalt is preferably contained.

Further, as required, an oxide or hydroxide of a lanthanoid element is preferably contained as a second component. This allows the electrode for electrolysis 101 to exhibit excellent durability.

As the oxide or hydroxide of a lanthanoid element, at least one selected from lanthanum, cerium, praseodymium, neodymium, promethium, samarium, europium, gadolinium, terbium, and dysprosium is preferably contained.

Further, as required, an oxide or hydroxide of a transition metal is preferably contained as a third component.

Addition of the third component enables the electrode for electrolysis 101 to exhibit more excellent durability and the electrolysis voltage to be lowered.

Examples of a preferable combination include ruthenium only, ruthenium+nickel, ruthenium+cerium, ruthenium+lanthanum, ruthenium+lanthanum+platinum, ruthenium+lanthanum+palladium, ruthenium+praseodymium, ruthenium+praseodymium+platinum, ruthenium+praseodymium+platinum+palladium, ruthenium+neodymium, ruthenium+neodymium+platinum, ruthenium+neodymium+manganese, ruthenium+neodymium+iron, ruthenium+neodymium+cobalt, ruthenium+neodymium+zinc, ruthenium+neodymium+gallium, ruthenium+neodymium+sulfur, ruthenium+neodymium+lead, ruthenium+neodymium+nickel, ruthenium+neodymium+copper, ruthenium+samarium, ruthenium+samarium+manganese, ruthenium+samarium+iron, ruthenium+samarium+cobalt, ruthenium+samarium+zinc, ruthenium+samarium+gallium, ruthenium+samarium+sulfur, ruthenium+samarium+lead, ruthenium+samarium+nickel, platinum+cerium, platinum+palladium+cerium, platinum+palladium+lanthanum+cerium, platinum+iridium, platinum+palladium, platinum+iridium+palladium, platinum+nickel+palladium, platinum+nickel+ruthenium, alloys of platinum and nickel, alloys of platinum and cobalt, and alloys of platinum and iron.

When platinum group metals, platinum group metal oxides, platinum group metal hydroxides, and alloys containing a platinum group metal are not contained, the main component of the catalyst is preferably nickel element.

At least one of nickel metal, oxides, and hydroxides is preferably contained.

As the second component, a transition metal may be added. As the second component to be added, at least one element of titanium, tin, molybdenum, cobalt, manganese, iron, sulfur, zinc, copper, and carbon is preferably contained.

Examples of a preferable combination include nickel+tin, nickel+titanium, nickel+molybdenum, and nickel+cobalt.

As required, an intermediate layer can be placed between the first layer 20 and the substrate for electrode for electrolysis 10. The durability of the electrode for electrolysis 101 can be improved by placing the intermediate layer.

As the intermediate layer, those having affinity to both the first layer 20 and the substrate for electrode for electrolysis 10 are preferable. As the intermediate layer, nickel oxides, platinum group metals, platinum group metal oxides, and platinum group metal hydroxides are preferable. The intermediate layer can be formed by applying and baking a solution containing a component that forms the intermediate layer. Alternatively, a surface oxide layer also can be formed by subjecting a substrate to a thermal treatment at a temperature of 300 to 600° C. in an air atmosphere. Besides, the layer can be formed by a known method such as a thermal spraying method and ion plating method.

(Second Layer)

Examples of components of the second layer 30 as the catalyst layer include metals such as C, Si, P, S, Al, Ti, V, Cr, Mn, Fe, Co, Ni, Cu, Zn, Y, Zr, Nb, Mo, Ru, Rh, Pd, Ag, Cd, In, Sn, Ta, W, Re, Os, Ir, Pt, Au, Hg, Pb, Bi, La, Ce, Pr, Nd, Pm, Sm, Eu, Gd, Tb, Dy, Ho, Er, Tm, Yb, and Lu, and oxides and hydroxides of the metals.

The second layer may or may not contain at least one of platinum group metals, platinum group metal oxides, platinum group metal hydroxides, and alloys containing a platinum group metal. Examples of a preferable combination of elements contained in the second layer include the combinations enumerated for the first layer. The combination of the first layer and the second layer may be a combination in which the compositions are the same and the composition ratios are different or may be a combination of different compositions.

As the thickness of the catalyst layer, the total thickness of the catalyst layer formed and the intermediate layer is preferably 0.01 μm to 20 μm. With a thickness of 0.01 μm or more, the catalyst layer can sufficiently serve as the catalyst. With a thickness of 20 μm or less, it is possible to form a robust catalyst layer that is unlikely to fall off from the substrate. The thickness is more preferably 0.05 μm to 15 μm. The thickness is more preferably 0.1 μm to 10 μm. The thickness is further preferably 0.2 μm to 8 μm.

The thickness of the electrode for electrolysis, that is, the total thickness of the substrate for electrode for electrolysis and the catalyst layer is preferably 315 μm or less, more preferably 220 μm or less, further preferably 170 μm or less, further more preferably 150 μm or less, particularly preferably 145 μm or less, still more preferably 140 μm or less, even still more preferably 138 μm or less, further still more preferably 135 μm or less in respect of the handling property of the electrode. A thickness of 135 μm or less can provide a particularly good handling property. Further, from a similar viewpoint as described above, the thickness is preferably 130 μm or less, more preferably less than 130 μm, further preferably 120 μm or less, further more preferably 115 μm or less, still more preferably 65 μm or less. The lower limit value is not particularly limited, but is preferably 1 μm or more, more preferably 5 μm or more for practical reasons, more preferably 20 μm or more. The thickness of the electrode can be determined by measurement with a digimatic thickness gauge (Mitutoyo Corporation, minimum scale 0.001 mm). The thickness of the electrode substrate for electrode is measured in the same manner as the thickness of the electrode. The thickness of the catalyst layer can be determined by subtracting the thickness of the electrode substrate for electrolysis from the thickness of the electrode.

In the present embodiment, the electrode for electrolysis preferably contains at least one catalyst component selected from the group consisting of Ru, Rh, Pd, Ir, Pt, Au, Ti, V, Cr, Mn, Fe, Co, Ni, Cu, Zn, Y, Zr, Nb, Mo, Ag, Ta, W, Re, Os, Al, In, Sn, Sb, Ga, Ge, B, C, N, O, Si, P, S, La, Ce, Pr, Nd, Pm, Sm, Eu, Gd, Tb, and Dy from the viewpoint of achieving sufficient electrolytic characteristics.

In the present embodiment, from the viewpoint that the electrode for electrolysis, if being an electrode having a broad elastic deformation region, can provide a better handling property and has a good adhesive force to a membrane such as an ion exchange membrane and a microporous membrane, a degraded electrode, a feed conductor having no catalyst coating, and the like, the thickness of the electrode for electrolysis is preferably 315 μm or less, more preferably 220 μm or less, further preferably 170 μm or less, further more preferably 150 μm or less, particularly preferably 145 μm or less, still more preferably 140 μm or less, even still more preferably 138 μm or less, further still more preferably 135 μm or less. A thickness of 135 μm or less can provide a particularly good handling property. Further, from a similar viewpoint as above, the thickness is preferably 130 μm or less, more preferably less than 130 μm, further preferably 115 μm or less, further more preferably 65 μm or less. The lower limit value is not particularly limited, but is preferably 1 μm or more, more preferably 5 μm or more for practical reasons, more preferably 20 μm or more. In the present embodiment, "having a broad elastic deformation region" means that, when an electrode for electrolysis is wound to form a wound body, warpage derived from winding is unlikely to occur after the wound state is released. The thickness of the electrode for electrolysis refers to, when a catalyst layer mentioned below is included, the total thickness of both the substrate for electrode for electrolysis and the catalyst layer.

As the first electrode for electrolysis, among the electrodes for electrolysis having the material, form, physical properties, and the like mentioned above, one that serves as a cathode may be selected and used as appropriate. As the second electrode for electrolysis, among the electrodes for electrolysis having the material, form, physical properties, and the like mentioned above, one that serves as an anode may be selected and used as appropriate.

(Method for Producing Electrode for Electrolysis)

Next, one embodiment of the method for producing the electrode for electrolysis 101 will be described in detail.

In the embodiment, the electrode for electrolysis 101 can be produced by forming the first layer 20, preferably the second layer 30, on the substrate for electrode for electrolysis by a method such as baking of a coating film under an oxygen atmosphere (pyrolysis), or ion plating, plating, or thermal spraying. The method for producing of the embodiment as mentioned can achieve a high productivity of the electrode for electrolysis 101. Specifically, a catalyst layer is formed on the substrate for electrode for electrolysis by an application step of applying a coating liquid containing a catalyst, a drying step of drying the coating liquid, and a pyrolysis step of performing pyrolysis. Pyrolysis herein means that a metal salt which is to be a precursor is decomposed by heating into a metal or metal oxide and a gaseous substance. The decomposition product depends on the metal species to be used, type of the salt, and the atmosphere under which pyrolysis is performed, and many metals tend to form oxides in an oxidizing atmosphere. In an industrial process of producing an electrode, pyrolysis is usually performed in air, and a metal oxide or a metal hydroxide is formed in many cases.

(Formation of First Layer of Anode)

(Application Step)

The first layer 20 is obtained by applying a solution in which at least one metal salt of ruthenium, iridium, and titanium is dissolved (first coating liquid) onto the substrate for electrode for electrolysis and then pyrolyzing (baking) the coating liquid in the presence of oxygen. The content of ruthenium, iridium, and titanium in the first coating liquid is substantially equivalent to that of the first layer 20.

The metal salts may be chlorides, nitrates, sulfates, metal alkoxides, and any other forms. The solvent of the first coating liquid can be selected depending on the type of the metal salt, and water and alcohols such as butanol can be used. As the solvent, water or a mixed solvent of water and an alcohol is preferable. The total metal concentration in the first coating liquid in which the metal salts are dissolved is not particularly limited, but is preferably in the range of 10 to 150 g/L in association with the thickness of the coating film to be formed by a single coating.

Examples of a method used as the method for applying the first coating liquid onto the substrate for electrode for electrolysis 10 include a dipping method of immersing the substrate for electrode for electrolysis 10 in the first coating liquid, a method of brushing the first coating liquid, a roll method using a sponge roll impregnated with the first coating liquid, and an electrostatic coating method in which the substrate for electrode for electrolysis 10 and the first coating liquid are oppositely charged and spraying is performed. Among these, preferable is the roll method or electrostatic coating method, which has an excellent industrial productivity.

(Drying Step and Pyrolysis Step)

After being applied onto the substrate for electrode for electrolysis 100, the first coating liquid is dried at a temperature of 10 to 90° C. and pyrolyzed in a baking furnace heated to 350 to 650° C. Between the drying and pyrolysis, preliminary baking at 100 to 350° C. may be performed as required. The drying, preliminary baking, and pyrolysis temperature can be appropriately selected depending on the composition and the solvent type of the first coating liquid. A longer time period of pyrolysis per step is preferable, but from the viewpoint of the productivity of the electrode, 3 to 60 minutes is preferable, 5 to 20 minutes is more preferable.

The cycle of application, drying, and pyrolysis described above is repeated to form a covering (the first layer 20) to a predetermined thickness. After the first layer 20 is formed and then further post-baked for a long period as required can further improve the stability of the first layer 20.

(Formation of Second Layer)

The second layer 30, which is formed as required, is obtained, for example, by applying a solution containing a palladium compound and a platinum compound or a solution containing a ruthenium compound and a titanium compound (second coating liquid) onto the first layer 20 and then pyrolyzing the coating liquid in the presence of oxygen.

(Formation of First Layer of Cathode by Pyrolysis Method)

(Application Step)

The first layer 20 is obtained by applying a solution in which metal salts of various combination are dissolved (first coating liquid) onto the substrate for electrode for electrolysis and then pyrolyzing (baking) the coating liquid in the presence of oxygen. The content of the metal in the first coating liquid is substantially equivalent to that in the first layer 20.

The metal salts may be chlorides, nitrates, sulfates, metal alkoxides, and any other forms. The solvent of the first coating liquid can be selected depending on the type of the metal salt, and water and alcohols such as butanol can be used. As the solvent, water or a mixed solvent of water and an alcohol is preferable. The total metal concentration in the first coating liquid in which the metal salts are dissolved is, but is not particularly limited to, preferably in the range of 10 to 150 g/L in association with the thickness of the coating film to be formed by a single coating.

Examples of a method used as the method for applying the first coating liquid onto the substrate for electrode for electrolysis 10 include a dipping method of immersing the substrate for electrode for electrolysis 10 in the first coating liquid, a method of brushing the first coating liquid, a roll method using a sponge roll impregnated with the first coating liquid, and an electrostatic coating method in which the substrate for electrode for electrolysis 10 and the first coating liquid are oppositely charged and spraying is performed. Among these, preferable is the roll method or electrostatic coating method, which has an excellent industrial productivity.

(Drying Step and Pyrolysis Step)

After being applied onto the substrate for electrode for electrolysis 10, the first coating liquid is dried at a temperature of 10 to 90° C. and pyrolyzed in a baking furnace heated to 350 to 650° C. Between the drying and pyrolysis, preliminary baking at 100 to 350° C. may be performed as required. The drying, preliminary baking, and pyrolysis temperature can be appropriately selected depending on the composition and the solvent type of the first coating liquid. A longer time period of pyrolysis per step is preferable, but from the viewpoint of the productivity of the electrode, 3 to 60 minutes is preferable, 5 to 20 minutes is more preferable.

The cycle of application, drying, and pyrolysis described above is repeated to form a covering (the first layer 20) to a predetermined thickness. After the first layer 20 is formed and then further post-baked for a long period as required can further improve the stability of the first layer 20.

(Formation of Intermediate Layer)

The intermediate layer, which is formed as required, is obtained, for example, by applying a solution containing a palladium compound or platinum compound (second coating liquid) onto the substrate and then pyrolyzing the coating liquid in the presence of oxygen. Alternatively, a nickel oxide intermediate layer may be formed on the substrate surface only by heating the substrate, with no solution applied thereon.

(Formation of First Layer of Cathode by Ion Plating)

The first layer 20 can be formed also by ion plating.

An example includes a method in which the substrate is fixed in a chamber and the metal ruthenium target is irradiated with an electron beam. Evaporated metal ruthenium particles are positively charged in plasma in the chamber to deposit on the substrate negatively charged. The plasma atmosphere is argon and oxygen, and ruthenium deposits as ruthenium oxide on the substrate.

(Formation of First Layer of Cathode by Plating)

The first layer 20 can be formed also by a plating method.

As an example, when the substrate is used as the cathode and subjected to electrolytic plating in an electrolyte solution containing nickel and tin, alloy plating of nickel and tin can be formed.

(Formation of First Layer of Cathode by Thermal Spraying)

The first layer 20 can be formed also by thermal spraying.

As an example, plasma spraying nickel oxide particles onto the substrate can form a catalyst layer in which metal nickel and nickel oxide are mixed.

Hereinbelow, the ion exchange membrane according to one aspect of the membrane will be described in detail.

[Ion Exchange Membrane]

The ion exchange membrane is not particularly limited as long as the membrane can be laminated with the electrode for electrolysis, and various ion exchange membranes may be employed. In the present embodiment, preferably used is an ion exchange membrane that has a membrane body containing a hydrocarbon polymer or fluorine-containing polymer having an ion exchange group and a coating layer provided on at least one surface of the membrane body. The coating layer contains inorganic material particles and a binder, and the specific surface area of the coating layer is preferably 0.1 to 10 $m^2/g$. In the ion exchange membrane having such a structure, the influence of gas generated during electrolysis on electrolytic performance is small, and stable electrolytic performance tends to be exhibited.

The membrane of a perfluorocarbon polymer into which an ion exchange group is introduced described above includes either one of a sulfonic acid layer having an ion exchange group derived from a sulfo group (a group represented by $—SO_3—$, hereinbelow also referred to as a "sulfonic acid group") or a carboxylic acid layer having an ion exchange group derived from a carboxyl group (a group represented by $—CO_2—$, hereinbelow also referred to as a "carboxylic acid group"). From the viewpoint of strength and dimension stability, reinforcement core materials are preferably further included.

The inorganic material particles and binder will be described in detail in the section of description of the coating layer below.

FIG. 8 illustrates a cross-sectional schematic view showing one embodiment of an ion exchange membrane. An ion exchange membrane 1 has a membrane body 1*a* containing a hydrocarbon polymer or fluorine-containing polymer having an ion exchange group and coating layers 11*a* and 11*b* formed on both the surfaces of the membrane body 1*a*.

In the ion exchange membrane 1, the membrane body 1*a* comprises a sulfonic acid layer 3 having an ion exchange group derived from a sulfo group (a group represented by $—SO_3—$, hereinbelow also referred to as a "sulfonic acid group") and a carboxylic acid layer 2 having an ion exchange group derived from a carboxyl group (a group represented by $—CO_2—$, hereinbelow also referred to as a "carboxylic acid group"), and the reinforcement core materials 4 enhance the strength and dimension stability. The ion exchange membrane 1, as comprising the sulfonic acid layer 3 and the carboxylic acid layer 2, is suitably used as an anion exchange membrane.

The ion exchange membrane may include either one of the sulfonic acid layer and the carboxylic acid layer. The ion exchange membrane may not be necessarily reinforced by reinforcement core materials, and the arrangement of the reinforcement core materials is not limited to the example in FIG. 8.

(Membrane Body)

First, the membrane body 10 constituting the ion exchange membrane 1 will be described.

The membrane body 1*a* should be one that has a function of selectively allowing cations to permeate and comprises a hydrocarbon polymer or a fluorine-containing polymer having an ion exchange group. Its configuration and material are not particularly limited, and preferred ones can be appropriately selected.

The hydrocarbon polymer or fluorine-containing polymer having an ion exchange group in the membrane body 1*a* can be obtained from a hydrocarbon polymer or fluorine-containing polymer having an ion exchange group precursor capable of forming an ion exchange group by hydrolysis or the like. Specifically, for example, after a polymer comprising a main chain of a fluorinated hydrocarbon, having, as a pendant side chain, a group convertible into an ion exchange group by hydrolysis or the like (ion exchange group precursor), and being melt-processable (hereinbelow, referred to as the "fluorine-containing polymer (a)" in some cases) is used to prepare a precursor of the membrane body 1*a*, the membrane body 1*a* can be obtained by converting the ion exchange group precursor into an ion exchange group.

The fluorine-containing polymer (a) can be produced, for example, by copolymerizing at least one monomer selected from the following first group and at least one monomer selected from the following second group and/or the following third group. The fluorine-containing polymer (a) can be also produced by homopolymerization of one monomer selected from any of the following first group, the following second group, and the following third group.

Examples of the monomers of the first group include vinyl fluoride compounds. Examples of the vinyl fluoride compounds include vinyl fluoride, tetrafluoroethylene, hexafluoropropylene, vinylidene fluoride, trifluoroethylene, chlorotrifluoroethylene, and perfluoro alkyl vinyl ethers. Particularly when the ion exchange membrane is used as a membrane for alkali electrolysis, the vinyl fluoride compound is preferably a perfluoro monomer, and a perfluoro monomer selected from the group consisting of tetrafluoroethylene, hexafluoropropylene, and perfluoro alkyl vinyl ethers is preferable.

Examples of the monomers of the second group include vinyl compounds having a functional group convertible into a carboxylic acid-type ion exchange group (carboxylic acid group). Examples of the vinyl compounds having a functional group convertible into a carboxylic acid group include monomers represented by $CF_2{=}CF(OCF_2CYF)_s{-}O(CZF)_t{-}COOR$, wherein s represents an integer of 0 to 2, t represents an integer of 1 to 12, Y and Z each independently represent F or $CF_3$, and R represents a lower alkyl group (a lower alkyl group is an alkyl group having 1 to 3 carbon atoms, for example).

Among these, compounds represented by $CF_2{=}CF(OCF_2CYF)_n{-}O(CF_2)_m{-}COOR$ are preferable. Wherein n represents an integer of 0 to 2, m represents an integer of 1 to 4, Y represents F or $CF_3$, and R represents $CH_3$, $C_2H_5$, or $C_3H_7$.

When the ion exchange membrane is used as a cation exchange membrane for alkali electrolysis, a perfluoro compound is preferably at least used as the monomer, but the alkyl group (see the above R) of the ester group is lost from the polymer at the time of hydrolysis, and therefore the alkyl group (R) need not be a perfluoroalkyl group in which all hydrogen atoms are replaced by fluorine atoms.

Of the above monomers, the monomers represented below are more preferable as the monomers of the second group:

$CF_2{=}CFOCF_2{-}CF(CF_3)\ OCF_2COOCH_3$,
$CF_2{=}CFOCF_2CF(CF_3)O(CF_2)_2COOCH_3$,
$CF_2{=}CF\ [OCF_2{-}CF(CF_3)]_{20}\ (CF_2)_2COOCH_3$,
$CF_2{=}CFOCF_2CF(CF_3)O(CF_2)_3COOCH_3$,
$CF_2{=}CFO(CF_2)_2COOCH_3$, and
$CF_2{=}CFO(CF_2)_3COOCH_3$.

Examples of the monomers of the third group include vinyl compounds having a functional group convertible into a sulfone-type ion exchange group (sulfonic acid group). As the vinyl compounds having a functional group convertible into a sulfonic acid group, for example, monomers represented by $CF_2{=}CFO{-}X{-}CF_2{-}SO_2F$ are preferable, wherein X represents a perfluoroalkylene group. Specific examples of these include the monomers represented below:

$CF_2{=}CFOCF_2CF_2SO_2F$,
$CF_2{=}CFOCF_2CF(CF_3)OCF_2CF_2SO_2F$,
$CF_2{=}CFOCF_2CF(CF_3)OCF_2CF_2CF_2SO_2F$,
$CF_2{=}CF(CF_2)_2SO_2F$,
$CF_2{=}CFO\ [CF_2CF(CF_3)O]_2CF_2CF_2SO_2F$, and
$CF_2{=}CFOCF_2CF(CF_2OCF_3)OCF_2CF_2SO_2F$.

Among these, $CF_2{=}CFOCF_2CF(CF_3)OCF_2CF_2CF_2SO_2F$ and $CF_2{=}CFOCF_2CF(CF_3)OCF_2CF_2SO_2F$ are more preferable.

The copolymer obtained from these monomers can be produced by a polymerization method developed for homopolymerization and copolymerization of ethylene fluoride, particularly a general polymerization method used for tetrafluoroethylene. For example, in a non-aqueous method, a polymerization reaction can be performed in the presence of a radical polymerization initiator such as a perfluorocarbon peroxide or an azo compound under the conditions of a temperature of 0 to 200° C. and a pressure of 0.1 to 20 MPa using an inert solvent such as a perfluorohydrocarbon or a chlorofluorocarbon.

In the above copolymerization, the type of combination of the above monomers and their proportion are not particularly limited and are selected and determined depending on the type and amount of the functional group desired to be imparted to the fluorine-containing polymer to be obtained. For example, when a fluorine-containing polymer containing only a carboxylic acid group is formed, at least one monomer should be selected from each of the first group and the second group described above and copolymerized. In addition, when a fluorine-containing polymer containing only a sulfonic acid group is formed, at least one monomer should be selected from each of the first group and the third group and copolymerized. Further, when a fluorine-containing polymer having a carboxylic acid group and a sulfonic acid group is formed, at least one monomer should be selected from each of the first group, the second group, and the third group described above and copolymerized. In this case, the target fluorine-containing polymer can be obtained also by separately preparing a copolymer comprising the monomers of the first group and the second group described above and a copolymer comprising the monomers of the first group and the third group described above, and then mixing the copolymers. The mixing proportion of the monomers is not particularly limited, and when the amount of the functional groups per unit polymer is increased, the proportion of the monomers selected from the second group and the third group described above should be increased.

The total ion exchange capacity of the fluorine-containing copolymer is not particularly limited, but is preferably 0.5 to 2.0 mg equivalent/g, more preferably 0.6 to 1.5 mg equivalent/g. The total ion exchange capacity herein refers to the equivalent of the exchange group per unit weight of the dry resin and can be measured by neutralization titration or the like.

In the membrane body 1*a* of the ion exchange membrane 1, a sulfonic acid layer 3 containing a fluorine-containing polymer having a sulfonic acid group and a carboxylic acid layer 2 containing a fluorine-containing polymer having a carboxylic acid group are laminated. By providing the membrane body 1*a* having such a layer configuration, selective permeability for cations such as sodium ions can be further improved.

The ion exchange membrane 1 is arranged in an electrolyzer such that, usually, the sulfonic acid layer 3 is located on the anode side of the electrolyzer and the carboxylic acid layer 2 is located on the cathode side of the electrolyzer.

The sulfonic acid layer 3 is preferably constituted by a material having low electrical resistance and has a membrane thickness larger than that of the carboxylic acid layer 2 from the viewpoint of membrane strength. The membrane thickness of the sulfonic acid layer 3 is preferably 2 to 25 times, more preferably 3 to 15 times that of the carboxylic acid layer 2.

The carboxylic acid layer 2 preferably has high anion exclusion properties even if it has a small membrane thickness. The anion exclusion properties here refer to the property of trying to hinder intrusion and permeation of anions into and through the ion exchange membrane 1. In order to raise the anion exclusion properties, it is effective to dispose a carboxylic acid layer having a small ion exchange capacity to the sulfonic acid layer.

As the fluorine-containing polymer for use in the sulfonic acid layer 3, preferable is a polymer obtained by using $CF_2{=}CFOCF_2CF(CF_3)OCF_2CF_2SO_2F$ as the monomer of the third group.

As the fluorine-containing polymer for use in the carboxylic acid layer 2, preferable is a polymer obtained by using $CF_2{=}CFOCF_2CF(CF_2)O(CF_2)_2COOCH_3$ as the monomer of the second group.

(Coating Layer)

The ion exchange membrane preferably has a coating layer on at least one surface of the membrane body. As shown in FIG. 8, in the ion exchange membrane 1, coating layers 11*a* and 11*b* are formed on both the surfaces of the membrane body 1*a*.

The coating layers contain inorganic material particles and a binder.

The average particle size of the inorganic material particles is preferably 0.90 μm or more. When the average particle size of the inorganic material particles is 0.90 μm or more, durability to impurities is extremely improved, in addition to attachment of gas. That is, enlarging the average particle size of the inorganic material particles as well as satisfying the value of the specific surface area mentioned above can achieve a particularly marked effect. Irregular inorganic material particles are preferable because the average particle size and specific surface area as above are satisfied. Inorganic material particles obtained by melting and inorganic material particles obtained by grinding raw ore can be used. Inorganic material particles obtained by grinding raw ore can preferably be used.

The average particle size of the inorganic material particles can be 2 μm or less. When the average particle size of the inorganic material particles is 2 μm or less, it is possible to prevent damage of the membrane due to the inorganic material particles. The average particle size of the inorganic material particle is more preferably 0.90 to 1.2 μm.

Here, the average particle size can be measured by a particle size analyzer ("SALD2200", SHIMADZU CORPORATION).

The inorganic material particles preferably have irregular shapes. Such shapes improve resistance to impurities further. The inorganic material particles preferably have a broad particle size distribution.

The inorganic material particles preferably contain at least one inorganic material selected from the group consisting of oxides of Group IV elements in the Periodic Table, nitrides of Group IV elements in the Periodic Table, and carbides of Group IV elements in the Periodic Table. From the viewpoint of durability, zirconium oxide particle is more preferable.

The inorganic material particles are preferably inorganic material particles produced by grinding the raw ore of the inorganic material particles or inorganic material particles, as spherical particles having a uniform diameter, obtained by melt-purifying the raw ore of the inorganic material particles.

Examples of means for grinding raw ore include, but are not particularly limited to, ball mills, bead mills, colloid mills, conical mills, disc mills, edge mills, grain mills, hammer mills, pellet mills, VSI mills, Wiley mills, roller mills, and jet mills. After grinding, the particles are preferably washed. As the washing method, the particles are preferably treated with acid. This treatment can reduce impurities such as iron attached to the surface of the inorganic material particles.

The coating layer preferably contains a binder. The binder is a component that forms the coating layers by retaining the inorganic material particles on the surface of the ion exchange membrane. The binder preferably contains a fluorine-containing polymer from the viewpoint of durability to the electrolyte solution and products from electrolysis.

As the binder, a fluorine-containing polymer having a carboxylic acid group or sulfonic acid group is more preferable, from the viewpoint of durability to the electrolyte solution and products from electrolysis and adhesion to the surface of the ion exchange membrane. When a coating layer is provided on a layer containing a fluorine-containing polymer having a sulfonic acid group (sulfonic acid layer), a fluorine-containing polymer having a sulfonic acid group is further preferably used as the binder of the coating layer. Alternatively, when a coating layer is provided on a layer containing a fluorine-containing polymer having a carboxylic acid group (carboxylic acid layer), a fluorine-containing polymer having a carboxylic acid group is further preferably used as the binder of the coating layer.

In the coating layer, the content of the inorganic material particles is preferably 40 to 90% by mass, more preferably 50 to 90% by mass. The content of the binder is preferably 10 to 60% by mass, more preferably 10 to 50% by mass.

The distribution density of the coating layer in the ion exchange membrane is preferably 0.05 to 2 mg per 1 $cm^2$. When the ion exchange membrane has asperities on the surface thereof, the distribution density of the coating layer is preferably 0.5 to 2 mg per 1 $cm^2$.

As the method for forming the coating layer, which is not particularly limited, a known method can be used. An example is a method including applying by a spray or the like a coating liquid obtained by dispersing inorganic material particles in a solution containing a binder.

(Reinforcement Core Materials)

The ion exchange membrane preferably has reinforcement core materials arranged inside the membrane body.

The reinforcement core materials are members that enhance the strength and dimensional stability of the ion exchange membrane. By arranging the reinforcement core materials inside the membrane body, particularly expansion and contraction of the ion exchange membrane can be controlled in the desired range. Such an ion exchange membrane does not expand or contract more than necessary during electrolysis and the like and can maintain excellent dimensional stability for a long term.

The configuration of the reinforcement core materials is not particularly limited, and, for example, the reinforcement core materials may be formed by spinning yarns referred to as reinforcement yarns. The reinforcement yarns here refer to yarns that are members constituting the reinforcement core materials, can provide the desired dimensional stability and mechanical strength to the ion exchange membrane, and can be stably present in the ion exchange membrane. By using the reinforcement core materials obtained by spinning such reinforcement yarns, better dimensional stability and mechanical strength can be provided to the ion exchange membrane.

The material of the reinforcement core materials and the reinforcement yarns used for these is not particularly limited but is preferably a material resistant to acids, alkalis, etc., and a fiber comprising a fluorine-containing polymer is preferable because long-term heat resistance and chemical resistance are required.

Examples of the fluorine-containing polymer to be used in the reinforcement core materials include polytetrafluoroethylene (PTFE), tetrafluoroethylene-perfluoroalkyl vinyl ether copolymers (PFA), tetrafluoroethylene-ethylene copolymers (ETFE), tetrafluoroethylene-hexafluoropropylene copolymers, trifluorochloroethylene-ethylene copolymers, and vinylidene fluoride polymers (PVDF). Among these, fibers comprising polytetrafluoroethylene are preferably used from the viewpoint of heat resistance and chemical resistance.

The yarn diameter of the reinforcement yarns used for the reinforcement core materials is not particularly limited, but is preferably 20 to 300 deniers, more preferably 50 to 250 deniers. The weave density (fabric count per unit length) is preferably 5 to 50/inch. The form of the reinforcement core materials is not particularly limited, for example, a woven fabric, a nonwoven fabric, and a knitted fabric are used, but is preferably in the form of a woven fabric. The thickness of the woven fabric to be used is preferably 30 to 250 μm, more preferably 30 to 150 μm.

As the woven fabric or knitted fabric, monofilaments, multifilaments, or yarns thereof, a slit yarn, or the like can be used, and various types of weaving methods such as a plain weave, a leno weave, a knit weave, a cord weave, and a seersucker can be used.

The weave and arrangement of the reinforcement core materials in the membrane body are not particularly limited, and preferred arrangement can be appropriately provided considering the size and form of the ion exchange membrane, physical properties desired for the ion exchange membrane, the use environment, and the like.

For example, the reinforcement core materials may be arranged along one predetermined direction of the membrane body, but from the viewpoint of dimensional stability, it is preferred that the reinforcement core materials be arranged along a predetermined first direction, and other reinforcement core materials be arranged along a second direction substantially perpendicular to the first direction. By arranging the plurality of reinforcement core materials substantially orthogonally to the longitudinal direction inside the membrane body, it is possible to impart better dimensional stability and mechanical strength in many directions. For example, arrangement in which the reinforcement core materials arranged along the longitudinal direction (warp yarns) and the reinforcement core materials arranged along the transverse direction (weft yarns) are woven on the surface side of the membrane body is preferred. The arrangement is more preferably in the form of plain weave driven and woven by allowing warps and wefts to run over and under each other alternately, leno weave in which two warps are woven into wefts while twisted, basket weave driven and woven by inserting, into two or more parallelly-arranged warps, wefts of the same number, or the like, from the viewpoint of dimension stability, mechanical strength and easy-production.

It is preferred that particularly, the reinforcement core materials be arranged along both directions, the MD (Machine Direction) and TD (Transverse Direction) of the ion exchange membrane. In other words, the reinforcement core materials are preferably plain-woven in the MD and TD. Here, the MD refers to the direction in which the membrane body and various core materials (for example, the reinforcement core materials, reinforcement yarns, and sacrifice yarns described later) are conveyed in an ion exchange membrane production step described later (flow direction), and the TD refers to the direction substantially perpendicular to the MD. Yarns woven along the MD are referred to as MD yarns, and yarns woven along the TD are referred to as TD yarns. Usually, the ion exchange membrane used for electrolysis is rectangular, and in many cases, the longitudinal direction is the MD, and the width direction is the TD. By weaving the reinforcement core materials that are MD yarns and the reinforcement core materials that are TD yarns, it is possible to impart better dimensional stability and mechanical strength in many directions.

The arrangement interval of the reinforcement core materials is not particularly limited, and preferred arrangement can be appropriately provided considering physical properties desired for the ion exchange membrane, the use environment, and the like.

The aperture ratio for the reinforcement core materials is not particularly limited, but is preferably 30% or more, more preferably 50% or more and 90% or less. The aperture ratio is preferably 30% or more from the viewpoint of the electrochemical properties of the ion exchange membrane, and preferably 90% or less from the viewpoint of the mechanical strength of the ion exchange membrane.

The aperture ratio for the reinforcement core materials herein refers to a ratio of a total area of a surface through which substances such as ions (an electrolyte solution and cations contained therein (e.g., sodium ions)) can pass (B) to the area of either one surface of the membrane body (A) (B/A). The total area of the surface through which substances such as ions can pass (B) can refer to the total areas of regions in which in the ion exchange membrane, cations, an electrolytic solution, and the like are not blocked by the reinforcement core materials and the like contained in the ion exchange membrane.

FIG. 9 illustrates a schematic view for explaining the aperture ratio of reinforcement core materials constituting the ion exchange membrane. FIG. 9, in which a portion of the ion exchange membrane is enlarged, shows only the arrangement of the reinforcement core materials 21*a* and 21*b* in the regions, omitting illustration of the other members.

By subtracting the total area of the reinforcement core materials (C) from the area of the region surrounded by the reinforcement core materials 21*a* arranged along the longitudinal direction and the reinforcement core materials 21*b* arranged along the transverse direction, the region including the area of the reinforcement core materials (A), the total area of regions through which substances such as ions can pass (B) in the area of the above-described region (A) can be obtained. That is, the aperture ratio can be determined by the following formula (I):

$$\text{Aperture ratio}=(B)/(A)=((A)-(C))/(A) \quad \text{(I)}$$

Among the reinforcement core materials, a particularly preferred form is tape yarns or highly oriented monofilaments comprising PTFE from the viewpoint of chemical resistance and heat resistance. Specifically, reinforcement core materials forming a plain weave in which 50 to 300 denier tape yarns obtained by slitting a high strength porous sheet comprising PTFE into a tape form, or 50 to 300 denier highly oriented monofilaments comprising PTFE are used and which has a weave density of 10 to 50 yarns or monofilaments/inch and has a thickness in the range of 50 to 100 μm are more preferred. The aperture ratio of an ion exchange membrane comprising such reinforcement core materials is further preferably 60% or more.

Examples of the shape of the reinforcement yarns include round yarns and tape yarns.

(Continuous Holes)

The ion exchange membrane preferably has continuous holes inside the membrane body.

The continuous holes refer to holes that can be flow paths for ions generated in electrolysis and an electrolyte solution. The continuous holes, which are tubular holes formed inside the membrane body, are formed by dissolution of sacrifice core materials (or sacrifice yarns) described below. The shape, diameter, or the like of the continuous holes can be controlled by selecting the shape or diameter of the sacrifice core materials (sacrifice yarns).

Forming the continuous holes inside the ion exchange membrane can ensure the mobility of an electrolyte solution on electrolysis. The shape of the continuous holes is not particularly limited, but may be the shape of sacrifice core materials to be used for formation of the continuous holes in accordance with the production method described below.

The continuous holes are preferably formed so as to alternately pass on the anode side (sulfonic acid layer side) and the cathode side (carboxylic acid layer side) of the reinforcement core materials. With such a structure, in a portion in which continuous holes are formed on the cathode side of the reinforcement core materials, ions (e.g., sodium ions) transported through the electrolyte solution with which the continuous holes are filled can flow also on the cathode side of the reinforcement core materials. As a result, the flow of cations is not interrupted, and thus, it is possible to further reduce the electrical resistance of the ion exchange membrane.

The continuous holes may be formed along only one predetermined direction of the membrane body constituting the ion exchange membrane, but are preferably formed in both the longitudinal direction and the transverse direction of the membrane body from the viewpoint of exhibiting more stable electrolytic performance.

[Method for Producing]

A suitable example of a method for producing an ion exchange membrane includes a method including the following steps (1) to (6):

Step (1): the step of producing a fluorine-containing polymer having an ion exchange group or an ion exchange group precursor capable of forming an ion exchange group by hydrolysis, Step (2): the step of weaving at least a plurality of reinforcement core materials, as required, and sacrifice yarns having a property of dissolving in an acid or an alkali, and forming continuous holes, to obtain a reinforcing material in which the sacrifice yarns are arranged between the reinforcement core materials adjacent to each other, Step (3): the step of forming into a film the above fluorine-containing polymer having an ion exchange group or an ion exchange group precursor capable of forming an ion exchange group by hydrolysis, Step (4): the step of embedding the above reinforcing materials, as required, in the above film to obtain a membrane body inside which the reinforcing materials are arranged, Step (5): the step of hydrolyzing the membrane body obtained in the step (4) (hydrolysis step), and Step (6): the step of providing a coating layer on the membrane body obtained in the step (5) (application step).

Hereinafter, each of the steps will be described in detail.

Step (1): Step of Producing Fluorine-Containing Polymer

In the step (1), raw material monomers described in the first group to the third group above are used to produce a fluorine-containing polymer. In order to control the ion exchange capacity of the fluorine-containing polymer, the mixture ratio of the raw material monomers should be adjusted in the production of the fluorine-containing polymer forming the layers.

Step (2): Step of Producing Reinforcing Materials

The reinforcing material is a woven fabric obtained by weaving reinforcement yarns or the like. The reinforcing material is embedded in the membrane to thereby form reinforcement core materials. When an ion exchange membrane having continuous holes is formed, sacrifice yarns are additionally woven into the reinforcing material. The amount of the sacrifice yarns contained in this case is preferably 10 to 80% by mass, more preferably 30 to 70% by mass based on the entire reinforcing material. Weaving the sacrifice yarns can also prevent yarn slippage of the reinforcement core materials.

As the sacrifice yarns, which have solubility in the membrane production step or under an electrolysis environment, rayon, polyethylene terephthalate (PET), cellulose, polyamide, and the like are used. Monofilaments or multifilaments having a thickness of 20 to 50 deniers and comprising polyvinyl alcohol and the like are also preferred.

In the step (2), the aperture ratio, arrangement of the continuous holes, and the like can be controlled by adjusting the arrangement of the reinforcement core materials and the sacrifice yarns.

Step (3): Step of Film Formation

In the step (3), the fluorine-containing polymer obtained in the step (1) is formed into a film by using an extruder. The film may be a single-layer configuration, a two-layer configuration of a sulfonic acid layer and a carboxylic acid layer as mentioned above, or a multilayer configuration of three layers or more.

Examples of the film forming method include the following:

a method in which a fluorine-containing polymer having a carboxylic acid group and a fluorine-containing polymer having a sulfonic acid group are separately formed into films; and a method in which fluorine-containing polymer having a carboxylic acid group and a fluorine-containing polymer having a sulfonic acid group are coextruded into a composite film.

The number of each film may be more than one. Coextrusion of different films is preferred because of its contribution to an increase in the adhesive strength in the interface.

Step (4): Step of Obtaining Membrane Body

In the step (4), the reinforcing material obtained in the step (2) is embedded in the film obtained in the step (3) to provide a membrane body including the reinforcing material therein.

Preferable examples of the method for forming a membrane body include (i) a method in which a fluorine-containing polymer having a carboxylic acid group precursor (e.g., carboxylate functional group) (hereinafter, a layer comprising the same is referred to as the first layer) located on the cathode side and a fluorine-containing polymer having a sulfonic acid group precursor (e.g., sulfonyl fluoride functional group) (hereinafter, a layer comprising the same is referred to as the second layer) are formed into a film by a coextrusion method, and, by using a heat source and a vacuum source as required, a reinforcing material and the second layer/first layer composite film are laminated in this order on breathable heat-resistant release paper on a flat plate or drum having many pores on the surface thereof and integrated at a temperature at which each polymer melts while air among each of the layers was evacuated by reduced pressure; and (ii) a method in which, in addition to the second layer/first layer composite film, a fluorine-containing polymer having a sulfonic acid group precursor is singly formed into a film (the third layer) in advance, and, by using a heat source and a vacuum source as required, the third layer film, the reinforcement core materials, and the composite film comprising the second layer/first layer are laminated in this order on breathable heat-resistant release paper on a flat plate or drum having many pores on the surface thereof and integrated at a temperature at which each polymer melts while air among each of the layers was evacuated by reduced pressure.

Coextrusion of the first layer and the second layer herein contributes to an increase in the adhesive strength at the interface.

The method including integration under a reduced pressure is characterized by making the third layer on the reinforcing material thicker than that of a pressure-application press method. Further, since the reinforcing material is fixed on the inner surface of the membrane body, the method has a property of sufficiently retaining the mechanical strength of the ion exchange membrane.

The variations of lamination described here are exemplary, and coextrusion can be performed after a preferred lamination pattern (for example, the combination of layers) is appropriately selected considering the desired layer configuration of the membrane body and physical properties, and the like.

For the purpose of further improving the electric properties of the ion exchange membrane, it is also possible to additionally interpose a fourth layer comprising a fluorine-containing polymer having both a carboxylic acid group precursor and a sulfonic acid group precursor between the first layer and the second layer or to use a fourth layer comprising a fluorine-containing polymer having both a carboxylic acid group precursor and a sulfonic acid group precursor instead of the second layer.

The method for forming the fourth layer may be a method in which a fluorine-containing polymer having a carboxylic acid group precursor and a fluorine-containing polymer having a sulfonic acid group precursor are separately produced and then mixed or may be a method in which a monomer having a carboxylic acid group precursor and a monomer having a sulfonic acid group precursor are copolymerized.

When the fourth layer is used as a component of the ion exchange membrane, a coextruded film of the first layer and the fourth layer is formed, in addition to this, the third layer and the second layer are separately formed into films, and lamination may be performed by the method mentioned above. Alternatively, the three layers of the first layer/fourth layer/second layer may be simultaneously formed into a film by coextrusion.

In this case, the direction in which the extruded film flows is the MD. As mentioned above, it is possible to form a membrane body containing a fluorine-containing polymer having an ion exchange group on a reinforcing material.

Additionally, the ion exchange membrane preferably has protruded portions composed of the fluorine-containing polymer having a sulfonic acid group, that is, projections, on the surface side composed of the sulfonic acid layer. As a method for forming such projections, which is not particularly limited, a known method also can be employed including forming projections on a resin surface. A specific example of the method is a method of embossing the surface of the membrane body. For example, the above projections can be formed by using release paper embossed in advance when the composite film mentioned above, reinforcing material, and the like are integrated. In the case where projections are formed by embossing, the height and arrangement density of the projections can be controlled by controlling the emboss shape to be transferred (shape of the release paper).

(5) Hydrolysis Step

In the step (5), a step of hydrolyzing the membrane body obtained in the step (4) to convert the ion exchange group precursor into an ion exchange group (hydrolysis step) is performed.

In the step (5), it is also possible to form dissolution holes in the membrane body by dissolving and removing the sacrifice yarns included in the membrane body with acid or alkali. The sacrifice yarns may remain in the continuous holes without being completely dissolved and removed. The sacrifice yarns remaining in the continuous holes may be dissolved and removed by the electrolyte solution when the ion exchange membrane is subjected to electrolysis.

The sacrifice yarn has solubility in acid or alkali in the step of producing an ion exchange membrane or under an electrolysis environment. The sacrifice yarns are eluted out to thereby form continuous holes at corresponding sites.

The step (5) can be performed by immersing the membrane body obtained in the step (4) in a hydrolysis solution containing acid or alkali. An example of the hydrolysis solution that can be used is a mixed solution containing KOH and dimethyl sulfoxide (DMSO).

The mixed solution preferably contains KOH of 2.5 to 4.0 N and DMSO of 25 to 35% by mass.

The temperature for hydrolysis is preferably 70 to 100° C. The higher the temperature, the larger can be the apparent thickness. The temperature is more preferably 75 to 100° C.

The time for hydrolysis is preferably 10 to 120 minutes. The longer the time, the larger can be the apparent thickness. The time is more preferably 20 to 120 minutes.

The step of forming continuous holes by eluting the sacrifice yarn will be now described in more detail. FIGS. 10(*a*) and (*b*) are schematic views for explaining a method for forming the continuous holes of the ion exchange membrane.

FIGS. 10(*a*) and (*b*) show reinforcement yarns 52, sacrifice yarns 504*a*, and continuous holes 504 formed by the sacrifice yarns 504*a* only, omitting illustration of the other members such as a membrane body.

First, the reinforcement yarns 52 that are to constitute reinforcement core materials in the ion exchange membrane and the sacrifice yarns 504*a* for forming the continuous holes 504 in the ion exchange membrane are used as interwoven reinforcing materials. Then, in the step (5), the sacrifice yarns 504*a* are eluted to form the continuous holes 504.

The above method is simple because the method for interweaving the reinforcement yarns 52 and the sacrifice yarns 504*a* may be adjusted depending on the arrangement of the reinforcement core materials and continuous holes in the membrane body of the ion exchange membrane.

FIG. 10(*a*) exemplifies the plain-woven reinforcing material in which the reinforcement yarns 52 and sacrifice yarns 504*a* are interwoven along both the longitudinal direction and the lateral direction in the paper, and the arrangement of the reinforcement yarns 52 and the sacrifice yarns 504*a* in the reinforcing material may be varied as required.

(6) Application Step

In the step (6), a coating layer can be formed by preparing a coating liquid containing inorganic material particles obtained by grinding raw ore or melting raw ore and a binder, applying the coating liquid onto the surface of the ion exchange membrane obtained in the step (5), and drying the coating liquid.

A preferable binder is a binder obtained by hydrolyzing a fluorine-containing polymer having an ion exchange group precursor with an aqueous solution containing dimethyl sulfoxide (DMSO) and potassium hydroxide (KOH) and then immersing the polymer in hydrochloric acid to replace the counterion of the ion exchange group by H+ (e.g., a fluorine-containing polymer having a carboxyl group or sulfo group). Thereby, the polymer is more likely to dissolve in water or ethanol mentioned below, which is preferable.

This binder is dissolved in a mixed solution of water and ethanol. The volume ratio between water and ethanol is preferably 10:1 to 1:10, more preferably 5:1 to 1:5, further preferably 2:1 to 1:2. The inorganic material particles are dispersed with a ball mill into the dissolution liquid thus obtained to thereby provide a coating liquid. In this case, it is also possible to adjust the average particle size and the like of the particles by adjusting the time and rotation speed during the dispersion. The preferable amount of the inorganic material particles and the binder to be blended is as mentioned above.

The concentration of the inorganic material particles and the binder in the coating liquid is not particularly limited, but a thin coating liquid is preferable. This enables uniform application onto the surface of the ion exchange membrane.

Additionally, a surfactant may be added to the dispersion when the inorganic material particles are dispersed. As the surfactant, nonionic surfactants are preferable, and examples thereof include HS-210, NS-210, P-210, and E-212 manufactured by NOF CORPORATION.

The coating liquid obtained is applied onto the surface of the ion exchange membrane by spray application or roll coating to thereby provide an ion exchange membrane.

[Microporous Membrane]

The microporous membrane of the embodiments is not particularly limited as long as the membrane can be formed into a laminate with the electrode for electrolysis, as mentioned above. Various microporous membranes may be employed.

The porosity of the microporous membrane of the embodiments is not particularly limited, but can be 20 to 90, for example, and is preferably 30 to 85. The above porosity can be calculated by the following formula:

Porosity=(1−(the weight of the membrane in a dried state)/(the weight calculated from the volume calculated from the thickness, width, and length of the membrane and the density of the membrane material))×100

The average pore size of the microporous membrane of the embodiments is not particularly limited, and can be 0.01 μm to 10 μm, for example, preferably 0.05 μm to 5 μm. With respect to the average pore size, for example, the membrane is cut vertically to the thickness direction, and the section is observed with an FE-SEM. The average pore size can be obtained by measuring the diameter of about 100 pores observed and averaging the measurements.

The thickness of the microporous membrane of the embodiments is not particularly limited, and can be 10 μm to 1000 μm, for example, preferably 50 μm to 600 μm. The above thickness can be measured by using a micrometer (manufactured by Mitutoyo Corporation) or the like, for example.

Specific examples of the microporous membrane as mentioned above include Zirfon Perl UTP 500 manufactured by Agfa (also referred to as a Zirfon membrane in the embodiment) and those described in International Publication No. WO 2013-183584 and International Publication No. WO 2016-203701.

In the embodiment, the membrane preferably comprises a first ion exchange resin layer and a second ion exchange resin layer having an EW (ion exchange capacity) different from that of the first ion exchange resin layer. Additionally, the membrane preferably comprises a first ion exchange resin layer and a second ion exchange resin layer having a functional group different from that of the first ion exchange resin layer. The ion exchange capacity can be adjusted by the functional group to be introduced, and functional groups that may be introduced are as mentioned above.

(Water Electrolysis)

The electrolyzer of the present embodiment, as an electrolyzer in the case of electrolyzing water, has a configuration in which the ion exchange membrane in an electrolyzer for use in the case of electrolyzing common salt mentioned above is replaced by a microporous membrane. The raw material to be supplied, which is water, is different from that for the electrolyzer in the case of electrolyzing common salt mentioned above. As for the other components, components similar to that of the electrolyzer in the case of electrolyzing common salt can be employed also in the electrolyzer in the case of electrolyzing water. Since chlorine gas is generated in the anode chamber in the case of common salt electrolysis, titanium is used as the material of the anode chamber, but in the case of water electrolysis, only oxygen gas is generated in the anode chamber. Thus, a material identical to that of the cathode chamber can be used. An example thereof is nickel. For anode coating, catalyst coating for oxygen generation is suitable. Examples of the catalyst coating include metals, oxides, and hydroxides of the platinum group metals and transition metal group metals. For example, elements such as platinum, iridium, palladium, ruthenium, nickel, cobalt, and iron can be used.

[Method for Producing Electrolyzer]

A method for producing an electrolyzer of the present embodiment is a method for producing a new electrolyzer from an existing electrolyzer comprising an anode (hereinbelow, also referred to as the "existing anode"), a cathode that is opposed to the anode (hereinbelow, also referred to as the "existing cathode"), a membrane that is arranged between the anode and the cathode (hereinbelow, also referred to as the "existing membrane"), and a first elastic body that presses the cathode in the direction toward the anode (hereinbelow, also referred to as the "existing elastic body"), the method comprising a step (A) of arranging a first electrode for electrolysis between the membrane and the cathode and arranging a second elastic body between the first electrode for electrolysis and the cathode in the existing electrolyzer, wherein the second elastic body presses the first electrode for electrolysis in the direction toward the anode.

As described above, according to the method for producing an electrolyzer according to the present embodiment, the characteristics of the cathode not only can be renewed without removal of the cathode (i.e., the existing cathode in the existing electrolyzer), but a member for maintaining the zero-gap structure also can be renewed without further removal of the first elastic body (i.e., the existing elastic body in the existing electrolyzer). Accordingly, it is possible to improve the work efficiency during renewing members in an electrolyzer without complicated works such as removal and conveyance of an electrolytic cell, removal of the old electrode, removal of the old elastic body, placement and fixing of a new elastic body, placement and fixing of a new electrode, and conveyance and placement thereof into the electrolyzer.

In the present embodiment, the existing electrolyzer comprises an anode, a cathode that is opposed to the anode, a membrane that is arranged between the anode and the cathode, and a first elastic body that presses the cathode in the direction toward the anode as constituent member, in other words, comprises an electrolytic cell. The existing electrolyzer is not particularly limited as long as comprising the constituent members described above, and various known configurations may be applied. The anode in the existing electrolyzer, when in contact with a second electrode for electrolysis mentioned below, substantially serves as a feed conductor. When not in contact with the second electrode for electrolysis, the anode per se serves as an anode. Similarly, the cathode in the existing electrolyzer, when in contact with the first electrode for electrolysis, substantially serves as a feed conductor. When not in contact with the first electrode for electrolysis, the cathode per se serves as a cathode. Here, in the present embodiment and a second embodiment mentioned below, the feed conductor means a degraded electrode (i.e., the existing electrode), an electrode having no catalyst coating, and the like.

In the present embodiment, a new electrolyzer further comprises a second elastic body and a first electrode for electrolysis in addition to the members that have already served as the anode or cathode in the existing electrolyzer. From the viewpoint of the entire renewing, such a new electrolyzer further comprises a laminate including a second elastic body, a first electrode for electrolysis, and a membrane, more preferably further comprises a laminate including a second elastic body, a first electrode for electrolysis, a new membrane, and a second electrode for electrolysis. In other words, the first electrode for electrolysis to be arranged on production of a new electrolyzer serves as a cathode, the second electrode for electrolysis serves as an anode, and these are separate from the cathode and anode in the existing electrolyzer. In the present embodiment, even when the electrolytic characteristics of the electrode for electrolysis that serves as an anode and/or cathode have deteriorated in association with operation of the existing electrolyzer, replacement of the degraded electrode for electrolysis by a new electrode for electrolysis separate therefrom enables the characteristics of the anode and/or cathode to be renewed. Further, when the laminate mentioned above is used, the existing membrane is replaced by a new membrane, and thus the characteristics of the membrane having characteristics that have deteriorated in association with operation can be renewed simultaneously. In the present embodiment and the second embodiment mentioned below, "renewing" means renewing the characteristics of each part in an electrolyzer, more specifically means making the characteristics comparable to or higher than the initial characteristics possessed by the existing electrolyzer before being operated.

In the present embodiment, the existing electrolyzer is assumed to be an "electrolyzer that has been already operated", and the new electrolyzer is assumed to be an "electrolyzer that has not been yet operated". That is, an electrolyzer produced as a new electrolyzer is once operated, the electrolyzer becomes "the existing electrolyzer in the present embodiment". Arrangement of a new laminate in this existing electrolyzer provides "a new electrolyzer in the present embodiment".

In the present embodiment, the membrane in the existing electrolyzer and a new membrane can be equivalent in terms of the shape, material, and physical properties. Accordingly, herein, "the membrane in the present embodiment" includes "the new membrane in the present embodiment".

(Step (A))

One example for performing the step (A) in the present embodiment will be described by use of FIG. 11. As shown in FIG. 11(A), in an existing electrolyzer, a cation exchange membrane 51 is sandwiched between the side of the cathode 21 of one electrolytic cell 50 and the side of the anode 11 of the other electrolytic cell 50. Here, the sandwiching is released by operation of the press device in the existing electrolyzer or the like, for example, to enable a gap S to be formed between the cathode 21 and the cation exchange membrane 51 to be formed, as shown in FIG. 11(B). Then, a second elastic body 22' and a first electrode for electrolysis 53 are arranged in this gap S, and these are sandwiched by operating the press device again or the like to thereby achieve the state shown in FIG. 11(C). In other words, in the state shown in FIG. 11(C), the first electrode for electrolysis 53 is arranged between the cation exchange membrane 51 and the cathode 21, and the second elastic body 22' is arranged between the first electrode for electrolysis 53 and the cathode 21. In the state shown in FIG. 11(C), the first electrode for electrolysis 53 serves as a cathode electrode, and the first electrode for electrolysis 53, the second elastic body 22', and the cathode 21, and the first elastic body 22 not shown (see FIG. 3) are electrically connected.

The order to dispose the first electrode for electrolysis 53 and the second elastic body 22' is not particularly limited. Both of them may be disposed simultaneously, or either of them may be disposed first.

(Step (B))

One example for performing the step (B) in the present embodiment will be described by use of FIG. 12. As shown in FIG. 12(A), in an existing electrolyzer, a cation exchange membrane 51 is sandwiched between the side of the cathode 21 of one electrolytic cell 50 and the side of the anode 11 of the other electrolytic cell 50. Here, the sandwiching is released by operation of the press device in the existing electrolyzer or the like, for example, to enable each gap S between the cathode 21 and the cation exchange membrane 51 and between the anode 11 and the cation exchange membrane 51 to be formed as shown in FIG. 12(B). Then, a second elastic body 22' and a first electrode for electrolysis 53 are arranged in the gap S on the side of the cathode 21, a second electrode for electrolysis 53' is arranged in the gap S on the side of the anode 11, and these are sandwiched by operating the press device again or the like to thereby achieve the state shown in FIG. 12(C). In other words, in the state shown in FIG. 12(C), the first electrode for electrolysis 53 is arranged between the cation exchange membrane 51 and the cathode 21, the second elastic body 22' is arranged between the first electrode for electrolysis 53 and the cathode 21, and the second electrode for electrolysis 53' is arranged between the anode 11 and the cation exchange membrane 51. In the state shown in FIG. 12(C), the first electrode for electrolysis 53 serves as a cathode electrode, the second electrode for electrolysis 53' serves as an anode electrode, the second electrode for electrolysis 53' and the anode 11 are electrically connected, and the first electrode for electrolysis 53, the second elastic body 22', the cathode 21, and the first elastic body 22 not shown (see FIG. 3) are electrically connected.

The order to dispose the first electrode for electrolysis 53, the second elastic body 22', and the second electrode for electrolysis 53' is not particularly limited. All of them may be disposed simultaneously, or any one of them may be disposed first.

(Sub-Steps (a1) to (a2))

In the present embodiment, from the viewpoint of the entire renewing, the step (A) preferably includes a sub-step (a1) of removing the membrane, and a sub-step (a2) of arranging a laminate including a new membrane and the first electrode for electrolysis between the second elastic body and the anode after the sub-step (a1). Here, one example for performing the sub-steps (a1) to (a2) will be described by use of FIG. 13. As shown in FIG. 13(A), in the existing electrolyzer, a cation exchange membrane 51 is sandwiched between the side of the cathode 21 of one electrolytic cell 50 and the side of the anode 11 of the other electrolytic cell 50. Here, the sandwiching is released by operation of the press device in the existing electrolyzer or the like, for example, and additionally, the cation exchange membrane 51 is removed to enable a gap S between the cathode 21 and the anode 11 to be formed as shown in FIG. 13(B). Then, a second elastic body 22', a first electrode for electrolysis 53, and a cation exchange membrane 51' as a new membrane are arranged in this gap S, and these are sandwiched by operating the press device again or the like to thereby achieve the state shown in FIG. 13(C). In other words, in the state shown in FIG. 13(C), the first electrode for electrolysis 53 is arranged between the cation exchange membrane 51' and the cathode 21, and second elastic body 22' is arranged between the first electrode for electrolysis 53 and the cathode 21. In the state shown in FIG. 13(C), the first electrode for electrolysis 53 serves as a cathode electrode, and the first electrode for electrolysis 53, the second elastic body 22', and the cathode 21, and the first elastic body 22 not shown (see FIG. 3) are electrically connected.

The order to dispose the first electrode for electrolysis 53, the second elastic body 22', and the cation exchange membrane 51' is not particularly limited. All of them may be disposed simultaneously, or any one of them may be disposed first. Here, when these are disposed simultaneously, it is preferable to use a laminate including the first electrode for electrolysis 53 and the cation exchange membrane 51'. From the viewpoint of a handling property of operation according to renewing, the laminate preferably has a configuration or physical properties similar to that of the laminate described in the electrolyzer of the present embodiment.

In the sub-steps (a1) to (a2), when a laminate including the first electrode for electrolysis 53 and the cation exchange membrane 51' is used, from the viewpoint of the entire renewing, the laminate preferably further includes a second electrode for electrolysis 53'. One example for performing the above steps will be described by use of FIG. 14. As shown in FIG. 14(A), in the existing electrolyzer, a cation exchange membrane 51 is sandwiched between the side of the cathode 21 of one electrolytic cell 50 and the side of the anode 11 of the other electrolytic cell 50. Here, the sandwiching is released by operation of the press device in the existing electrolyzer, for example, and additionally, the cation exchange membrane 51 is removed to enable a gap S between the cathode 21 and the anode 11 to be formed as shown in FIG. 14(B). Then, a laminate 54 including a first electrode for electrolysis 53, a cation exchange membrane 51' as a new membrane, and a second electrode for electrolysis 53' and a second elastic body 22' are arranged in this gap S, and these are sandwiched by operating the press device again or the like to thereby achieve the state shown in FIG. 14(C). In other words, in the state shown in FIG. 14(C), the first electrode for electrolysis 53 is arranged between the cation exchange membrane 51' and the cathode 21, the second elastic body 22' is arranged between the first electrode for electrolysis 53 and the cathode 21, and the second electrode for electrolysis 53' is arranged between the anode 11 and the cation exchange membrane 51'. In the state shown in FIG. 14(C), the first electrode for electrolysis 53 serves as a cathode electrode, the second electrode for electrolysis 53' serves as an anode electrode, the second electrode for electrolysis 53' and the anode 11 are electrically connected, and the first electrode for electrolysis 53, the second elastic body 22', the cathode 21, and the first elastic body 22 not shown (see FIG. 3) are electrically connected.

The order to dispose the laminate 54 and the second elastic body 22' is not particularly limited. Both of them may be disposed simultaneously, or either of them may be disposed first.

In the present embodiment, from the viewpoint of effectively preventing the zero-gap structure from being lost due to degradation of the first elastic body, the thickness of the second elastic body is preferably larger than the thickness of the first elastic body. From the similar viewpoint, the normal surface pressure of the second elastic body is preferably larger than the normal surface pressure of the first elastic body.

Second Embodiment

Here, a second aspect according to the present embodiment (hereinbelow, also referred to as the "second embodiment") will be described in detail with reference to FIGS. 15 to 20.

[Method for Producing Electrolyzer]

A method for producing an electrolyzer according to the second embodiment (hereinbelow, unless otherwise specified, "the present embodiment" in the section of <Second embodiment> means the second embodiment.) (hereinbelow, also referred to as the "method of the present embodiment") is a method for producing a new electrolyzer from an existing electrolyzer comprising an anode, a cathode that is opposed to the anode, a membrane that is arranged between the anode and the cathode, and a support that directly supports the cathode, the method comprising a step (A) of replacing the membrane by a laminate including a new membrane and a first electrode for electrolysis and arranging an elastic body between the first electrode for electrolysis and the cathode in the existing electrolyzer, wherein the elastic body presses the first electrode for electrolysis in the direction toward the anode, the thickness of the first electrode for electrolysis is 120 μm or less, and the first electrode for electrolysis, the elastic body, the cathode, and the support are electrically connected.

As configured as described above, the method of the present embodiment achieves zero-gapping by use of the existing structure used in a narrow-gap electrolyzer, additionally enables the characteristics of the existing membrane to be renewed, and is further excellent in working efficiency.

The new electrolyzer is not particularly limited as long as the electrolyzer can be obtained in accordance with the method of the present embodiment. In other words, the electrolyzer of the present embodiment can be obtained by modification of an existing electrolyzer. Hereinbelow, the description will be made in consideration of the structure of an existing electrolyzer.

In the present embodiment, the new electrolyzer is assumed to be an electrolyzer obtained by zero-gapping an existing electrolyzer (narrow-gap electrolyzer), the electrolyzer having not been yet operated. The existing electrolyzer is assumed to be an "electrolyzer that has been already operated", having a structure as described below.

[Existing Electrolyzer]

In the present embodiment, the existing electrolyzer comprises an anode, a cathode that is opposed to the anode, a membrane that is arranged between the anode and the cathode, and a support that directly supports the cathode as constituent members, in other words, comprises an electrolytic cell including at least an anode, a cathode, a membrane, and a support. The existing electrolyzer is not particularly limited as long as comprising the constituent members described above, and various known configurations may be applied.

It is also can be said that the new electrolyzer in the present embodiment comprises a new electrolytic cell obtained by modification of the electrolytic cell in the existing electrolyzer (existing electrolytic cell). As described above, on production of a new electrolyzer in the present embodiment, a new electrolytic cell can be obtained. Thus, it can be said that the method for producing an electrolyzer according to the present embodiment corresponds to a method for producing an electrolytic cell (a method for producing a new electrolytic cell), and more specifically, it can be said that the method for producing an electrolytic cell according to the present embodiment is a method for producing a new electrolytic cell from an existing electrolytic cell comprising an anode, a cathode that is opposed to the anode, a membrane that is arranged between the anode and the cathode, and a support that directly supports the cathode, the method comprising a step (A) of replacing the membrane by a laminate including a new membrane and a first electrode for electrolysis and arranging an elastic body between the first electrode for electrolysis and the cathode in the existing electrolyzer, wherein the elastic body presses the first electrode for electrolysis in the direction toward the anode, the thickness of the first electrode for electrolysis is 120 μm or less, and the first electrode for electrolysis, the elastic body, the cathode, and the support are electrically connected.

From the viewpoint aforementioned, the description for the method for producing an electrolyzer according to the present embodiment hereinbelow can be read as the description for the method for producing an electrolytic cell.

Hereinbelow, a case of performing common salt electrolysis by using an ion exchange membrane as the membrane is taken as an example, and one embodiment of the existing electrolyzer will be described in detail. However, in the present embodiment, the existing electrolyzer and new electrolyzer are not limited to use in common salt electrolysis but are also used in water electrolysis and fuel cells, for example.

[Electrolytic Cell]

First, one example of the electrolytic cell, which can be used as a constituent unit of the electrolyzer in the present embodiment, will be described.

FIG. 15 is a cross-sectional schematic view of an electrolytic cell 50.

As shown in FIG. 15, the electrolytic cell 50 comprises a cation exchange membrane 51, an anode chamber 60 defined by the cation exchange membrane 51 and an anode frame 24, a cathode chamber 70 defined by the cation exchange membrane 51 and a cathode frame 25, an anode 11 placed in the anode chamber 60, and a cathode 21 placed in the cathode chamber 70, wherein the anode 11 is supported directly by the anode frame 24 and the anode 11 is supported directly by the cathode frame 25. That is, the anode frame 24 and the cathode frame 25 serves as the supports for the anode 11 and the cathode 21, respectively. In FIG. 15, for convenience of description, the cation exchange membrane 51, the anode frame 24, and the cathode frame 25 are shown spaced apart, but in a state where placed on the electrolyzer, these are in contact with one another. However, a gap exists between the cation exchange membrane 51 and the cathode 21 in the electrolytic cell inside the existing electrolyzer.

FIG. 16 shows an electrolyzer 4. FIG. 17 shows a step of assembling the electrolyzer 4.

As shown in FIG. 16, the electrolyzer 4 is composed of a plurality of electrolytic cells 50 connected in series. That is, the electrolyzer 4 is a bipolar electrolyzer comprising the plurality of electrolytic cells 50 arranged in series. As shown in FIGS. 16 to 17, the electrolyzer 4 is assembled by arranging the plurality of electrolytic cells 50 connected in series and coupling the cells by means of a press device 5.

The electrolyzer 4 has an anode terminal 7 and a cathode terminal 6 to be connected to a power supply. The anode 11 of the electrolytic cell 50 located at farthest end among the plurality of electrolytic cells 50 coupled in series in the electrolyzer 4 is electrically connected to the anode terminal 7. The cathode 21 of the electrolytic cell located at the end opposite to the anode terminal 7 among the plurality of electrolytic cells 2 coupled in series in the electrolyzer 4 is electrically connected to the cathode terminal 6. The electric current during electrolysis flows from the side of the anode terminal 7, through the anode and cathode of each electrolytic cell 50, toward the cathode terminal 6. At the both ends of the coupled electrolytic cells 50, an electrolytic cell having an anode chamber only (anode terminal cell) and an electrolytic cell having a cathode chamber only (cathode terminal cell) may be arranged. In this case, the anode terminal 7 is connected to the anode terminal cell arranged at the one end, and the cathode terminal 6 is connected to the cathode terminal cell arranged at the other end.

In the case of electrolyzing brine, brine is supplied to each anode chamber 60, and pure water or a low-concentration sodium hydroxide aqueous solution is supplied to each cathode chamber 70. Each liquid is supplied from an electrolyte solution supply pipe (not shown in Figure), through an electrolyte solution supply hose (not shown in Figure), to each electrolytic cell 50. The electrolyte solution and products from electrolysis are recovered from an electrolyte solution recovery pipe (not shown in Figure). During electrolysis, sodium ions in the brine migrate from the anode chamber 60 of the one electrolytic cell 50, through the cation exchange membrane 51, to the cathode chamber 70. Thus, the electric current during electrolysis flows in the direction in which the electrolytic cells 50 are coupled in series. That is, the electric current flows, through the cation exchange membrane 51, from the anode chamber 60 toward the cathode chamber 70. As the brine is electrolyzed, chlorine gas is generated on the side of the anode 11, and sodium hydroxide (solute) and hydrogen gas are generated on the side of the cathode 21.

(Anode Chamber)

The anode chamber 60 has the anode 11. The anode chamber 60 preferably has an anode-side electrolyte solution supply unit that supplies an electrolyte solution to the anode chamber 60, a baffle plate that is arranged above the anode-side electrolyte solution supply unit so as to be substantially parallel or oblique to an anode frame 24, and an anode-side gas liquid separation unit that is arranged above the baffle plate to separate gas from the electrolyte solution including the gas mixed.

(Anode)

As the anode 11, a metal electrode such as so-called DSA(R) can be used. DSA is an electrode including a titanium substrate of which surface is covered with an oxide comprising ruthenium, iridium, and titanium as components.

As the form, any of a perforated metal, nonwoven fabric, foamed metal, expanded metal, metal porous foil formed by electroforming, so-called woven mesh produced by knitting metal lines, and the like can be used.

(Anode-Side Electrolyte Solution Supply Unit)

The anode-side electrolyte solution supply unit, which supplies the electrolyte solution to the anode chamber 60, is connected to the electrolyte solution supply pipe. The anode-side electrolyte solution supply unit is preferably arranged below the anode chamber 60. As the anode-side electrolyte solution supply unit, for example, a pipe on the surface of which aperture portions are formed (dispersion pipe) and the like can be used. Such a pipe is more preferably arranged along the surface of the anode 11 and parallel to the bottom of the electrolytic cell. This pipe is connected to an electrolyte solution supply pipe (liquid supply nozzle) that supplies the electrolyte solution into the electrolytic cell 50. The electrolyte solution supplied from the liquid supply nozzle is conveyed with a pipe into the electrolytic cell 50 and supplied from the aperture portions provided on the surface of the pipe to inside the anode chamber 60. Arranging the pipe along the surface of the anode 11 and parallel to the bottom of the electrolytic cell is preferable because the electrolyte solution can be uniformly supplied to inside the anode chamber 60.

(Anode-Side Gas Liquid Separation Unit)

The anode-side gas liquid separation unit is preferably arranged above the baffle plate. The anode-side gas liquid separation unit has a function of separating produced gas such as chlorine gas from the electrolyte solution during electrolysis. Unless otherwise specified, above means the right direction in the electrolytic cell 50 in FIG. 15, and below means the left direction in the electrolytic cell 50 in FIG. 15.

During electrolysis, produced gas generated in the electrolytic cell 50 and the electrolyte solution form a mixed phase (gas-liquid mixed phase), which is then emitted out of the system. Subsequently, pressure fluctuations inside the electrolytic cell 50 cause vibration, which may result in physical damage of the ion exchange membrane. In order to prevent this event, the electrolytic cell 50 is preferably provided with an anode-side gas liquid separation unit to separate the gas from the liquid. The anode-side gas liquid separation unit is preferably provided with a defoaming plate to eliminate bubbles. When the gas-liquid mixed phase flow passes through the defoaming plate, bubbles burst to thereby enable the electrolyte solution and the gas to be separated. As a result, vibration during electrolysis can be prevented.

(Baffle Plate)

The baffle plate is preferably arranged above the anode-side electrolyte solution supply unit and arranged substantially in parallel with or obliquely to the anode frame 24. The baffle plate is a partition plate that controls the flow of the electrolyte solution in the anode chamber 60. When the baffle plate is provided, it is possible to cause the electrolyte solution (brine or the like) to circulate internally in the anode chamber 60 to thereby make the concentration uniform. In order to cause internal circulation, the baffle plate is preferably arranged so as to separate the space in proximity to the anode 11 from the space in proximity to the anode frame 24. From such a viewpoint, the baffle plate is preferably placed so as to be opposed to the surface of the anode 11 and to the surface of the anode frame 24. In the space in proximity to the anode partitioned by the baffle plate, as electrolysis proceeds, the electrolyte solution concentration (brine concentration) is lowered, and produced gas such as chlorine gas is generated. This results in a difference in the gas-liquid specific gravity between the space in proximity to anode 11 and the space in proximity to the anode frame 24 partitioned by the baffle plate. By use of the difference, it is possible to promote the internal circulation of the electrolyte solution in the anode chamber 60 to thereby make the concentration distribution of the electrolyte solution in the anode chamber 60 more uniform.

(Anode Frame)

The anode frame 24, in conjunction with the cation exchange membrane 51, defines the anode chamber 60. As the anode frame 24, one known as a separator for electrolysis can be used, and an example thereof includes a metal plate formed by welding a plate comprising titanium thereto.

Although not shown in FIG. 15, a collector may be additionally provided between the anode 11 and the anode frame 24 in the anode chamber 60. The material and configuration of such a collector may be the same as those of the collector of the cathode chamber mentioned below.

(Cathode Chamber)

The cathode chamber 70 has the cathode 21. The cathode chamber 70, similarly to the anode chamber 60, preferably has a cathode-side electrolyte solution supply unit and a cathode-side gas liquid separation unit. Among the components constituting the cathode chamber 70, components similar to those constituting the anode chamber 60 will be not described.

(Cathode)

The entire surface of the cathode 21 is preferably covered with a catalyst layer for reduction reaction. More specifically, the cathode 21 preferably has a nickel substrate and a catalyst layer that covers the nickel substrate. Examples of the components of the catalyst layer on the nickel substrate include metals such as Ru, C, Si, P, S, Al, Ti, V, Cr, Mn, Fe, Co, Ni, Cu, Zn, Y, Zr, Nb, Mo, Rh, Pd, Ag, Cd, In, Sn, Ta, W, Re, Os, Ir, Pt, Au, Hg, Pb, Bi, La, Ce, Pr, Nd, Pm, Sm, Eu, Gd, Tb, Dy, Ho, Er, Tm, Yb, and Lu, and oxides and hydroxides of the metals. Examples of the method for forming the catalyst layer include plating, alloy plating, dispersion/composite plating, CVD, PVD, pyrolysis, and spraying. These methods may be used in combination. The catalyst layer may have a plurality of layers and a plurality of elements, as required. The cathode 21 may be subjected to a reduction treatment, as required. As the substrate of the cathode 21, nickel, nickel alloys, and nickel-plated iron or stainless may be used.

As the form, any of a perforated metal, nonwoven fabric, foamed metal, expanded metal, metal porous foil formed by electroforming, so-called woven mesh produced by knitting metal lines, and the like can be used.

(Cathode Frame)

The cathode frame 25, in conjunction with the cation exchange membrane 51, defines the cathode chamber 70. As the cathode frame 25, one known as a separator for electrolysis can be used, and an example thereof includes a metal plate formed by welding a plate comprising nickel thereto.

In the present embodiment, the cathode is directly supported by the support. The phrase "directly supported" referred to herein is intended to exclude an aspect in which the support supports the cathode via an elastic body to be mentioned below, including an aspect in which the support supports the cathode via the collector. In FIG. 15, an example in which the cathode frame 25 serves as a support that directly supports the cathode 21 is shown, but the frame defining the cathode chamber may be separate from the support in the present embodiment.

(Collector)

As described above, in the cathode chamber 70, a collector not shown may be arranged between the cathode 21 and the cathode frame 25. This tends to improve current collection efficiency. The collector preferably comprises an electrically conductive metal such as nickel, iron, copper, silver, and titanium. The collector may be a mixture, alloy, or composite oxide of these metals. The collector may have any form as long as the form enables the function of the collector and may be a porous plate in the form of plate, net, or the like.

(Reverse Current Absorber)

In the electrolytic cell 50, a reverse current absorber not shown may be placed in the cathode chamber, as required. The reverse current absorber, which is arranged so as to be electrically connected to the cathode, can have a multilayer structure having a substrate and a reverse current absorbing layer formed on the substrate. The cathode 21 and the reverse current absorbing layer may be directly connected or may be indirectly connected via the collector, an elastic body mentioned below, the cathode frame, or the like.

A material having a redox potential less noble than the redox potential of the element for the catalyst layer of the cathode mentioned above may be selected as a material for the reverse current absorbing layer. Examples thereof include nickel and iron. The substrate is not particularly limited as long as having electrical conductivity, and various known materials can be applied thereto.

(Anode-Side Gasket and Cathode-Side Gasket)

The anode-side gasket 12 is preferably arranged on the surface of the anode frame 24 constituting the anode chamber 60. The cathode-side gasket 13 is preferably arranged on the surface of the cathode frame 25 constituting the cathode chamber 70. The anode frame 24 and the cathode frame 25 are integrated such that the anode-side gasket 12 and the cathode-side gasket 13 included in the electrolytic cell 50 sandwich the cation exchange membrane 51 (see FIG. 15). These gaskets can impart airtightness to connecting points during the integration described above.

The gaskets form a seal between the membrane and each of the electrodes. Specific examples of the gaskets include picture frame-like rubber sheets at the center of which an aperture portion is formed. The gaskets preferably have resistance against corrosive electrolyte solutions or produced gas and are usable for a long period. Thus, in respect of chemical resistance and hardness, vulcanized products and peroxide-crosslinked products of ethylene-propylene-diene rubber (EPDM rubber) and ethylene-propylene rubber (EPM rubber) are usually used as the gaskets. Alternatively, gaskets of which region to be in contact with liquid (liquid contact portion) is covered with a fluorine-containing resin such as polytetrafluoroethylene (PTFE) and tetrafluoroethylene-perfluoroalkyl vinyl ether copolymers (PFA) may be employed as required. These gaskets each may have an aperture portion so as not to inhibit the flow of the electrolyte solution, and the shape of the aperture portion is not particularly limited. For example, a picture frame-like gasket is attached with an adhesive or the like along the peripheral edge of each aperture portion of the anode frame 24 constituting the anode chamber 60 or the cathode frame 25 constituting the cathode chamber 70. For example, when the anode frame 24 and the cathode frame 25 are connected via the cation exchange membrane 51 (see FIG. 15), the surfaces onto each of which the anode frame 24 or the cathode frame 25 is attached should be tightened so as to sandwich the cation exchange membrane 51. This tightening can prevent the electrolyte solution, alkali metal hydroxide, chlorine gas, hydrogen gas, and the like generated from electrolysis from leaking out of the electrolytic cells 50.

In the production method of the present embodiment, an existing electrolyzer as mentioned above is used to produce a new electrolyzer according to steps described below in detail.

(Step (A))

In the step (A), the membrane is replaced by a laminate including a new membrane and a first electrode for electrolysis and an elastic body is arranged between the first electrode for electrolysis and the cathode in the existing electrolyzer.

Figure 18B:
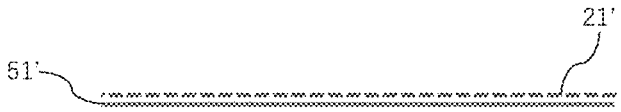

Hereinbelow, one example for performing the step (A) will be described by use of FIGS. 18 and 19. In the step (A), there can be used an elastic body 22 as shown in FIG. 18(A) and a laminate including a new membrane 51' and a first electrode for electrolysis 21' as shown in FIG. 18(B).

The first electrode for electrolysis in the present embodiment is not particularly limited as long as the thickness thereof is 120 μm or less. The elastic body is not particularly limited as long as the elastic body can press the first electrode for electrolysis in the direction toward the anode and be electrically connected to the cathode. The details of the first electrode for electrolysis and elastic body will be mentioned below.

The membrane in the existing electrolyzer and the new membrane can be equivalent in terms of the shape, material, and physical properties. Accordingly, herein, "the membrane in present embodiment" includes "the new membrane in the present embodiment". The details of the membrane in the present embodiment will be mentioned below.

In the electrolytic cell 50 in the existing electrolyzer in FIG. 15, as an example, the sandwiching of the cation exchange membrane 51 is released by operation of the press device in the existing electrolyzer or the like, for example, to enable the cation exchange membrane 51 to be removed from the electrolytic cell 50. Then, the elastic body 22 shown in FIG. 18(A) is arranged on the cathode 21 as well as the laminate shown in FIG. 18(B) is arranged on the elastic body 22 to provide a structure shown in FIG. 19.

In FIG. 19, for convenience of description, the anode 11, the new membrane 51', the first electrode for electrolysis 21', and the elastic body 22 are shown spaced apart, but in a state where placed on the electrolyzer, these are in contact with one another. In other words, in the new electrolyzer, no gap exists between the cation exchange membrane 51 and the cathode 21 in the electrolytic cell, and the first electrode for electrolysis 21', the elastic body 22, the cathode 21, and the cathode frame 25 (the support for the cathode 21) are electrically connected.

The order to dispose the laminate including the new membrane 51' and the first electrode for electrolysis 21' and the elastic body 22 is not particularly limited. Both of them may be disposed simultaneously, or either of them may be disposed first.

Figure 18C:
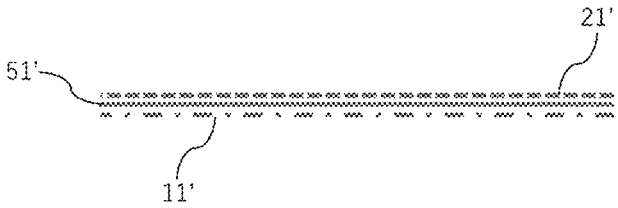

In the step (A), there also can be used the elastic body 22 as shown in FIG. 18(A), and a laminate including the new membrane 51', the first electrode for electrolysis 21', and a second electrode for electrolysis 11' as shown in FIG. 18(C). In other words, in the method for producing an electrolyzer according to the present embodiment, an aspect can be employed in which the laminate further includes a second electrode for electrolysis, the second electrode for electrolysis serves as an anode electrode, and the second electrode for electrolysis and the anode are electrically connected. Also in the method for producing an electrolytic cell according to the present embodiment, an aspect can be employed in which the laminate further includes a second electrode for electrolysis, the second electrode for electrolysis serves as an anode electrode, and the second electrode for electrolysis and the anode are electrically connected.

The second electrode for electrolysis in the present embodiment is not particularly limited as long as the electrode serves as an anode electrode and can be electrically connected to the anode. The details of the second electrode for electrolysis will be mentioned below.

When the laminate shown in FIG. 18(C) is used, the cation exchange membrane 51 can be removed from the electrolytic cell 50, similarly as mentioned above. Then, the elastic body 22 shown in FIG. 18(A) is arranged on the cathode 21 as well as the laminate shown in FIG. 18(C) is arranged on the elastic body 22 to provide a structure shown in FIG. 20.

Also in FIG. 20, for convenience of description, the anode 11, the second electrode for electrolysis 11', the new membrane 51', the first electrode for electrolysis 21', and the elastic body 22 are shown spaced apart, but in a state where placed on the electrolyzer, these are in contact with one another. In other words, in the new electrolyzer, no gap exists between the cation exchange membrane 51 and the cathode 21 in the electrolytic cell, and the first electrode for electrolysis 21', the elastic body 22, the cathode 21, and the cathode frame 25 (the support for the cathode 21) are electrically connected. Further, the second electrode for electrolysis 11' and the anode 11 are also electrically connected.

As described above, preferably, the new electrolyzer in the present embodiment comprises an anode, a cathode that is opposed to the anode, a membrane that is arranged between the anode and the cathode, a first electrode for electrolysis that is arranged between the membrane and the cathode, a second electrode for electrolysis that is arranged between the anode and the membrane, an elastic body that is arranged between the first electrode for electrolysis and the cathode and presses the first electrode for electrolysis in the direction toward the anode, and a support that directly supports the cathode, the first electrode for electrolysis serving as a cathode electrode, the second electrode for electrolysis serving as an anode electrode, the thickness of the first electrode for electrolysis being 120 μm or less, the first electrode for electrolysis, the elastic body, the cathode, and the support being electrically connected, the second electrode for electrolysis and the anode being electrically connected.

Preferably, the new electrolytic cell in the present embodiment comprises an anode, a cathode that is opposed to the anode, a membrane that is arranged between the anode and the cathode, a first electrode for electrolysis that is arranged between the membrane and the cathode, a second electrode for electrolysis that is arranged between the anode and the membrane, an elastic body that is arranged between the first electrode for electrolysis and the cathode and presses the first electrode for electrolysis in the direction toward the anode, and a support that directly supports the cathode, the first electrode for electrolysis serving as a cathode electrode, the second electrode for electrolysis serving as an anode electrode, the thickness of the first electrode for electrolysis being 120 μm or less, the first electrode for electrolysis, the elastic body, the cathode, and the support being electrically connected, the second electrode for electrolysis and the anode being electrically connected.

The order to dispose the laminate including the new membrane 51', the first electrode for electrolysis 21', and the second electrode for electrolysis 11' and the elastic body 22 is not particularly limited. Both of them may be disposed simultaneously, or either of them may be disposed first.

In the present embodiment, the new electrolyzer further comprises a laminate including an elastic body to be mentioned below, the first electrode for electrolysis, and a new membrane in addition to the membrane, the anode, the cathode, and any members mentioned above in the existing electrolyzer. From the viewpoint of the entire renewing, the new electrolyzer preferably further comprises a laminate including an elastic body, a first electrode for electrolysis, a new membrane, and a second electrode for electrolysis. In other words, the first electrode for electrolysis to be arranged on production of a new electrolyzer serves as a cathode, the second electrode for electrolysis serves as an anode, and these are separate from the cathode and anode in the existing electrolyzer.

The cathode in the existing electrolyzer is brought into contact with the first electrode for electrolysis to substantially serve as a feed conductor. Similarly, the anode in the existing electrolyzer, when in contact with a second electrode for electrolysis mentioned below, substantially serves as a feed conductor. When not in contact with the second electrode for electrolysis, the anode per se serves as an anode.

As described above, in the present embodiment, on zero-gapping based on a narrow-gap electrolyzer that has been already subjected to operation, even when the characteristics of the existing cathode and membrane in the narrow-gap electrolyzer have deteriorated in association with operation, the characteristics of the cathode and membrane can be renewed because the first electrode for electrolysis separate from the cathode is allowed to newly serve as a cathode as well as the existing membrane is replaced by a new membrane. Further, the first electrode for electrolysis, which has a thickness as very thin as 120 μm or less, can be easily integrated with a new membrane. As a result, the first electrode for electrolysis can be used as a laminate with a new membrane in the step (A). Electrolytic cells widely used have a size of about 1.5 m in length and 3 m in width, for example. Although a work for removing and inserting members having such a size during member renewing tends to be complicated, use of the laminate in the present embodiment can reduce the number of times of removing and inserting membranes and electrodes, markedly improving the work efficiency. In other words, according to the production method of the present embodiment, it is possible to produce an electrolyzer by zero-gapping a narrow-gap electrolyzer, additionally to renew the characteristics of the existing cathode and membrane, and further to provide excellent work efficiency. Additionally, when the laminate in the present embodiment further includes a second electrode for electrolysis, the characteristics of the anode having characteristics deteriorated in association with operation also can be renewed simultaneously.

(Elastic Body)

As shown in FIGS. 19 and 20, placing the elastic body 22 between the first electrode for electrolysis 21' and the cathode 21 presses the first electrode for electrolysis 21' onto the cation exchange membrane 51 to reduce the distance between the anode 11 and the cathode 21, and thus the voltage can be lowered. Lowering of the voltage enables the power consumption of the entire electrolyzer to be markedly reduced. With the elastic body 22 placed, the pressing pressure caused by the elastic body 22 enables the first electrode for electrolysis 21' to be stably maintained in place when the laminate in the present embodiment is placed in the electrolytic cell.

As the elastic body, spring members such as spiral springs and coils and cushioning mats may be used. As the elastic body, a suitable one may be appropriately employed, in consideration of a stress to press the ion exchange membrane and the like. The elastic body preferably comprises an electrically conductive metal such as nickel, iron, copper, silver, and titanium.

The thickness of the elastic body is not particularly limited. The thickness can be, for example, 0.1 mm to 15 mm and is preferably 0.2 mm to 10 mm, more preferably 0.5 mm to 7 mm.

The normal surface pressure of the elastic body is also not particularly limited. The normal surface pressure can be, for example, 30 gf/cm$^2$ to 350 gf/cm$^2$ and is preferably 40 to 300 gf/cm$^2$, more preferably 50 to 250 gf/cm$^2$.

(Laminate)

The laminate in the present embodiment includes a membrane such as an ion exchange membrane or a microporous membrane and a first electrode for electrolysis and preferably further includes a second electrode for electrolysis. Hereinbelow, unless otherwise indicated, when an "electrode for electrolysis" is simply referred to, both the first electrode for electrolysis and the second electrode for electrolysis are included. Specific examples of these and the membrane will be detailed.

[Electrode for Electrolysis]

The electrode for electrolysis in the present embodiment is preferably one that can constitute a laminate with a membrane as described above, that is, one that can be integrated with a membrane, more preferably one that is used as a wound body.

As the first electrode for electrolysis, which is not particularly limited as long as the thickness thereof is 120 μm or less, for example, among those having the material, form, physical properties, and the like mentioned above as the electrode for electrolysis in the <First embodiment> section, one that serves as a cathode may be selected and used as appropriate.

As the second electrode for electrolysis, which is not particularly limited, for example, among those having the material, form, physical properties, and the like mentioned above as the second electrode for electrolysis in the <First embodiment> section, one that serves as an anode may be selected and used as appropriate.

In other words, as for the material, form, physical properties, and the like of the electrode for electrolysis in the present embodiment, those suitable may be appropriately selected, in consideration of the step (A), the configuration of the electrolyzer, and the like in the present embodiment.

As the membrane in the present embodiment, which is not particularly limited, among those having the material, form, physical properties, and the like mentioned above as the ion exchange membrane and microporous membrane in the <First embodiment> section, one that may form a laminate with the electrode for electrolysis mentioned above may be selected and used as appropriate.

(Water Electrolysis)

The electrolyzer of the present embodiment, as an electrolyzer in the case of electrolyzing water, has a configuration in which the ion exchange membrane in an electrolyzer for use in the case of electrolyzing common salt mentioned above is replaced by a microporous membrane. The raw material to be supplied, which is water, is different from that for the electrolyzer in the case of electrolyzing common salt mentioned above. As for the other components, components similar to that of the electrolyzer in the case of electrolyzing common salt can be employed also in the electrolyzer in the case of electrolyzing water. Since chlorine gas is generated in the anode chamber in the case of common salt electrolysis, titanium is used as the material of the anode chamber, but in the case of water electrolysis, only oxygen gas is generated in the anode chamber. Thus, a material identical to that of the cathode chamber can be used. Examples thereof include nickel. For anode coating, catalyst coating for oxygen generation is suitable. Examples of the catalyst coating include metals, oxides, and hydroxides of the platinum group metals and transition metal group metals. For example, elements such as platinum, iridium, palladium, ruthenium, nickel, cobalt, and iron can be used.

The present application is based on a Japanese Patent Application filed on Feb. 26, 2020 (Japanese Patent Application No. 2020-030768) and a Japanese Patent Application filed on May 12, 2020 (Japanese Patent Application No. 2020-083726), the contents of which are hereby incorporated by reference.

REFERENCE SIGNS LIST

Reference Signs List for FIGS. 1 to 6 and FIGS. 11 to 14

4 . . . electrolyzer
5 . . . press device
6 . . . cathode terminal
7 . . . anode terminal

11 . . . anode
12 . . . anode gasket
13 . . . cathode gasket
18 . . . reverse current absorber
18*a* . . . substrate
18*b* . . . reverse current absorbing layer
19 . . . bottom of anode chamber
21 . . . cathode
22 . . . first elastic body
22' . . . second elastic body
23 . . . collector
24 . . . support
50 . . . electrolytic cell
51 . . . cation exchange membrane (membrane)
51' . . . new cation exchange membrane
53 . . . first electrode for electrolysis
53' . . . second electrode for electrolysis
54 . . . laminate
S . . . gap
60 . . . anode chamber
70 . . . cathode chamber
80 . . . partition wall
90 . . . cathode structure for electrolysis Reference Signs List for FIG. 7
10 . . . electrode substrate for electrolysis
20 . . . first layer covering substrate
30 . . . second layer
101 . . . electrode for electrolysis Reference Signs List for FIG. 8
1 . . . ion exchange membrane
1*a* . . . membrane body
2 . . . carboxylic acid layer
3 . . . sulfonic acid layer
4 . . . reinforcement core material
11*a*, 11*b* . . . coating layer Reference Signs List for FIG. 9
21*a*, 21*b* . . . reinforcement core material Reference Signs List for FIG. 10
52 . . . reinforcement yarn
504 . . . continuous hole
504*a* . . . sacrifice yarn Reference Signs List for FIGS. 15 to 20
4 . . . electrolyzer
5 . . . press device
6 . . . cathode terminal
7 . . . anode terminal
11 . . . anode
11' . . . second electrode for electrolysis
12 . . . anode gasket
13 . . . cathode gasket
21 . . . cathode
21' . . . first electrode for electrolysis
22 . . . elastic body
24 . . . anode frame (anode support)
25 . . . cathode frame (cathode support)
50 . . . electrolytic cell
51 . . . cation exchange membrane (membrane)
51' . . . new membrane (cation exchange membrane)
60 . . . anode chamber
70 . . . cathode chamber

The invention claimed is:

1. An electrolyzer comprising:
an anode,
a cathode that is opposed to the anode,
a membrane that is arranged between the anode and the cathode;
a first elastic body that presses the cathode in a direction toward the anode,
a first electrode for electrolysis that is arranged between the membrane and the cathode;
a second elastic body that is arranged between the first electrode for electrolysis and the cathode and presses the first electrode for electrolysis in the direction toward the anode,
a collector that is arranged on a first surface of the first elastic body, the first surface being an opposite side of the cathode,
a support that is arranged on a second surface of the collector, the second surface being an opposite side of the first elastic body, and
a partition wall that is arranged on a third surface of the support, the third surface being an opposite side of the collector, wherein
the first electrode for electrolysis serves as a cathode electrode, and
the first electrode for electrolysis, the second elastic body, the cathode, and the first elastic body are electrically connected.

2. The electrolyzer according to claim 1, wherein a thickness of the second elastic body is larger than a thickness of the first elastic body.

3. The electrolyzer according to claim 1, wherein a surface pressure of the second elastic body is larger than a surface pressure of the first elastic body.

4. The electrolyzer according to any one of claims 1 to 3, further comprising a second electrode for electrolysis that is arranged between the anode and the membrane, wherein
the second electrode for electrolysis serves as an anode electrode, and
the second electrode for electrolysis and the anode are electrically connected.

5. A method for producing a new electrolyzer from an existing electrolyzer comprising an anode, a cathode that is opposed to the anode, a membrane that is arranged between the anode and the cathode, and a first elastic body that presses the cathode in a direction toward the anode, the method comprising:
arranging a first electrode for electrolysis between the membrane and the cathode and arranging a second elastic body between the first electrode for electrolysis and the cathode in the existing electrolyzer, wherein
the second elastic body presses the first electrode for electrolysis in the direction toward the anode,
the first electrode for electrolysis serves as a cathode electrode,
the first electrode for electrolysis, the second elastic body, the cathode, and the first elastic body are electrically connected, and
the new electrolyzer that is produced is the electrolyzer according to claim 1.

6. The method for producing the electrolyzer according to claim 5, wherein a thickness of the second elastic body is larger than a thickness of the first elastic body.

7. The method for producing the electrolyzer according to claim 5, wherein a surface pressure of the second elastic body is larger than a surface pressure of the first elastic body.

8. The method for producing the electrolyzer according to claim 5, further comprising:
arranging a second electrode for electrolysis between the anode and the membrane, wherein
the second electrode for electrolysis serves as an anode electrode, and the second electrode for electrolysis and the anode are electrically connected.

9. The method for producing the electrolyzer according to claim 5, wherein the arranging of the first electrode for electrolysis between the membrane and the cathode and the arranging of the second elastic body between the first electrode for electrolysis and the cathode in the existing electrolyzer comprises:

removing the membrane, and arranging a laminate between the second elastic body and the anode after the removal of the membrane, the laminate comprising a new membrane and the first electrode for electrolysis.

10. The method for producing the electrolyzer according to claim 9, wherein the laminate further comprises a second electrode for electrolysis, the second electrode for electrolysis serves as an anode electrode, and the second electrode for electrolysis and the anode are electrically connected.

11. A method for producing a new electrolyzer from an existing electrolyzer comprising an anode, a cathode that is opposed to the anode, a membrane that is arranged between the anode and the cathode, and a support that directly supports the cathode, the method comprising:

replacing the membrane by a laminate comprising a new membrane and a first electrode for electrolysis and arranging an elastic body between the first electrode for electrolysis and the cathode in the existing electrolyzer, wherein the elastic body presses the first electrode for electrolysis in a direction toward the anode, a thickness of the first electrode for electrolysis is 120 μm or less, the first electrode for electrolysis, the elastic body, the cathode, and the support are electrically connected, and the new electrolyzer that is produced is the electrolyzer according to claim 1.

12. The method for producing the electrolyzer according to claim 11, wherein the laminate further comprises a second electrode for electrolysis, the second electrode for electrolysis serves as an anode electrode, and the second electrode for electrolysis and the anode are electrically connected.

13. An electrolyzer comprising:

an anode, a cathode that is opposed to the anode, a membrane that is arranged between the anode and the cathode, a first electrode for electrolysis that is arranged between the membrane and the cathode, a second electrode for electrolysis that is arranged between the anode and the membrane, an elastic body that is arranged between the first electrode for electrolysis and the cathode and presses the first electrode for electrolysis in a direction toward the anode, and a support that directly supports the cathode, wherein the first electrode for electrolysis serves as a cathode electrode, the second electrode for electrolysis serves as an anode electrode, a thickness of the first electrode for electrolysis is 120 μm or less, the first electrode for electrolysis is one that is configured such that it can be in the form of a wound body before it is arranged in the electrolyzer in an unwound state, the first electrode for electrolysis, the elastic body, the cathode, and the support are electrically connected, and the second electrode for electrolysis and the anode are electrically connected.

14. A method for producing a new electrolytic cell from an existing electrolytic cell comprising an anode, a cathode that is opposed to the anode, a membrane that is arranged between the anode and the cathode, and a support that directly supports the cathode, the method comprising:

replacing the membrane by a laminate comprising a new membrane and a first electrode for electrolysis and arranging an elastic body between the first electrode for electrolysis and the cathode in the existing electrolytic cell, wherein the elastic body presses the first electrode for electrolysis in a direction toward the anode, a thickness of the first electrode for electrolysis is 120 μm or less, the first electrode for electrolysis, the elastic body, the cathode, and the support are electrically connected, and the new electrolyzer that is produced is the electrolyzer according to claim 13.

15. The method for producing the electrolytic cell according to claim 14, wherein the laminate further comprises a second electrode for electrolysis, the second electrode for electrolysis serves as an anode electrode, and the second electrode for electrolysis and the anode are electrically connected.

16. An electrolytic cell comprising:

an anode, a cathode that is opposed to the anode, a membrane that is arranged between the anode and the cathode, a first electrode for electrolysis that is arranged between the membrane and the cathode, a second electrode for electrolysis that is arranged between the anode and the membrane, an elastic body that is arranged between the first electrode for electrolysis and the cathode and presses the first electrode for electrolysis in a direction toward the anode, and a support that directly supports the cathode, wherein the first electrode for electrolysis serves as a cathode electrode, the second electrode for electrolysis serves as an anode electrode, a thickness of the first electrode for electrolysis is 120 μm or less, the first electrode for electrolysis is one that is configured such that it can be in the form of a wound body before it is arranged in the electrolyzer in an unwound state, the first electrode for electrolysis, the elastic body, the cathode, and the support are electrically connected, and the second electrode for electrolysis and the anode are electrically connected.

17. An electrolyzer comprising the electrolytic cell according to claim 16.

* * * * *